US009247784B2

(12) United States Patent
Stewart

(10) Patent No.: US 9,247,784 B2
(45) Date of Patent: Feb. 2, 2016

(54) WEARABLE EXERCISE APPARATUSES

(71) Applicant: Jeffrey David Stewart, Sammamish, WA (US)

(72) Inventor: Jeffrey David Stewart, Sammamish, WA (US)

( * ) Notice: Subject to any disclaimer, the term of this patent is extended or adjusted under 35 U.S.C. 154(b) by 140 days.

(21) Appl. No.: 13/844,369

(22) Filed: Mar. 15, 2013

(65) Prior Publication Data

US 2013/0340287 A1 Dec. 26, 2013

Related U.S. Application Data

(60) Provisional application No. 61/663,493, filed on Jun. 22, 2012.

(51) Int. Cl.

| | |
|---|---|
| ***A43B 13/18*** | (2006.01) |
| ***A43B 13/14*** | (2006.01) |
| ***A63B 21/00*** | (2006.01) |
| ***A63B 69/00*** | (2006.01) |
| ***A63B 21/005*** | (2006.01) |
| ***A63B 21/008*** | (2006.01) |
| ***A63B 21/02*** | (2006.01) |

(Continued)

(52) U.S. Cl.

CPC ..... *A43B 13/14* (2013.01); *A43B 13/183* (2013.01); *A43B 13/184* (2013.01); *A63B 21/0056* (2013.01); *A63B 21/00069* (2013.01); *A63B 21/0083* (2013.01); *A63B 21/023* (2013.01); *A63B 21/068* (2013.01); *A63B 21/143* (2013.01); *A63B 21/1449* (2013.01); *A63B 21/1465* (2013.01); *A63B 24/0062* (2013.01); *A63B 24/0087* (2013.01); *A63B 69/0028* (2013.01); *A63B 2024/0071* (2013.01); *A63B 2024/0093* (2013.01); *A63B 2069/0031* (2013.01); *A63B 2220/16* (2013.01); *A63B 2220/40* (2013.01); *A63B 2220/52* (2013.01); *A63B 2220/801* (2013.01); *A63B 2220/833* (2013.01); *A63B 2225/50* (2013.01); *A63B 2230/015* (2013.01)

(58) Field of Classification Search

CPC ... A43B 13/181; A43B 13/183; A43B 13/184
USPC ..... 36/7.8, 27, 132
See application file for complete search history.

(56) References Cited

U.S. PATENT DOCUMENTS

| | | | |
|---|---|---|---|
| 1,516,395 | A | 11/1924 | Micell |
| 1,613,538 | A | 1/1927 | Schad |

(Continued)

FOREIGN PATENT DOCUMENTS

| | | |
|---|---|---|
| DE | 2064414 | 7/1972 |
| EP | 0103041 | 3/1984 |

(Continued)

OTHER PUBLICATIONS

International Searching Authority, International Search Report and Written Opinion, PCT Patent Application PCT/US2009/032748, mailed Apr. 27, 2009, 11 pages.

*Primary Examiner* — Marie Bays
(74) *Attorney, Agent, or Firm* — Perkins Coie LLP

(57) ABSTRACT

An exercise apparatus includes a pair of apparatuses wearable on feet of a user. Each apparatus is configurable between expanded configurations and compressed configurations to simulate a selected motion when the user wearing the pair of apparatuses travels by foot. One of the apparatuses can move towards an expanded configuration while the other apparatus moves towards a compressed configuration.

26 Claims, 57 Drawing Sheets

(51) Int. Cl.
*A63B 21/068* (2006.01)
*A63B 24/00* (2006.01)

(56) References Cited

U.S. PATENT DOCUMENTS

| | | | | |
|---|---|---|---|---|
| 1,843,493 | A | | 2/1932 | Pfeifenbring |
| 2,172,000 | A | | 9/1939 | Wenker |
| 2,242,748 | A | | 5/1941 | Fulwiler |
| 2,345,085 | A | | 3/1944 | Albert et al. |
| 2,404,083 | A | | 7/1946 | Murray |
| 2,644,248 | A | | 7/1953 | Seligman |
| 2,837,840 | A | | 6/1958 | Kerpel |
| 3,377,722 | A | | 4/1968 | Downing |
| 3,641,601 | A | | 2/1972 | Sieg |
| 4,133,086 | A | | 1/1979 | Brennan |
| 4,196,903 | A | | 4/1980 | Illustrato |
| 4,271,606 | A | | 6/1981 | Rudy |
| 4,305,212 | A | | 12/1981 | Coomer |
| 4,319,412 | A | | 3/1982 | Muller et al. |
| 4,451,994 | A | | 6/1984 | Fowler |
| 4,492,374 | A | | 1/1985 | Lekhtman et al. |
| 4,534,124 | A | * | 8/1985 | Schnell ..... 36/114 |
| 4,547,978 | A | | 10/1985 | Radford |
| 4,619,059 | A | | 10/1986 | Koniuk |
| 4,697,361 | A | | 10/1987 | Ganter et al. |
| 4,754,559 | A | | 7/1988 | Cohen |
| 4,864,737 | A | | 9/1989 | Marrello |
| 4,912,859 | A | * | 4/1990 | Ritts ..... 36/7.8 |
| 4,936,030 | A | | 6/1990 | Rennex |
| 5,138,776 | A | | 8/1992 | Levin |
| 5,205,798 | A | | 4/1993 | Lekhtman |
| 5,224,810 | A | | 7/1993 | Pitkin |
| 5,337,492 | A | | 8/1994 | Anderie et al. |
| 5,435,079 | A | * | 7/1995 | Gallegos ..... 36/38 |
| 5,464,380 | A | | 11/1995 | Ikeda et al. |
| 5,643,148 | A | | 7/1997 | Naville |
| 5,647,147 | A | | 7/1997 | Coomer |
| 5,675,915 | A | | 10/1997 | Faughn et al. |
| 5,685,092 | A | | 11/1997 | Prieskorn |
| 5,794,359 | A | | 8/1998 | Jenkins et al. |
| 5,797,198 | A | * | 8/1998 | Pomerantz ..... 36/27 |
| 5,902,214 | A | | 5/1999 | Makikawa et al. |
| 5,916,071 | A | | 6/1999 | Lee |
| 5,918,502 | A | | 7/1999 | Bishop |
| 6,115,943 | A | * | 9/2000 | Gyr ..... 36/35 R |
| 6,266,897 | B1 | | 7/2001 | Seydel et al. |
| 6,266,898 | B1 | | 7/2001 | Cheng |
| 6,312,361 | B1 | | 11/2001 | Hayes |
| 6,349,487 | B1 | | 2/2002 | Hice |
| 6,405,455 | B1 | | 6/2002 | Walsh |
| 6,436,012 | B1 | | 8/2002 | Naville |
| 6,457,262 | B1 | | 10/2002 | Swigart |
| 6,516,540 | B2 | | 2/2003 | Seydel et al. |
| 6,722,059 | B2 | | 4/2004 | Robinson, Jr. et al. |
| 6,754,981 | B1 | | 6/2004 | Edwards |
| 6,782,639 | B1 | | 8/2004 | Muller |
| 6,823,612 | B2 | | 11/2004 | Manz et al. |
| 6,845,573 | B2 | | 1/2005 | Litchfield et al. |
| 6,915,594 | B2 | | 7/2005 | Kim |
| 6,962,008 | B2 | | 11/2005 | Manz et al. |
| 6,979,287 | B2 | | 12/2005 | Elbaz et al. |
| 6,983,555 | B2 | | 1/2006 | Lacorazza et al. |
| 6,983,557 | B2 | | 1/2006 | Manz et al. |
| 7,007,412 | B2 | | 3/2006 | Munster |
| 7,140,124 | B2 | | 11/2006 | Manz et al. |
| 7,181,867 | B2 | | 2/2007 | Litchfield et al. |
| 7,188,439 | B2 | | 3/2007 | DiBenedetto et al. |
| 7,254,905 | B2 | | 8/2007 | Dennison |
| 7,290,354 | B2 | | 11/2007 | Perenich |
| 7,377,057 | B2 | | 5/2008 | Lacorazza et al. |
| 7,383,648 | B1 | | 6/2008 | Litchfield et al. |
| 7,788,823 | B2 | | 9/2010 | Killion et al. |
| 7,905,033 | B1 | * | 3/2011 | Perenich ..... 36/27 |
| 7,950,166 | B1 | * | 5/2011 | Perenich ..... 36/27 |
| 8,617,033 | B2 | * | 12/2013 | Stewart ..... 482/77 |
| 2002/0083616 | A1 | | 7/2002 | Hajianpour |
| 2003/0121178 | A1 | * | 7/2003 | Rennex ..... 36/27 |
| 2004/0177531 | A1 | * | 9/2004 | DiBenedetto et al. ..... 36/132 |
| 2005/0005472 | A1 | * | 1/2005 | Perenich ..... 36/27 |
| 2005/0086838 | A1 | | 4/2005 | Khantzis |
| 2005/0132617 | A1 | | 6/2005 | Potter et al. |
| 2005/0183292 | A1 | * | 8/2005 | DiBenedetto et al. ..... 36/132 |
| 2005/0262725 | A1 | * | 12/2005 | Rennex et al. ..... 36/7.8 |
| 2006/0021262 | A1 | * | 2/2006 | Killion et al. ..... 36/136 |
| 2006/0048411 | A1 | * | 3/2006 | Lindqvist et al. ..... 36/27 |
| 2006/0075657 | A1 | * | 4/2006 | Chu ..... 36/28 |
| 2006/0137217 | A1 | * | 6/2006 | Asmundson ..... 36/7.8 |
| 2007/0006489 | A1 | | 1/2007 | Case et al. |
| 2007/0074430 | A1 | | 4/2007 | Coomer |
| 2008/0141559 | A1 | * | 6/2008 | Marc ..... 36/27 |
| 2008/0209764 | A1 | | 9/2008 | Fusco |
| 2008/0276494 | A1 | | 11/2008 | Lacorazza et al. |
| 2008/0317487 | A1 | | 12/2008 | Murakami |
| 2009/0100719 | A1 | | 4/2009 | Pierre |
| 2009/0137933 | A1 | | 5/2009 | Lieberman et al. |
| 2009/0260426 | A1 | | 10/2009 | Lieberman et al. |
| 2010/0063778 | A1 | | 3/2010 | Schrock et al. |
| 2010/0063779 | A1 | | 3/2010 | Schrock et al. |
| 2010/0251571 | A1 | * | 10/2010 | Woodard ..... 36/103 |
| 2014/0336008 | A1 | | 11/2014 | Stewart |

FOREIGN PATENT DOCUMENTS

| | | |
|---|---|---|
| FR | 2594344 | 8/1987 |
| JP | 2006020656 | 1/2006 |
| WO | 2005011419 | 2/2005 |

* cited by examiner 1702
1703
1704
1704
1704

WEARABLE EXERCISE APPARATUSES

CROSS-REFERENCE TO RELATED APPLICATION

This patent application claims the benefit of commonly assigned U.S. Provisional Patent Application Ser. No. 61/663,493, entitled "WEARABLE EXERCISE APPARATUSES" and filed on Jun. 22, 2012, which is incorporated herein in its entirety by reference.

TECHNICAL FIELD

The present disclosure generally relates to exercise apparatuses and, more specifically, to wearable cardiovascular exercise footwear.

DESCRIPTION OF THE RELATED ART

Exercise equipment for cardiovascular exercise is often used in gymnasiums or homes. It may be difficult or impossible to use stationary exercise equipment while performing other activities. For example, an individual using a treadmill or an elliptical machine may be unable to perform activities that require mobility, such as many household chores. This inconvenience may deter people with busy schedules from exercising. People also may not exercise because of the travel time to and from sport facilities, hiking trails, gymnasiums, or other workout facilities suitable for performing strenuous cardiovascular exercises that can strengthen and build muscles.

Activities (e.g., running, jogging, and walking) can be performed without utilizing stationary exercise equipment. Running and other high impact activities may be unsuitable for people with arthritis, damaged bones (e.g., bones with stress fractures), damaged joints, or damaged connective tissue. Running may also lead to injuries, tissue damage, and pain/discomfort. For example, chondromalacia patella (commonly referred to as runner's knee) is a condition that may be caused by running. To minimize trauma to joints or connective tissue, people often perform low impact activities; however, low impact activities, such as walking, often do not provide a desired level of aerobic activity and may be ineffective at strengthening or building muscles.

BRIEF SUMMARY

Exercise apparatuses disclosed herein can be used while performing various activities, such as walking, running, hiking, performing workout routines, or other normal everyday activities. The exercise apparatuses can be footwear worn on an individual's feet in order to provide a desired exercise program. The exercise program can be designed to simulate various types of motions, strengthen muscles, tone muscles, increase aerobic activity, control impact stresses, or the like. The exercise apparatuses, in some embodiments, simulate climbing (e.g., stairs, slopes) while the user walks on generally flat surfaces. The exercise apparatuses can be used while performing numerous types of everyday activities, including housework, gardening, or the like, without causing the trauma often associated with high impact activities. The exercise apparatuses can provide a strenuous workout without the trauma often associated with high impact activities.

In certain embodiments, a wearable exercise apparatus does not begin to compress until after the user has completed most or substantially all of the exercise that involves lifting the user's body up and onto a forward placed shoe. After the user's rearward foot with the rearward exercise apparatus has left the ground, the forward exercise apparatus can collapse. In some embodiments, the forward exercise apparatus begins to compress as soon as possible after the rearward exercise apparatus has left the ground. Consequently, the user can walk relatively fast and/or run as the exercise apparatuses are repeatedly opened and closed.

To reduce the amount of vertical work, the rearward shoe can be partially open to allow the rearward foot to be elevated as the user steps up and onto the forward placed foot. In other embodiments, the vertical work can be decreased by reducing the maximum expansion distance. The maximum expansion distance can thus be set to various levels to achieve different amounts of vertical work without changing the compressed configuration. Thus, the vertical work can be adjusted as desired.

In some embodiments, a pair of wearable exercise apparatuses is provided. Each exercise apparatus is configured to be worn on a foot and is movable between different configurations, such as open configurations and closed configurations. All or part of the wearable exercise apparatuses may move from open configurations to closed configurations based on the forces applied by the wearer, a timing sequence, the motion of the wearer's body, or combinations thereof. The wearable exercise apparatuses can have a collapsible sole, a collapsible heel, or other type of component that changes configurations to provide the desired actions. In certain embodiments, each exercise apparatus includes a collapsible heel with a step-up mechanism positioned generally underneath the user's heel. To facilitate natural body movements, the step-up mechanism can collapse as the user transfers his or her weight forward, for example, towards the ball of the foot. The exercise apparatuses may assume different configurations at different points during a gait, for example, when the heel is placed on the ground, when weight is transferred along the exercise apparatus, when the user pushes off of the ground, or the like.

In some embodiments, a footwear apparatus includes a mechanism that begins to compress after the user has lifted a significant portion of his or her body mass (e.g., all or most of his or her body mass) up and onto the mechanism. The mechanism begins to compress when the body moves forward, after a period of time, based on weight transfer or other body motion. In certain embodiments, the mechanism begins to compress after the user's other footwear apparatus has left the ground. The mechanism compresses to allow the user's body to descend. After the mechanism has partially or completely compressed, the user can put the other footwear apparatus on the ground. Once the footwear apparatus with the partially or completely compressed mechanism is moved away from the ground, the unloaded mechanism can return to an uncompressed configuration. The mechanism of the loaded footwear apparatus on the ground can collapse. The mechanisms can be repeatedly moved between a compressed configuration and an uncompressed configuration.

A pair of footwear apparatuses, in some embodiments, is used to walk at relatively high speeds to repeatedly lift the user's body to increase cardiovascular exercise. In certain embodiments, each apparatus moves to a fully collapsed position so that the user has to lift his or her body up and onto the extended footwear apparatus on the other foot. In some embodiments, a step-up mechanism of each footwear apparatus collapses at a generally constant rate. In other embodiments, the rate of collapse is proportional to the applied force. In some embodiments, the footwear apparatuses can be modified or adjusted to allow collapsing when the user's weight is positioned at a desired weight-bearing portion. The weight-bearing portion can be part of a sole, coupled to a sole, or otherwise integrated into the footwear apparatus. In certain embodiments, a weight-bearing portion may have an expanded configuration for keeping the user's foot elevated, even when the user stands on the weight-bearing portion. After the amount of mass supported by the weight-bearing portion decreases, the weight-bearing portion can collapse. For example, a weight-bearing portion may extend along the rear third to half of the length of the footwear apparatus. After the user transfers weight to another portion of the footwear apparatus, the weight-bearing portion can begin to collapse. As such, compression of the footwear apparatus is based on when the user's weight gets to an appropriate portion of the footwear apparatus.

Exercise apparatuses, in some embodiments, have one or more collapsible weight bearing portions, dampening portions, expansion portions, or the like. In certain embodiments, a weight-bearing portion is a section that supports most of the user's weight when this section is in an expanded configuration. Collapsible weight bearing portions may provide substantially no rebound or propelling force after supporting substantially all of the user's weight, after the exercise apparatus has collapsed (for example, after it has been collapsed for a desired length of time), in response to a user pushing off the ground (for example, pushing off of the ground using the dampening portion), combinations thereof, or the like. In certain embodiments, a collapsible weight-bearing portion is positioned at a rearward end of the apparatus. A dampening portion, in some embodiments, is positioned at a forward end of the apparatus. For example, a weight-bearing portion can support the user's heel, and a dampening portion can support the ball of the user's foot. Some embodiments have multiple collapsible weight-bearing portions. Straps, couplers, adhesives, or the like can couple the collapsible mechanisms to the footwear apparatus. In other embodiments, the collapsible mechanisms are monolithically formed with a component of the shoe or integrated into the footwear apparatus. In some embodiments, the mechanisms are permanently encapsulated in the sole of the shoe. In other embodiments, the collapsible weight bearing mechanisms are removable from the sole such that the step-up mechanisms can be replaced to provide different functionality.

Some embodiments include multiple collapsible resistance mechanisms. In some embodiments with multiple collapsible resistance mechanisms, the height of a collapsible mechanism defines a height of a portion of an exercise apparatus. When an exercise apparatus is weighted, the height of a collapsible resistance mechanism determines the distance the user's foot is above the contact surface. In some exercise apparatuses with multiple collapsible resistance mechanisms the resistive force of a rearward mechanism may be reduced to allow the mechanism to move towards the compressed configuration without any corresponding reduction in resistive force of other collapsible mechanism(s) on the same exercise apparatus. The resistive force of other collapsible mechanisms may or may not be reduced after the time at which the rearward mechanism begins to move towards a compressed configuration. In some embodiments the resistive force of a rearward collapsible mechanism may be reduced after the mechanism has supported the user's weight and the resistive force of a forward collapsible mechanism will be reduced later in the user's gait as the user's mass is substantially supported by the forward mechanism.

In some embodiments with collapsible resistance mechanisms located under or forward of the ball of the user's foot, the resistive force of a forward resistance mechanism is controlled in such a manner to absorb energy as the user steps from the current footwear apparatus to another exercise apparatus (for example, an exercise apparatus worn on the other foot of the user). The resistive force of the mechanism may be based in part on sensor data, a timing sequence, or information received from another footwear apparatus, user input, or other parameters. In some embodiments, the reduction of the resistive force of a forward collapsible mechanism may be initiated when a footwear apparatus worn on the other foot of the user is placed on the contact surface.

In some embodiments with multiple collapsible resistance mechanisms, the resistance profile of the collapsible mechanisms may vary over time. The changes in resistance may be based on desired level of exercise, desired muscles to exercise, desired simulation (e.g. climbing stairs, climbing a slope, walking in sand or gravel, etc.), characteristics of the user such as their weight or characteristics of their gait, their walking speed, characteristics of the terrain on which the user is walking, or the like. Some exercise apparatuses with multiple collapsible resistance mechanisms contain a controller which controls the resistance profiles of the collapsible mechanisms independently of each other. Some exercise apparatuses with multiple collapsible resistance mechanisms have means for the user to input desired exercise characteristics which may affect how a controller sets the resistance profile of one or more collapsible resistance mechanisms.

In some embodiments, a footwear apparatus comprises a selectively collapsible weight-bearing heel, a central release portion, and a forward dampening portion. The dampening portion is configured to provide substantially no rebound or propelling force. The weight-bearing heel is configured to support the user's heel and to collapse based on at least one of relative applied forces, an absolute applied force, rates of change of applied forces, force distributions, or combinations thereof. In some embodiments, the dampening portion extends along most of or a substantial portion of the length of the shoe. In certain embodiments, the central release portion may at least partially overlap with the weight-bearing heel. The central release portion can cause the weight-bearing heel to assume different configurations. In some embodiments, the central release portion unlocks the weight-bearing heel.

In some embodiments, an exercise apparatus for increasing aerobic activity includes a collapsible step-up mechanism and a forward sole connected to a shoe main body. A step-up mechanism can be integrally formed with the sole. In other embodiments, a collapsible mechanism is detachably coupled to the sole. The sole can support the ball of the user's foot. Different step-up mechanisms can be used to provide different types of workouts. In certain embodiments, a step-up mechanism is positioned underneath the user's heel during use. For example, the sole can extend outwardly from one side of the step-up mechanism. In cantilevered embodiments, the sole can be coupled to a step-up mechanism in a cantilevered fashion. In some embodiments, a plurality of collapsible resistance mechanisms can be positioned at different locations along the length of the shoe. The collapsible mechanisms can be independently operated to provide different types of motion and may or may not provide propelling or rebound forces. The independent operation can be based on force relationships, pressure distributions, changes in pressure distributions, applied forces, changes in applied forces, or the like.

In some embodiments, a footwear apparatus for increasing aerobic activity comprises a shoe main body wearable on a foot of a user, a sole having a toe support region, and a collapsible resistance mechanism. The collapsible resistance mechanism is coupled to or integrated with the shoe main body. The collapsible resistance mechanism has an open configuration and a closed configuration and is self-expandable.

The collapsible resistance mechanism, in some embodiments, is configured to support the user's body mass when in the open configuration and to move towards the closed configuration in response to a change in a pressure distribution applied by the user while substantially all or most of the user's body mass is supported by the collapsible resistance mechanism.

In other some embodiments, a footwear apparatus is wearable on a user's foot. The footwear apparatus has a raised configuration for supporting the user's body mass and a lowered configuration. The footwear apparatus moves from the raised configuration in response to forces applied by the user after the user has stepped up and onto the footwear apparatus.

In some embodiments, an exercise apparatus includes a controller capable of controlling a resistive force, the rate of compression, rate of expansion, timing (e.g., timing of compression, timing of expansion, time delays, or the like), step-up height versus applied forces relationship, automated adjustment of settings, or the like. In some embodiments, one or more sensors communicate with the controller to provide feedback. The controller can control any number collapsible resistance mechanisms based, at least in part, on the output from the sensor(s). The output can include position signals, acceleration signals, force signals, pressure data, combinations thereof, or the like.

The controller can be used to adjust operation of the exercise apparatus to provide a desired range of motion, to have a wearer reach a desired level of exercise, target specific muscles, simulate an activity (e.g. climbing steps, climbing a slope, hiking, walking on sand or gravel, etc.) or the like. The controller can communicate with other controllers (e.g., a controller of another exercise apparatus) or other devices or systems, including smart phones, diagnostic equipment, networks (including wireless networks), or the like. The sensors can be accelerometers, force sensors, pressure sensors, strain gauges, proximity sensors, or the like.

The exercise apparatus, in some embodiments, includes an expandable sole assembly that is adjustable to provide parallel movement, non-parallel movement, or both. The type of movement can be selected based on the targeted muscles, desired levels of exercise, or desired simulation. In certain embodiments, parallel expansion keeps the user's foot generally parallel to the ground as the exercise apparatus is compressed. In non-parallel compression/expansion modes of operation, the user's foot can be non-parallel (e.g., inclined, declined, or otherwise non-parallel) with respect to the ground. For some exercise routines, exercise apparatuses are switched between non-parallel and parallel modes of operation. In yet other embodiments, the exercise apparatus may be configured to provide parallel compression/expansion or non-parallel compression/expansion, but not both. The exercise apparatus, in some embodiments, can keep the user's foot at a desired angle and/or move the user's foot between different orientations, for example, to adjust for pronation or supination.

BRIEF DESCRIPTION OF THE SEVERAL VIEWS OF THE DRAWINGS

Non-limiting and non-exhaustive embodiments are described with reference to the following drawings, wherein like reference numerals refer to like parts or acts throughout the various views unless otherwise specified.

DETAILED DESCRIPTION

The present detailed description is generally directed to exercise apparatuses that can provide different types of workout routines, exercises, and motions. The apparatuses can be used to simulate climbing steps, climbing up a slope, hiking, traversing uneven surfaces, walking on sand or gravel, and the like. Many specific details and certain exemplary embodiments are set forth in the following description and in FIGS. 1-60 to provide a thorough understanding of such embodiments. One skilled in the art, however, will understand that the disclosed embodiments may be practiced without one or more of the details described in the following description. Additionally, exercise apparatuses are discussed in the context of simulating climbing or walking on different types of terrains because they have particular utility in this context. However, the exercise apparatuses and their components can be used to simulate other activities.

Figure 1:
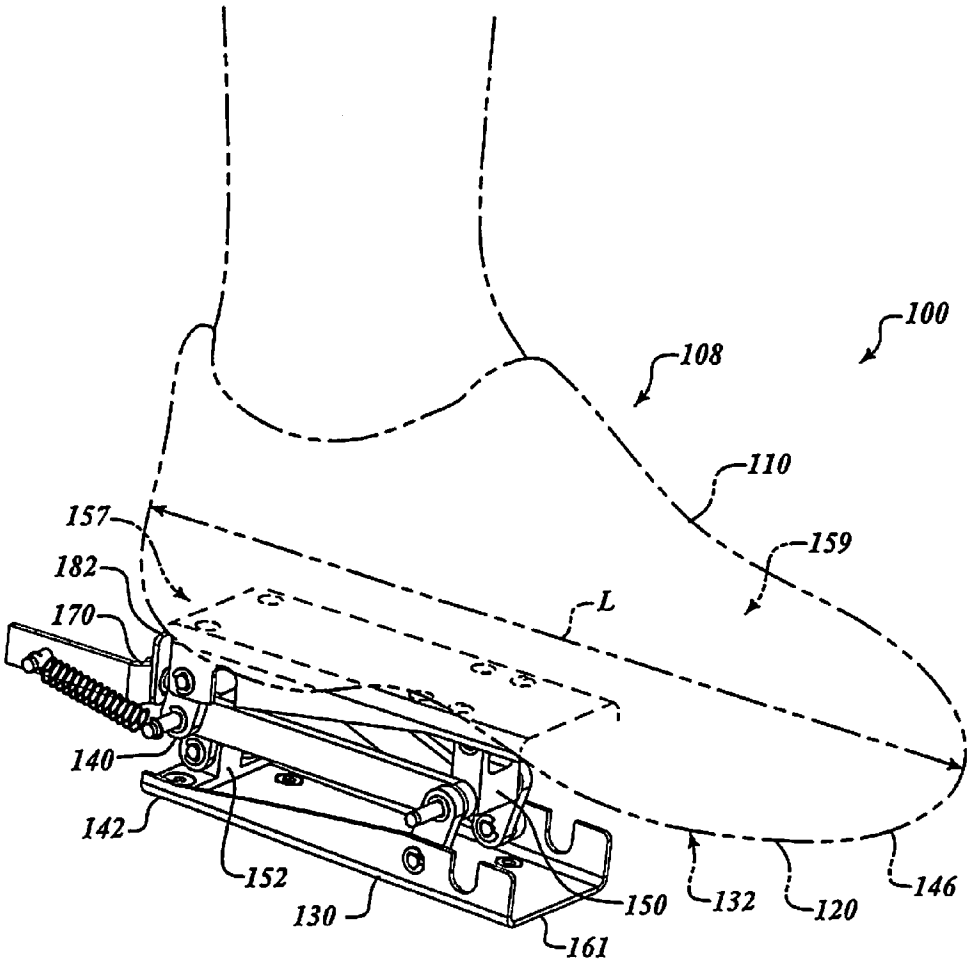
FIG. 1 is an isometric view of a wearable exercise apparatus, in accordance with one embodiment.

FIG. 1 illustrates a wearable exercise apparatus 100 that includes a shoe 108 with a shoe main body 110 wearable on a foot of a user, a sole 120, and a step-up mechanism 130. The step-up mechanism 130 is coupled to a lower surface 132 of the sole 120. The step-up mechanism 130 is movable between an open configuration, illustrated in FIG. 1, and a closed configuration.

When a user steps up and onto the step-up mechanism 130, the step-up mechanism 130 supports the user's weight. The step-up mechanism 130 can move towards the closed configuration. Advantageously, the step-up mechanism 130 can unlock in response to applied forces (e.g., absolute forces, relative forces, force distributions, movements, etc.). To enhance cardiovascular exercise, the step-up mechanism 130 can begin to close after most or all of the user's body mass is supported by the step-up mechanism 130. In some embodiments, the step-up mechanism 130 can be in a locked configuration when a user lands heel-first on the ground. As the user transfers weight forwardly along the step-up mechanism 130, the step-up mechanism 130 can begin to collapse. The user can continue to apply weight to the step-up mechanism 130 so that the step-up mechanism 130 reaches a fully compressed configuration. To prevent locking of the step-up mechanism 130, the ball of the user's foot can land on the ground before the user's heel. This keeps the step-up mechanism 130 in the unlocked configuration. By selecting how forces are initially applied to the step-up mechanism 130, the user can control the configuration of the step-up mechanism 130.

To ensure that the user's body is raised a significant distance, a locking device 140 can lock a rearward portion 142 of the step-up mechanism 130. The locking device 140 includes a rearward linkage assembly 152 and a stop 182. When the user initially steps onto a support surface, the rearward portion 142 in the open configuration may be locked so as to bear significant forces, irrespective of the forces applied to the rearward portion 142 by a user. After the user stands on the step-up mechanism 130, the user's body weight can be transferred towards a forward portion 146 of the exercise apparatus 100. This can cause movement of a forward linkage assembly 150. As the linkage assembly 150 rotates, the locking device 140 unlocks and allows the rearward linkage assembly 152 to collapse. In this manner, the step-up mechanism 130 can be unlocked in response to the user's body movement.

Figure 2:
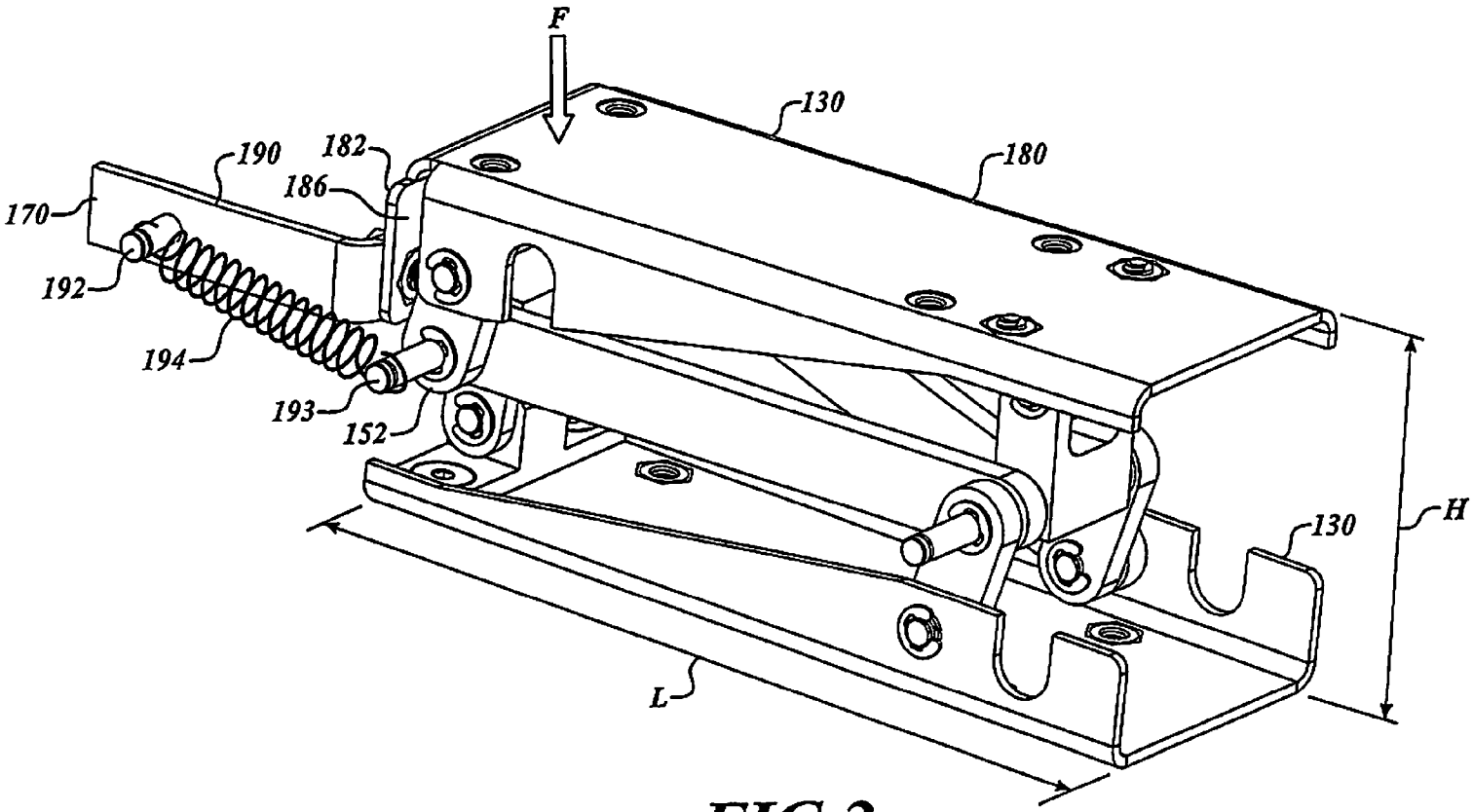
FIG. 2 is an isometric view of a step-up mechanism, in accordance with one embodiment.

Referring to FIGS. 1 and 2, the step-up mechanism 130 extends longitudinally along a rearward region 157 of the shoe 108. The rearward region 157 receives the user's heel. A forward region 159 of the shoe 108 extends in a cantilever fashion from the step-up mechanism 130. The illustrated forward region 159 receives the anterior portion of the user's foot. The rearward region 157 and forward region 159 thus support the heel and ball of the user's foot, respectively.

The dimensions and configuration of the step-up mechanism 130 can be selected based on the region of the user's foot that presses on the step-up mechanism 130. In certain embodiments, a longitudinal length L (shown in FIG. 2) of the step-up mechanism 130 can be less than about 20%, 30%, 40%, 60%, 80%, 90%, or 95% of the longitudinal length L (shown in FIG. 1) of the shoe 108, and a height H of the step-up mechanism 130 can be greater than about 0.5 inch, 2 inches, 3 inches, 5 inches, 7 inches, or the like. The height H can be adjustable and may be selected based on the desired type of exercise to be performed. In some embodiments, the step-up mechanism 130 can be replaced with another step-up mechanism to provide another type of exercise. For example, step-up mechanisms with different heights can be installed on the shoe 108 to provide different step-up heights. Step-up mechanisms with different lengths can be installed to adjust the timing for opening and closing. In other embodiments, the step-up mechanisms can be adjusted using mechanical adjustment mechanisms, a controller, or other type of component or feature for controlling the timing of opening and closing.

An opener assembly 170 of FIGS. 1 and 2 can bias the step-up mechanism 130 towards the open configuration with or without providing a propelling or restoring force. After the user raises the step-up mechanism 130 off of the ground, the opener assembly 170 can move the step-up mechanism 130 to the open configuration. The locking device 140 can be locked based on whether initial forces applied by a user are in front of or behind the tipping point. When sufficient forces are applied forward of the tipping point, the step-up mechanism 130 collapses. If sufficient forces are applied rearward of the tipping point, the step-up mechanism 130 is locked. The moments applied by the user can thus be used to operate the locking device 140. The locking device 140 can automatically lock once the step-up mechanism 130 reaches the open configuration. In this manner, the exercise apparatus 100 can be self-expanding.

Referring to FIG. 2, an upper member 180 of the step-up mechanism 130 can be coupled to or integrally formed with the sole 120. The upper member 180 includes the stop 182, illustrated as a bracket, that can inhibit or stop rearward movement of the rearward linkage assembly 152. The illustrated rearward linkage assembly 152 can bear against a face 186 of the stop 182, thereby keeping the step-up mechanism 130 in the open configuration.

A retainer 190 of the opener assembly 170 holds a rod 192. A biasing member 194 extends between the rod 192 and a rod 193 extending from the rearward linkage assembly 152. When the rod 193 moves forwardly as the step-up mechanism 130 collapses, the biasing member 194 is tensioned and provides a biasing force urging the rearward linkage assembly 152 back to its initial position. As such, the biasing member 194 can provide self-expansion. The biasing member 194 is shown removed in FIGS. 3 and 6. Other types of opener assemblies can also be used or located elsewhere, if needed or desired.

Figure 4:
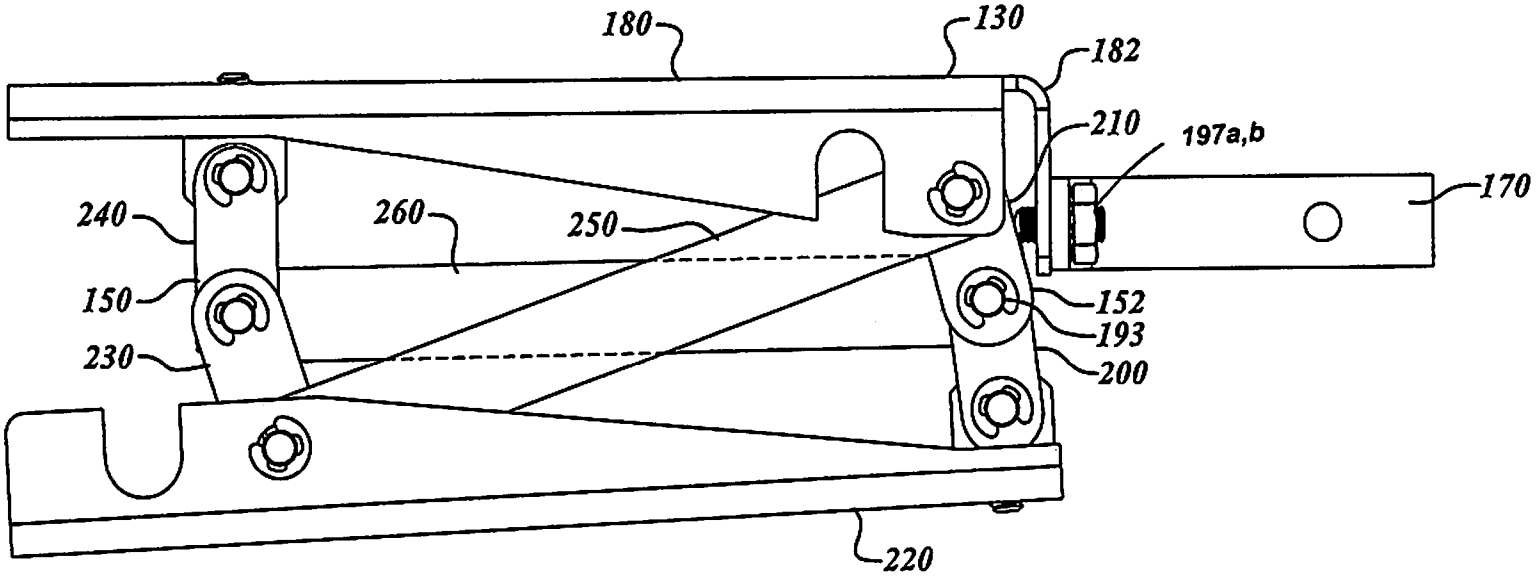
FIG. 4 is a side elevational view of a right side of the step-up mechanism of FIG. 2.

Referring to FIG. 4, the forward linkage assembly 150 includes link members 230, 240 pivotably coupled to the upper member 180 and a lower member 220, respectively. The rearward linkage assembly 152 includes link members 200, 210 pivotably coupled to the upper member 180 and the lower member 220, respectively. As the forward linkage assembly 150 collapses (for example, by pivoting forwardly), it pulls the rearward linkage assembly 152 away from the stop 182, such that the rearward linkage assembly 152 can collapse. The forward linkage assembly 150 therefore operates as a release mechanism.

Figure 5:
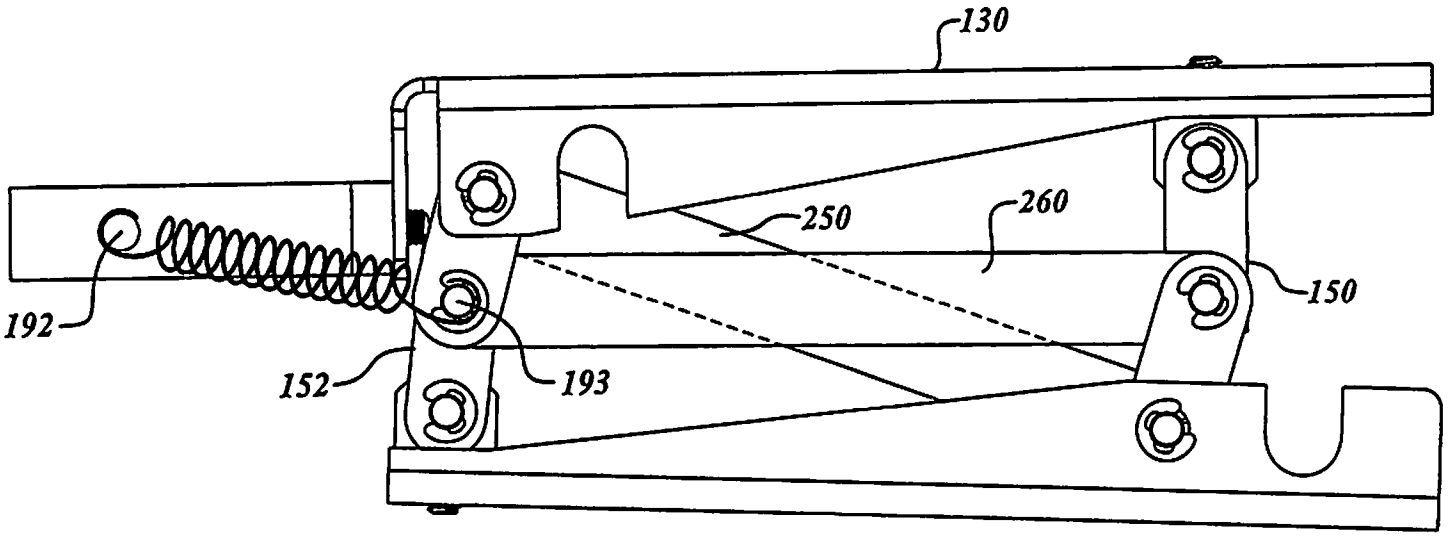
FIG. 5 is a side elevational view of a left side of the step-up mechanism of FIG. 2.
Figure 6:
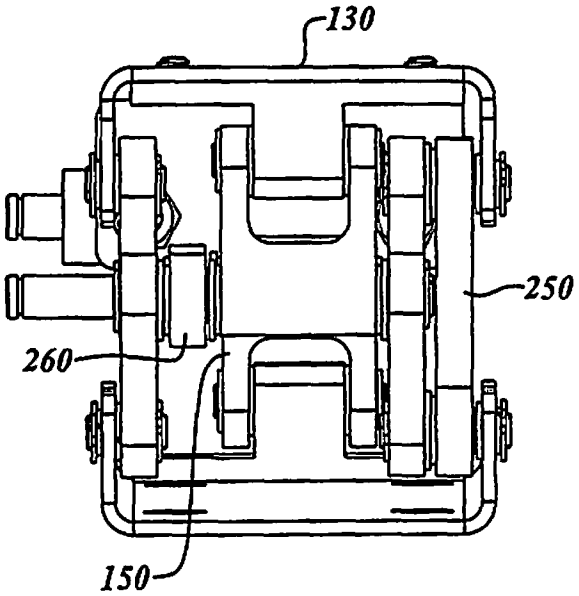
FIG. 6 is a front elevational view of the step-up mechanism of FIG. 2.
Figure 7:
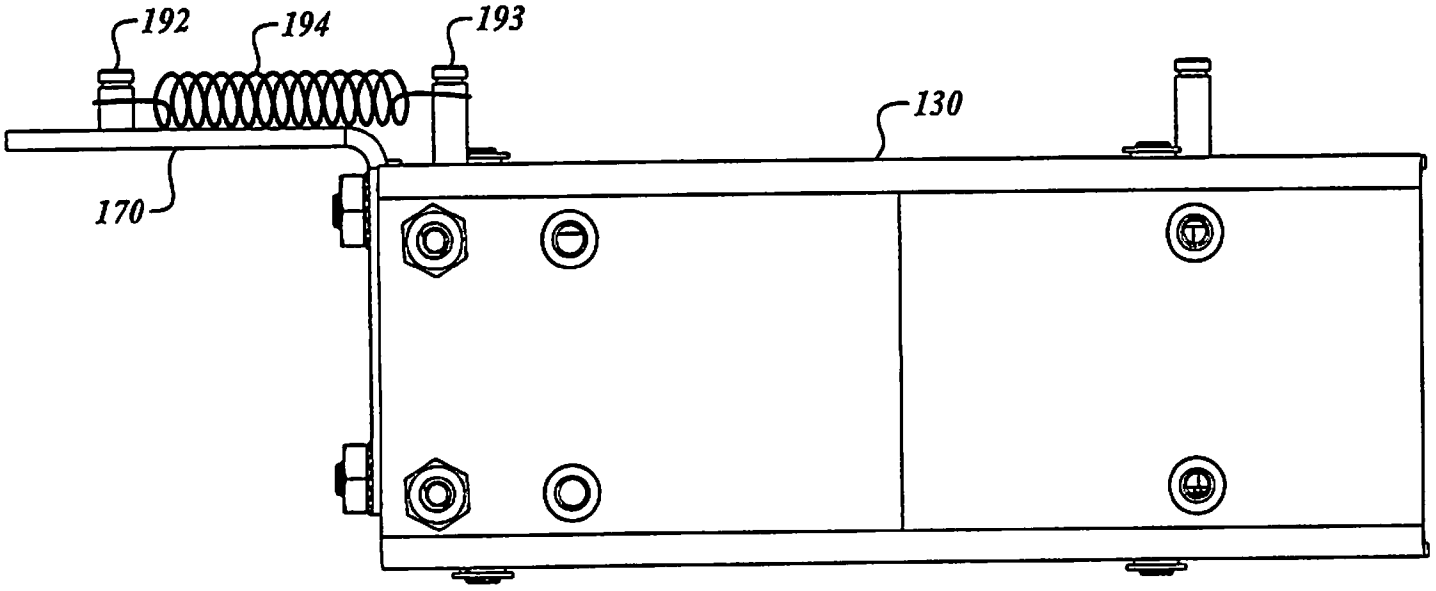
FIG. 7 is a bottom view of the step-up mechanism of FIG. 2.

FIGS. 5 and 6 show connectors 250, 260 extending between and pivotally coupled to the forward linkage assembly 150 and rearward linkage assembly 152.

Figure 8:
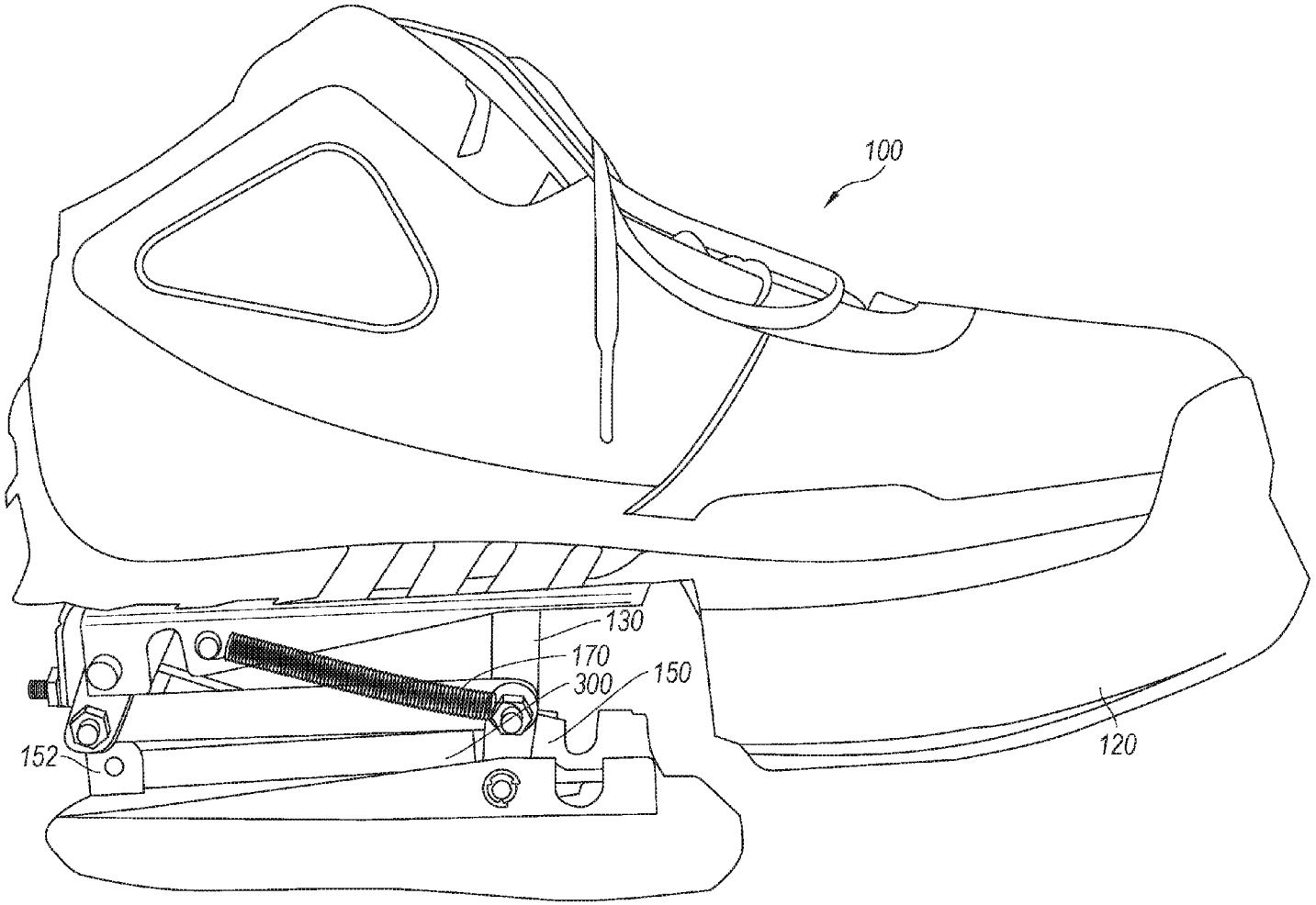
FIG. 8 is a pictorial view of a wearable exercise apparatus with the step-up mechanism in an open configuration.
Figure 9:
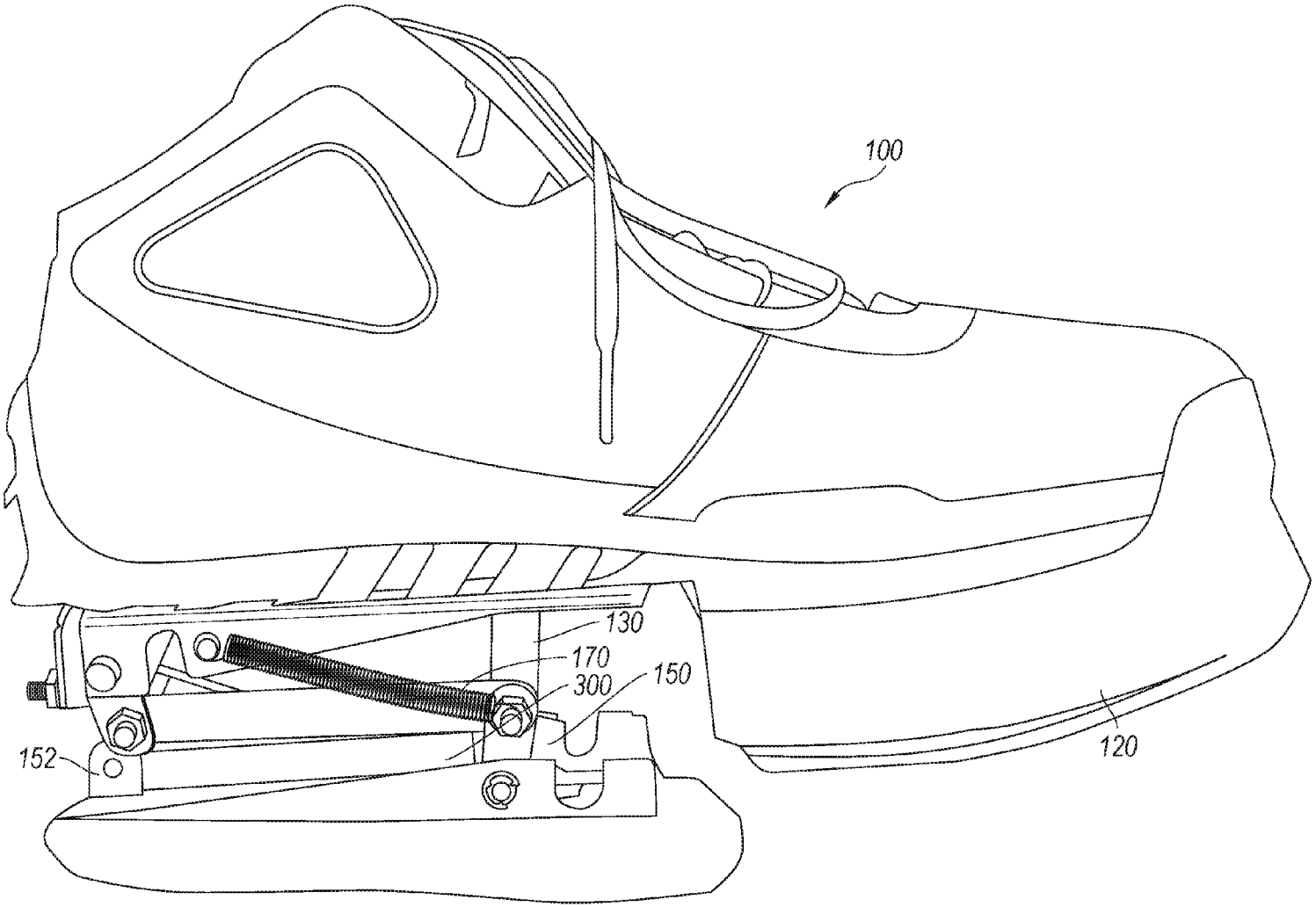
FIG. 9 is a pictorial view of a wearable exercise apparatus in an intermediate configuration.
Figure 10:
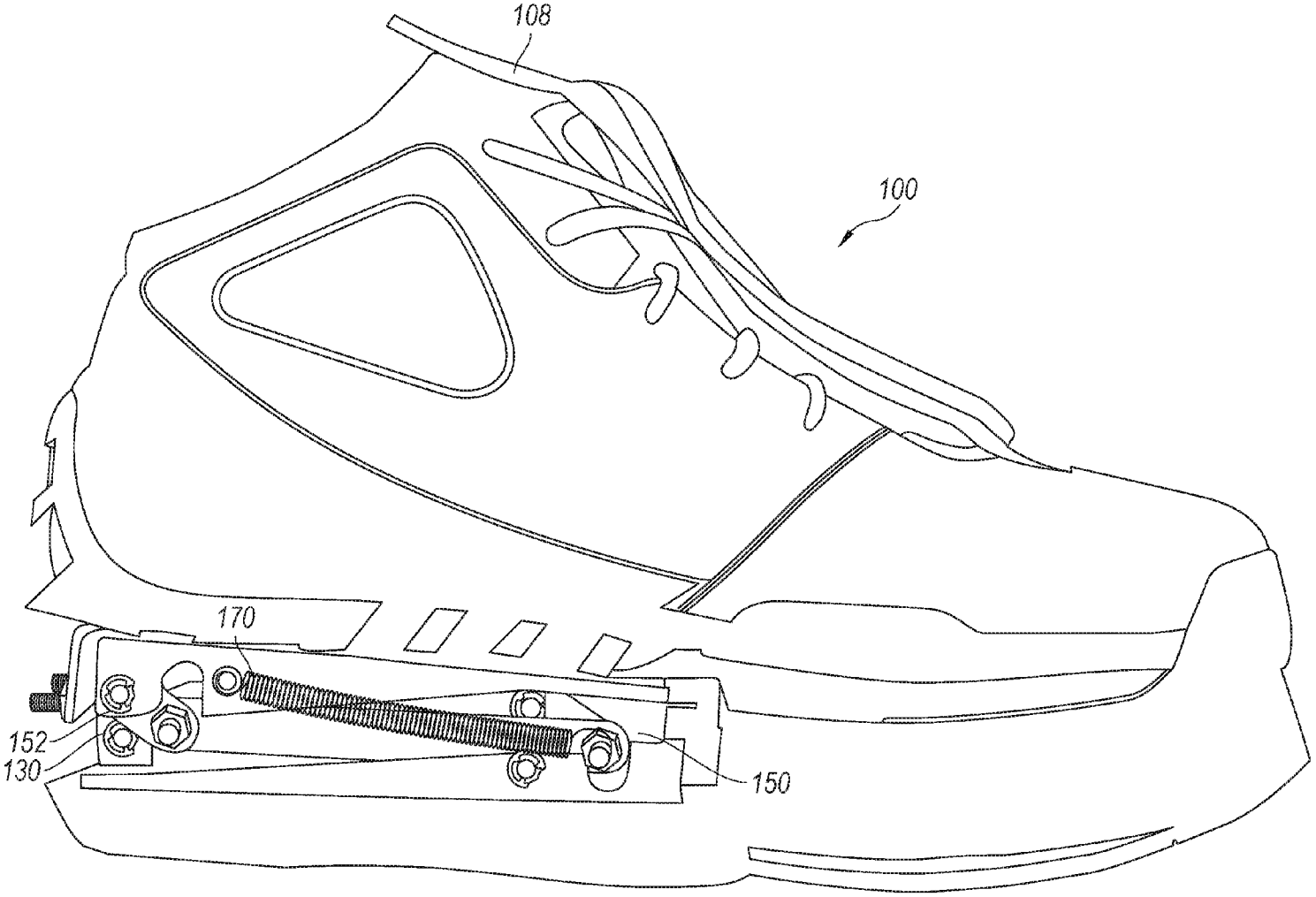
FIG. 10 is a pictorial view of a wearable exercise apparatus in a closed configuration.
Figure 11:
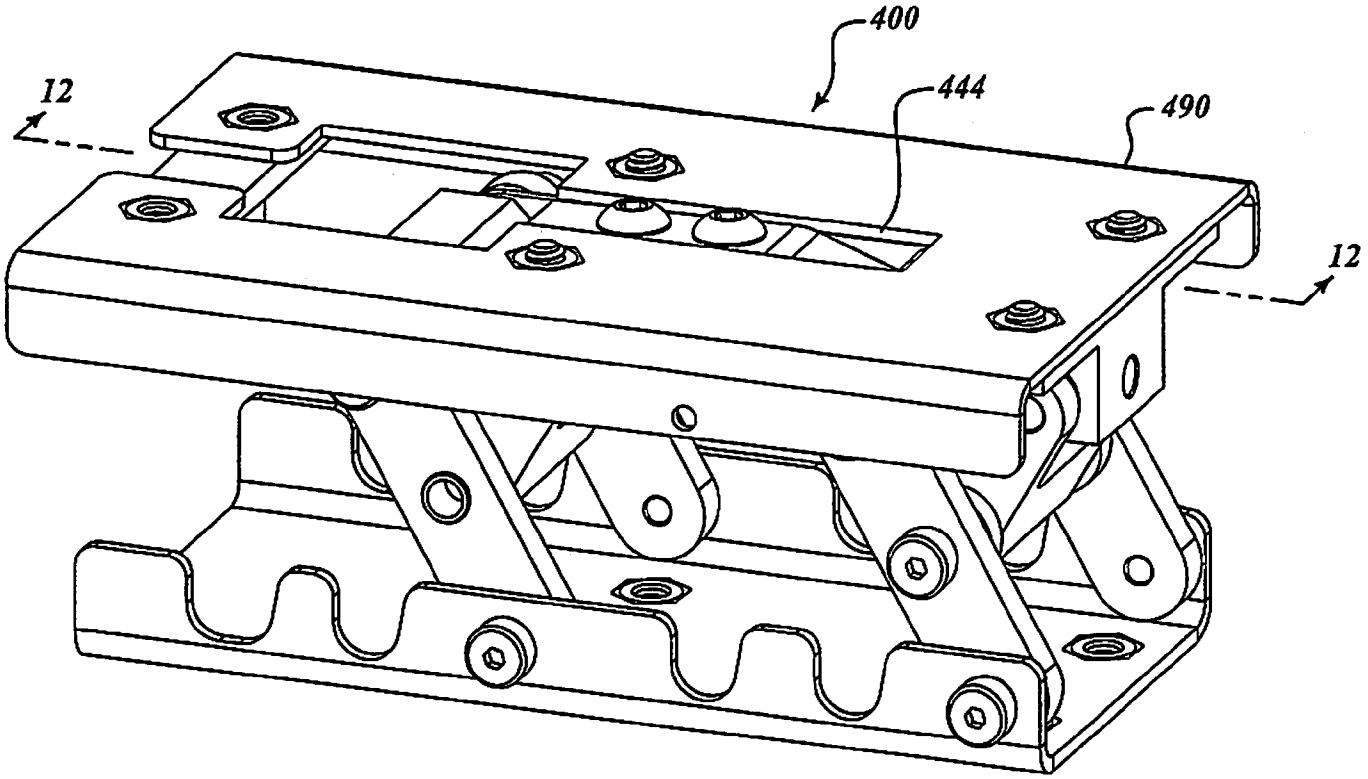
FIG. 11 is an isometric view of a portion of a step-up mechanism, in accordance with one embodiment.

FIGS. 8-10 show the step-up mechanism 130 in different configurations. When the step-up mechanism 130 is in the open configuration, the forward region 159 can be adjacent to or on a support surface. In other embodiments, the forward region 159 is spaced well apart and above the support surface (see, e.g., FIG. 1). As the step-up mechanism 130 collapses, the rearward end of the sole 120 can be moved downwardly towards the support surface.

FIG. 9 shows the step-up mechanism 130 in an intermediate configuration. The step-up mechanism 130 continues to collapse until the user can push off of the ground with the forward region 159. FIG. 10 shows the step-up mechanism 130 in a closed configuration such that a user can tilt the shoe 108 forward to push off of the ground with the forward region 159. As the exercise apparatus 100 moves away from the support surface, the step-up mechanism 130 may or may not provide any propelling forces, rebound forces, and/or restoring forces.

The exercise apparatus 100 can be worn on each foot of the user such that the user alternately steps up and onto the exercise apparatus 100. The user has to repeatedly raise his or her body, thereby increasing cardiovascular exercise. The step-up mechanism 130 can be adjustable to provide different types of workouts. The height of the step-up mechanism 130 can be increased or decreased by changing the initial positions of the linkage assemblies 150, 152. For example, the stop 182 can be moved rearwardly or forwardly to decrease or increase, respectively, the height of the step-up mechanism 130. Dampeners, shock absorbers, springs, or other components can be used to control the rate of the collapse and/or cushion the user's foot. The opener assembly 170, illustrated as a spring extending between linkage assemblies 150, 152, can be used to adjust the rate at which the step-up mechanism 130 opens. FIGS. 8-10, for example, show elements 300 that can be dampeners or shock absorbers. The dampeners or shock absorbers can contain gases, liquids, air, mechanical devices (for example, springs, etc.), combinations thereof, or the like.

Additionally or alternatively, the relative positions of the linkage assemblies 150, 152 of FIG. 1 can be adjusted to cause unlocking at different times during a person's gait. This adjustment can be made to customize operation based on an individual's specific attributes (e.g., weight, gait, stride, etc.). A user can make adjustments, for example, to increase or decrease levels of exercise. In some embodiments, the forward linkage assembly 150 is positioned at a forward end 161 of the step-up mechanism 130 to delay collapsing. If the forward linkage assembly 150 is located at the forward end 161, the step-up mechanism 130 may begin to collapse after substantially all of the user's weight has been transferred to the ball of the user's foot. The forward linkage assembly 150 can be moved rearwardly to the rearward linkage assembly 152 such that the step-up mechanism 130 begins to collapse as the user begins to transfer his or her weight to the ball of the user's foot. Thus, the components of the step-up mechanism 130 can be repositioned to achieve different types of workouts.

Figure 3:
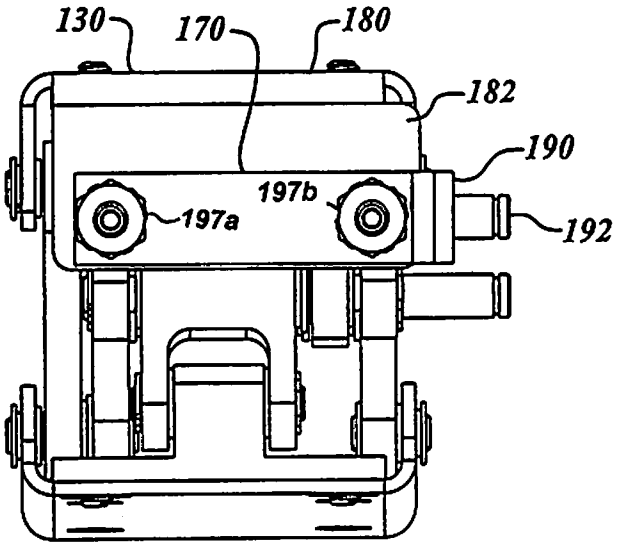
FIG. 3 is a back elevational view of the step-up mechanism of FIG. 2.

FIGS. 3 and 4 show set screws 197*a*, 197*b* that can be used to adjust the initial position of the rearward linkage assembly 152 as well as the forward linkage assembly 150. Other types of adjustment features can also be used to change the initial positions of the linkage assemblies 150, 152. A user can set the maximum expanded position (for example, the maximum desired height), the orientation of the components (for example, whether the rearward portion 142 is parallel or angled with respect to the upper member 180, or the like). In some embodiments, the set screws, or other types of components, can be used to set the step-up mechanism 130 for parallel expansion/compression or non-parallel expansion/compression, or both (e.g., parallel expansion and non-parallel compression). The exercise apparatus 100 can include one or more dampeners that absorb energy as the user steps onto the ground. In some embodiments, a dampening portion may include a wide range of different types of materials (e.g., foam, rubber, gel, viscoelastic materials, or the like), fluids (e.g., hydraulic fluid, gases, air, etc.), combinations thereof, or the like. In some embodiments, the exercise apparatus 100 may be segmented along its length to provide different functionality. For example, an array of step-up mechanisms can be positioned along the length of the exercise apparatus 100 and can be independently operated to provide complex types of motion.

Different forces can be used to control operation of the exercise apparatus 100. The first set of forces can allow the step-up mechanism 130 to begin to close. A second set of forces at a different point along the step-up mechanism 130 can speed up, slow down, or otherwise adjust the rate of closing and/or allow the remainder of the closing. To adjust the location of forces that cause closing of the step-up mechanism 130, a controller can control operation of the components of the exercise apparatus 100. One or more sensors positioned along the exercise apparatus 100 can provide feedback used by the controller to determine operation of the exercise apparatus 100.

The step-up mechanisms described herein can include dampening features, release mechanisms, or the like that cooperate to provide different types of functionality. In some embodiments, the exercise apparatus is reconfigurable to allow repositioning of any number of step-up mechanisms. For example, modular step-up mechanisms can be removably coupled to the sole 120. A user can reposition, remove, or replace the step-up mechanisms as desired.

FIGS. 11-14 show a step-up mechanism 400 that is generally similar to the step-up mechanism 130 discussed in connection with FIGS. 1-10, except as detailed below. The step-up mechanism 400 can include a release mechanism 410 (not shown in FIGS. 11 and 12) that can be operated to control movement of the step-up mechanism 400.

Figure 12:
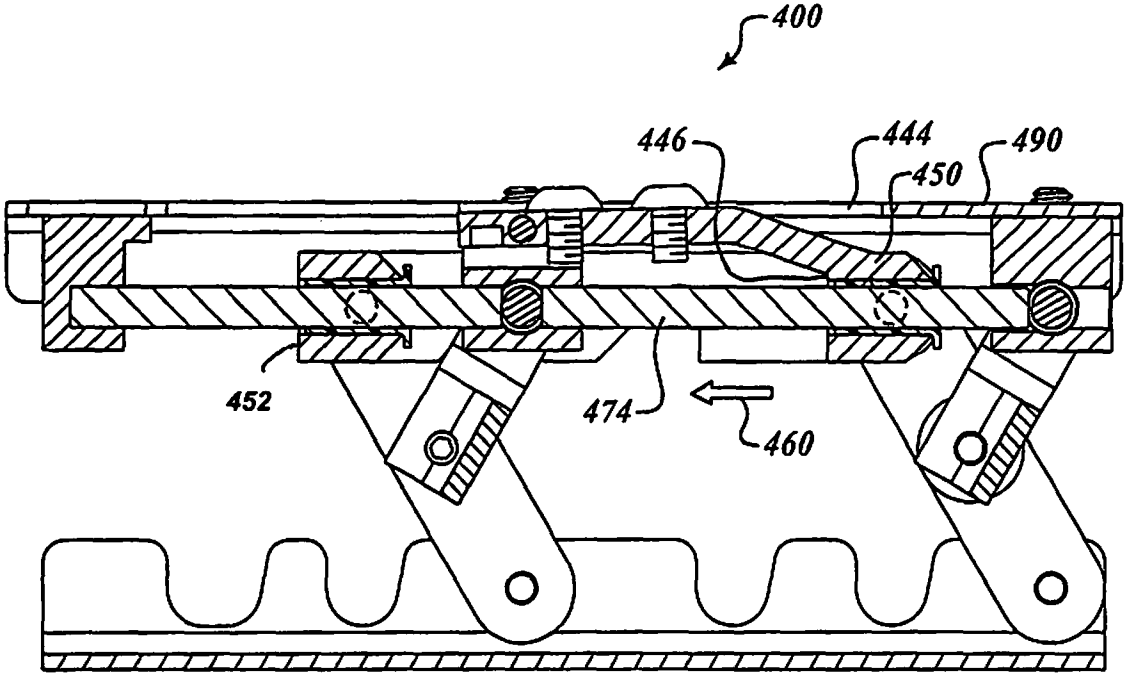
FIG. 12 is a cross-sectional view of the step-up mechanism of FIG. 11 taken along a line 12-12.
Figure 13:
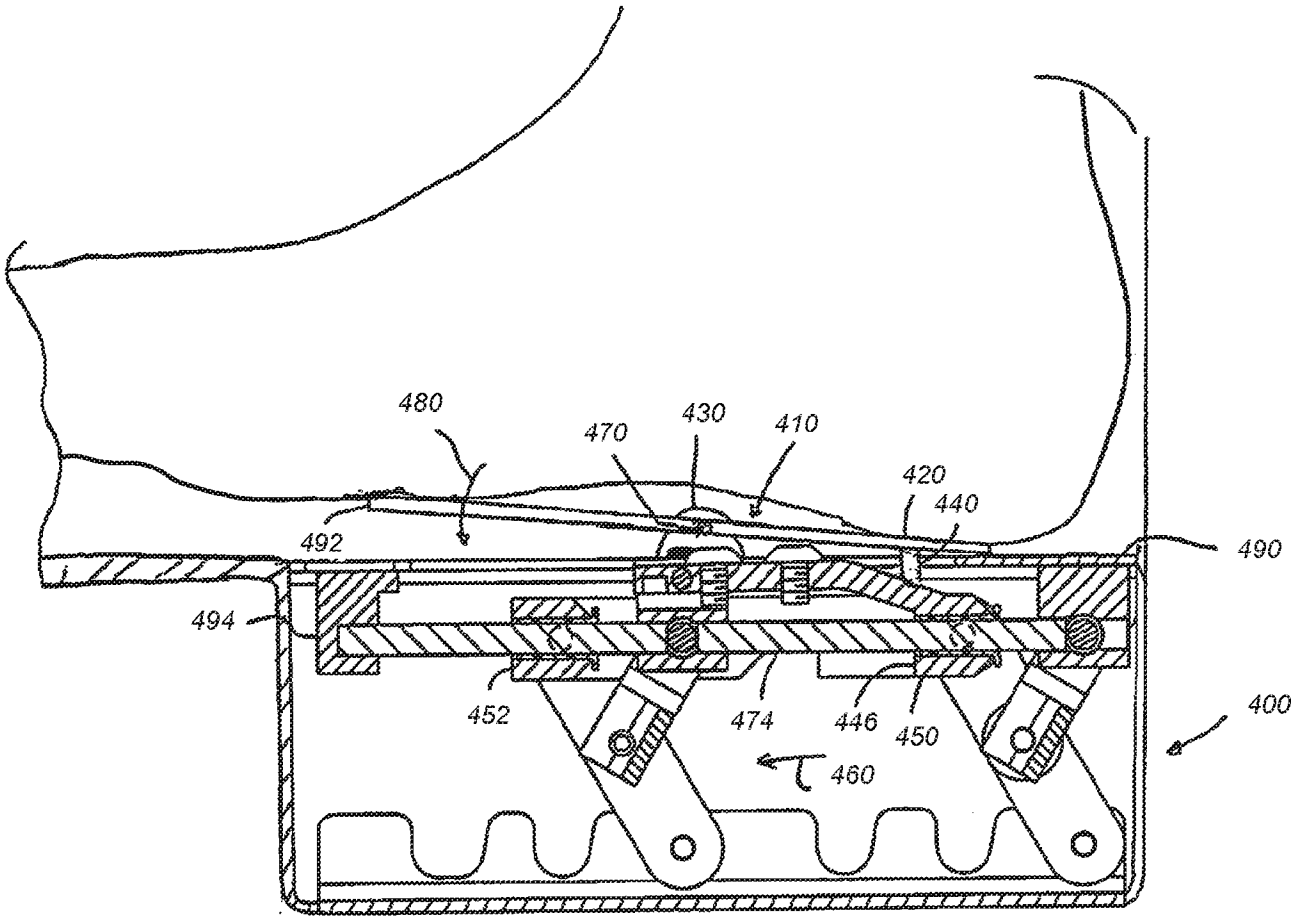
FIG. 13 is a side elevational view of a step-up mechanism in a locked configuration.

The illustrated release mechanism 410 of FIG. 13 is in the form of a locking device that includes a plate 420, a pivot 430, and a stop 440 coupled to the plate 420. The stop 440 can selectively allow movement of a slider 450, as shown in FIG. 12. When the release mechanism 410 is in a locked state (illustrated in FIG. 13), the stop 440 can be positioned through an opening 444 (FIGS. 11 and 12) and positioned forward of an end 446 of the slider 450. The stop 440 is positioned to prevent, limit, or substantially eliminate movement of the slider 450 in a forward direction (indicated by an arrow 460).

FIG. 13 shows the stop 440 obstructing movement of the slider 450 (a portion of which is illustrated in dashed line). As the plate 420 rotates about an axis of rotation 470, as indicated by an arrow 480, the stop 440 moves out of the opening 444 and away from the slider 450. The slider 450 can then slide forwardly along a rod 474 (see FIG. 12) to allow the step-up mechanism 400 to move towards a closed configuration.

During use, when a user's weight is on a rearward portion 490 of the step-up mechanism 400 (shown in FIG. 13), the step-up mechanism 400 is in a locked configuration. The user can impart significant downward forces without causing collapse of the step-up mechanism 400. In some embodiments, a user can stand on the step-up mechanism 400 while the mechanism 400 remains locked. When the user's heel applies weight to the step-up mechanism 400, the release mechanism 410 moves to or remains in the locked configuration. The pivot 430 can be positioned at different locations along the upper member.

Figure 14:
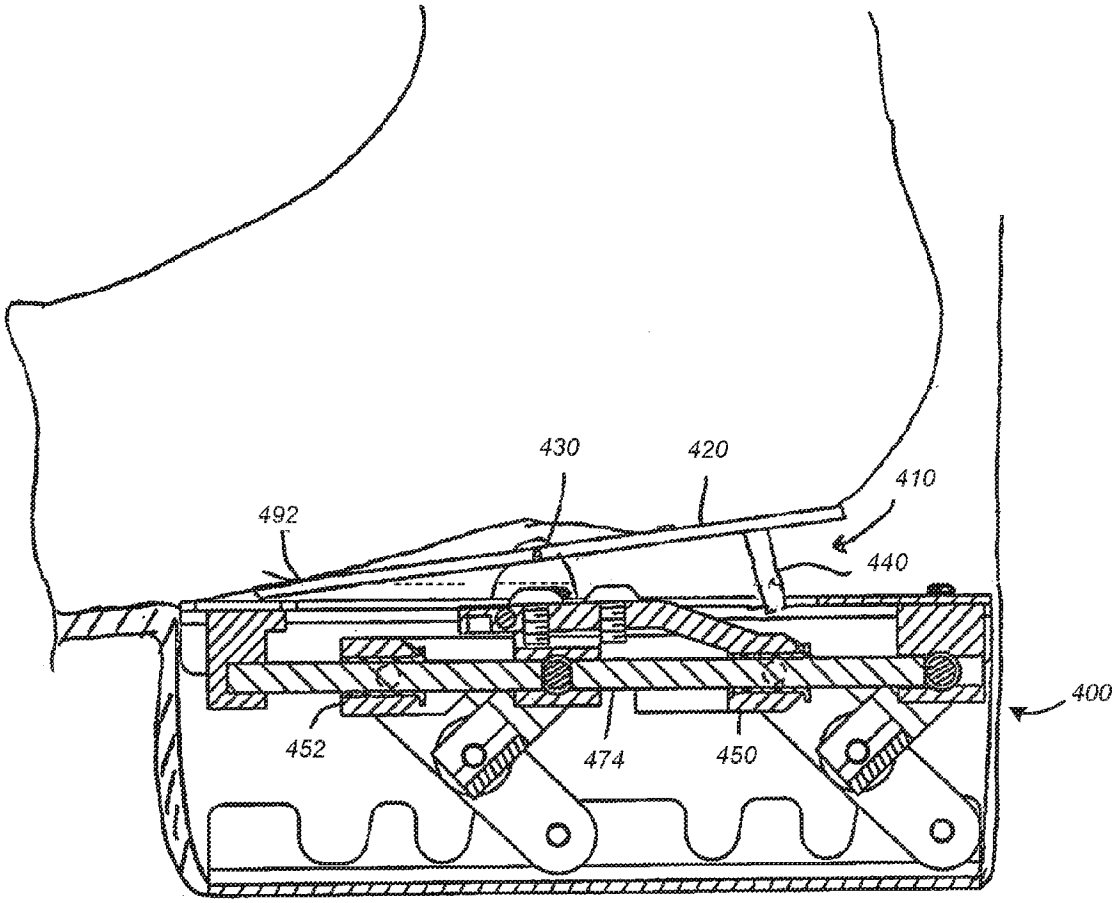
FIG. 14 is a side elevational view of a step-up mechanism in an unlocked configuration.

As the user's body weight is moved forward, a forward end 492 of the plate 420 can pivot towards an upper member 494. The slider 450 and a slider 452 then move forward such that the step-up mechanism 400 moves to the closed configuration. FIG. 14 shows the step-up mechanism 400 in the unlocked configuration. In some embodiments, the release mechanism 410 is biased towards the locked state, as shown in FIG. 13 by a spring, actuator, or other device. In some embodiments, the release mechanism 410 is biased towards the unlocked state, as shown in FIG. 14, by a spring, actuator, or other device.

Figure 16:
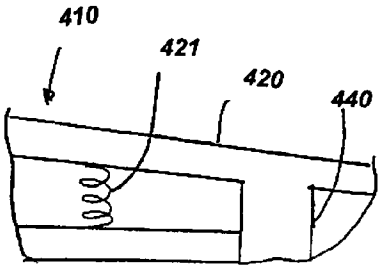
FIG. 16 is a detailed view of a portion of the step-up mechanism of FIG. 15.
Figure 15:
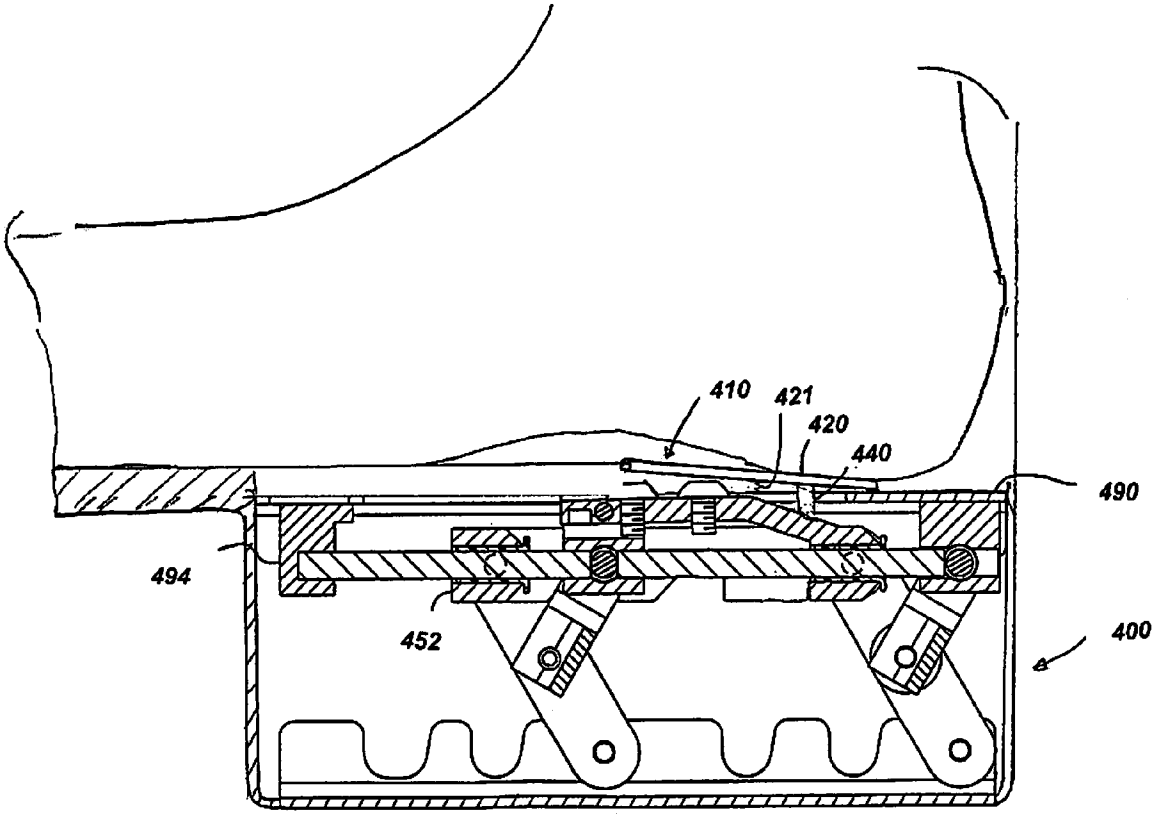
FIG. 15 is a side elevational view of a step-up mechanism in an unlocked configuration, in accordance with another embodiment.

FIGS. 15 and 16 show an embodiment that is similar to the step-up mechanism 400 shown and discussed in connection with FIGS. 11-14. The release mechanism 410 includes the plate 420 underneath the user's heel. A biasing mechanism 421 can push the plate 420 upwardly. When the user's heel is raised, or pressure is reduced on the plate 420, the biasing mechanism 421 can push the plate 420 upwardly to release the step-up mechanism 400. The biasing mechanism 421 can be in the form of one or more springs. The illustrated biasing mechanism 421 is a helical spring. Other types of biasing mechanisms can also be used.

Figure 17:
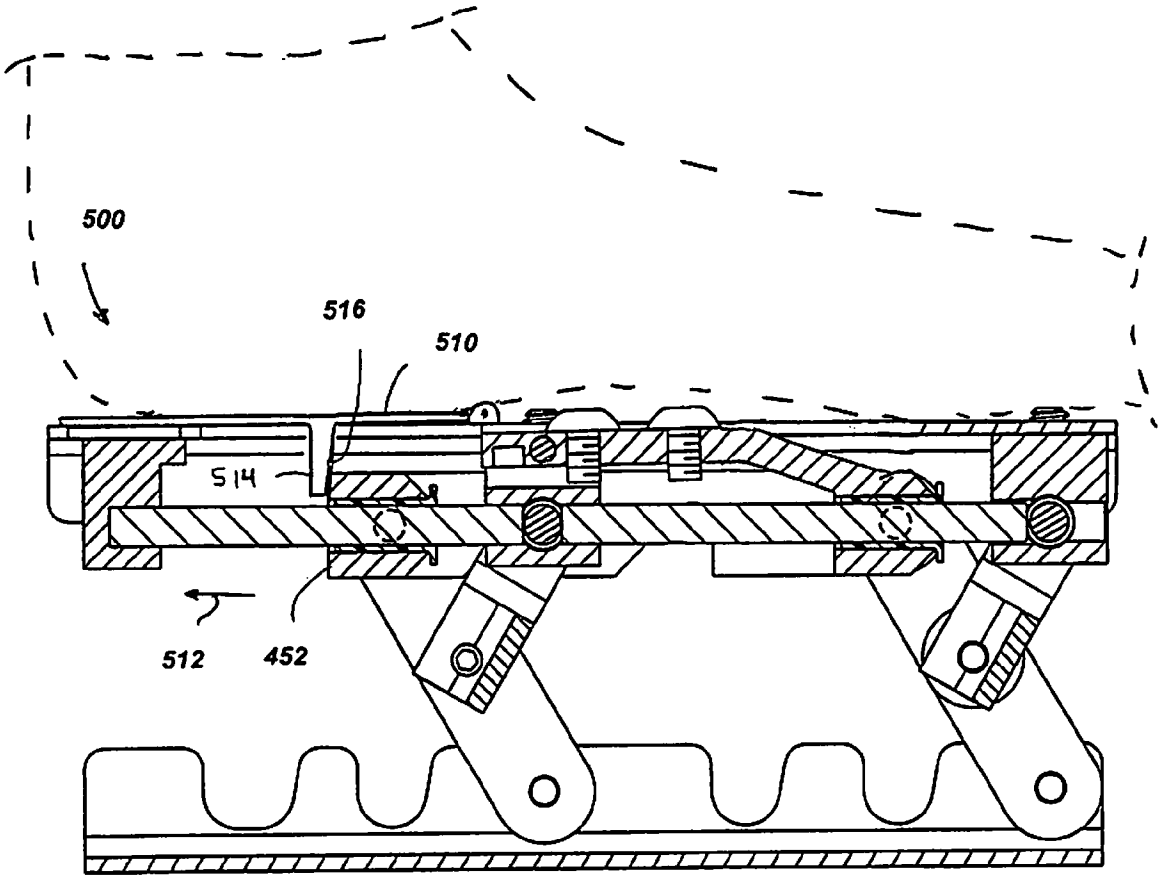
FIG. 17 is a cross-sectional view of a step-up mechanism, in accordance with one embodiment.
Figure 18:
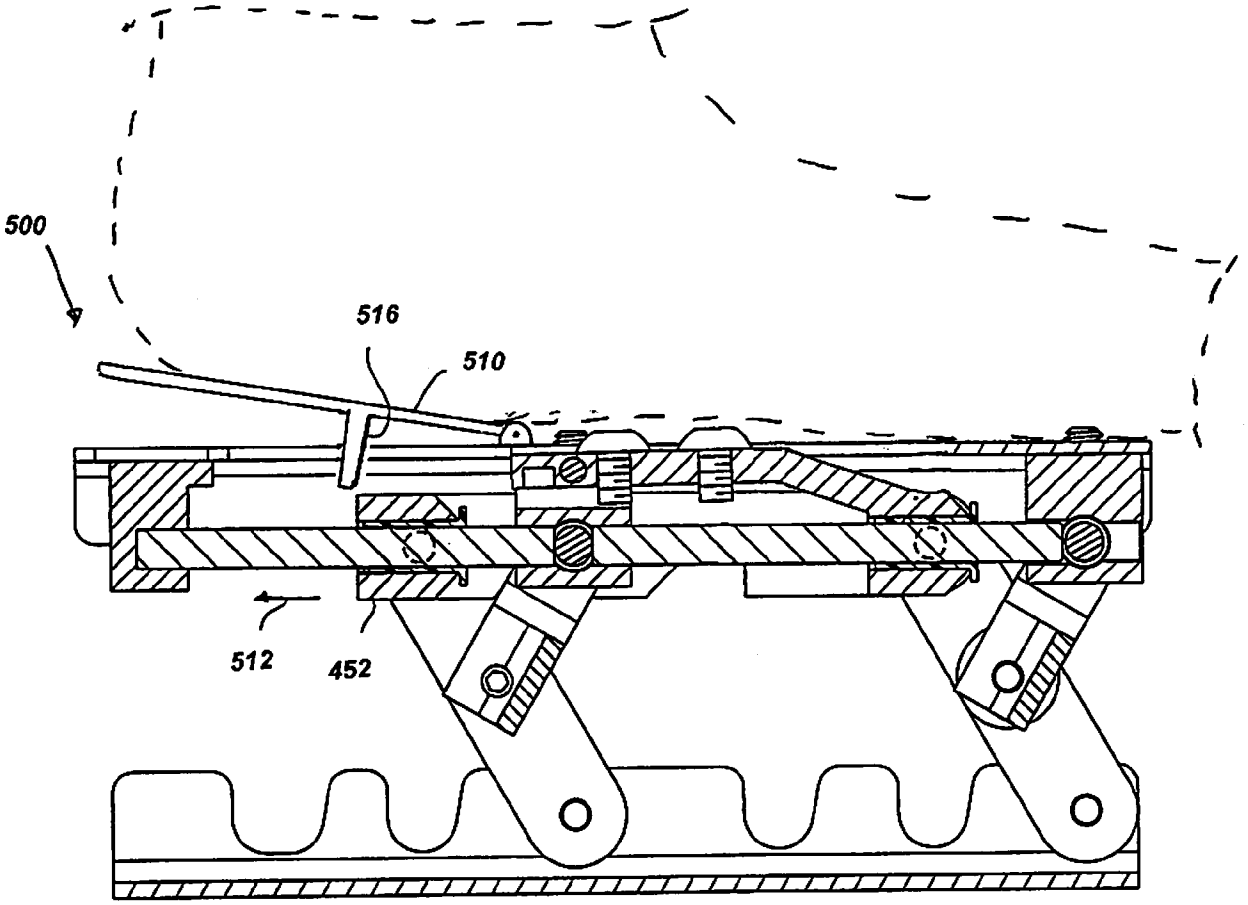
FIG. 18 is a cross-sectional view of the step-up mechanism of FIG. 17 with a release mechanism in an open configuration.

FIGS. 17 and 18 show a step-up mechanism 500 that includes a release mechanism 510 that can be pressed down by a user's heel. When the user transfers weight to the ball of the user's foot, the slider 452 pushes against a downwardly protruding stop 514. The slider 452 begins to move rearwardly, as indicated by an arrow 512. A forwardly facing surface 516 of the stop 514 can slide upwardly along the rearward face of the slider 452 as the slider 452 applies a rearwardly directed force. In this manner, the slider 452 pushes the release mechanism 510 upward. Once the stop 514 moves past the slider 452, the slider 452 is free to move rearwardly. In this manner, the step-up mechanism 500 can automatically unlock based on the action of the user's heel.

Of course, the configuration of the stop 514 and the slider 452 can be selected to achieve the desired amount of force needed to keep the release mechanism 510 in the unlocked position. A wide range of different types of stops and/or sliders with bearings, friction reducing surfaces, or the like can be used.

Figure 19:
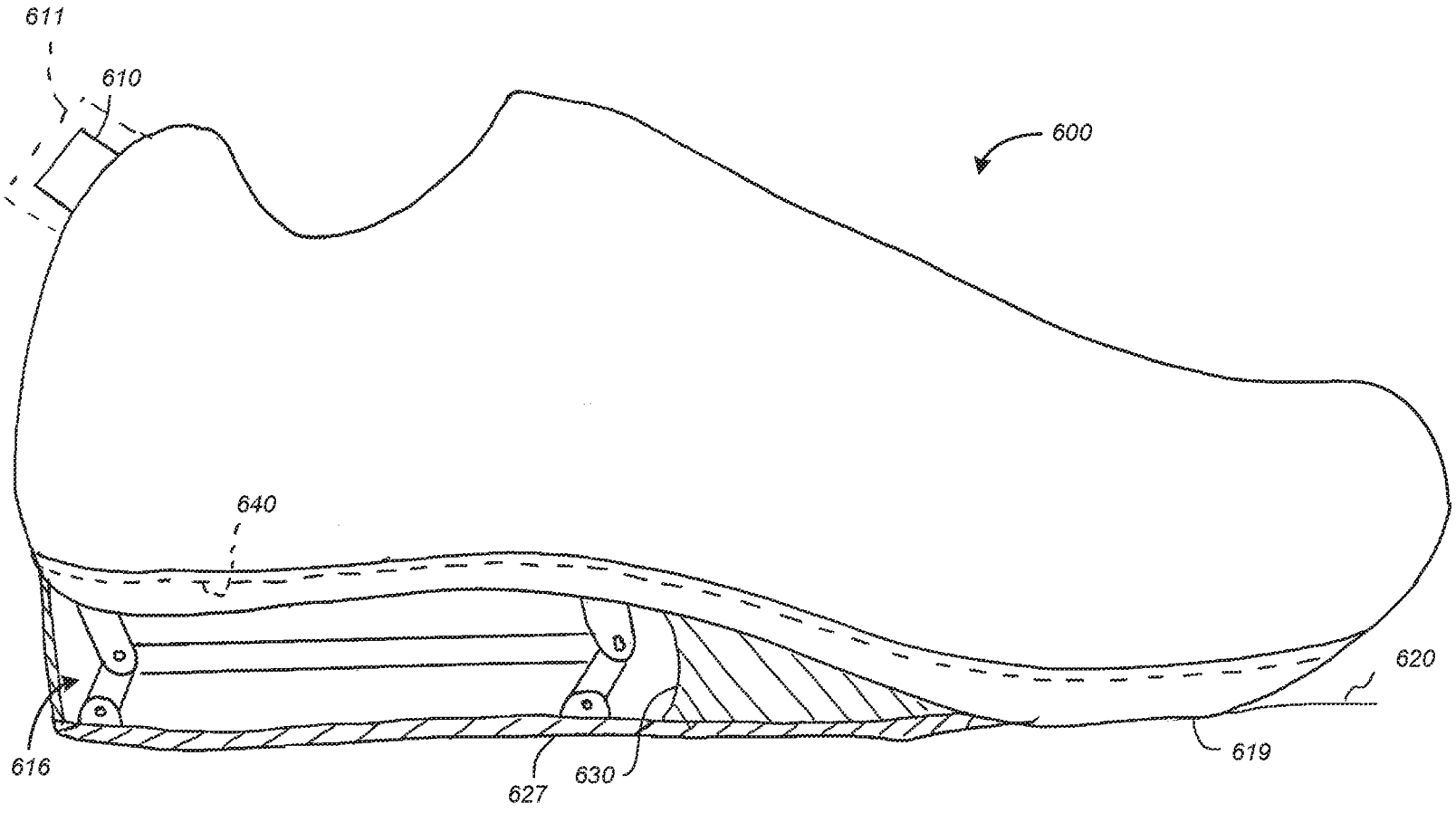
FIG. 19 is a side elevational view of an exercise apparatus, in accordance with one embodiment, with a step-up mechanism shown in cross-section.

FIG. 19 shows an exercise apparatus 600 that includes a controller 610, a step-up mechanism 616, and a forward portion 619. When the forward portion 619 is on a support surface 620, the user can collapse the step-up mechanism 616 to provide vertical work. A compressible material 630 can be positioned between the step-up mechanism 616 and the forward portion 619 to provide a smooth transition of the user's weight along the longitudinal length of the exercise apparatus 600.

The controller 610 can be in communication with any number of components or sensors positioned at various locations along the exercise apparatus 600 and/or can be in communication with other devices, such as other exercise apparatuses, diagnostic devices or systems (e.g., diagnostic equipment used by trainers, physicians, or the like), computers, networks (including Wi-Fi networks or other type of wireless networks), or the like.

Figure 20:
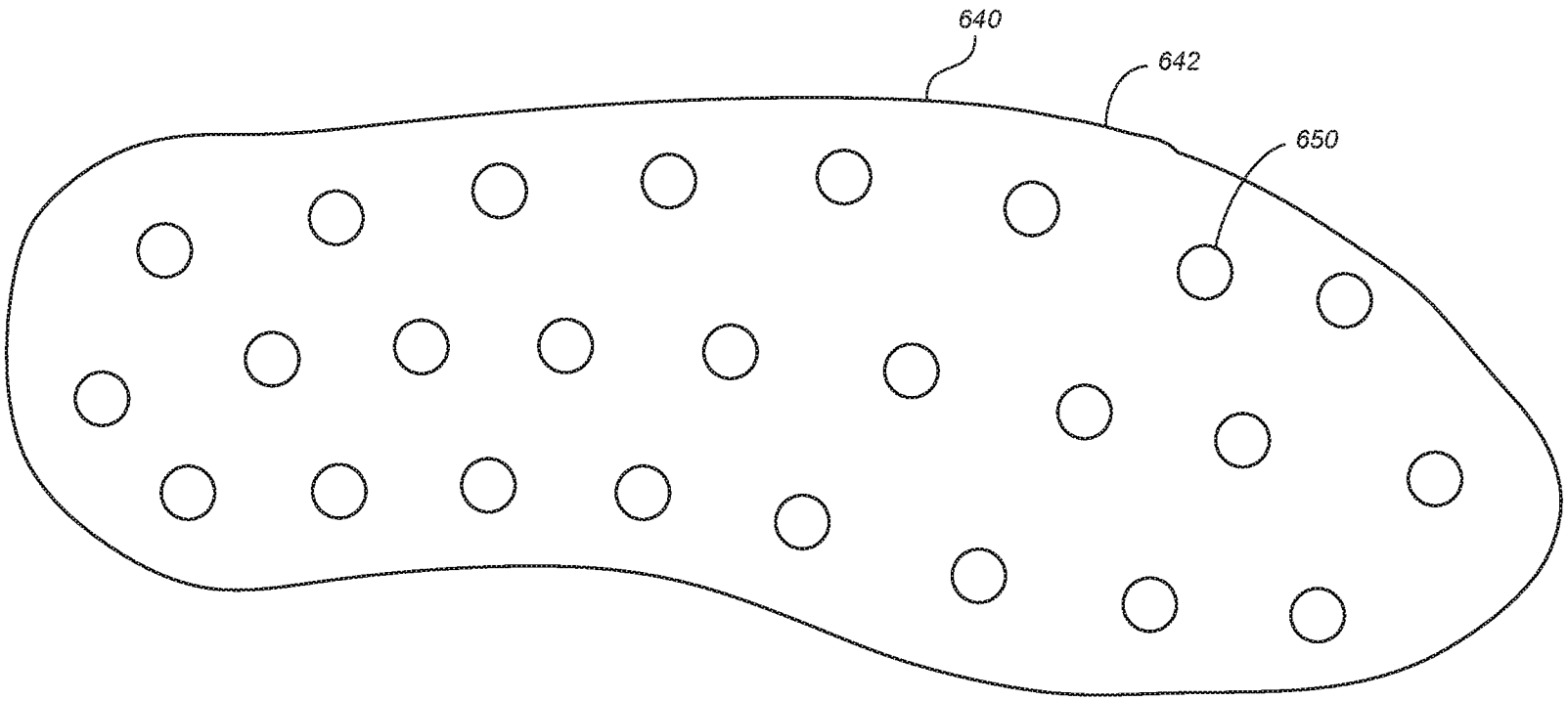
FIG. 20 is a top plan view of a sensor assembly of the exercise apparatus of FIG. 19, in accordance with one embodiment.

Referring to FIGS. 19 and 20, a sensor assembly 640 (illustrated in phantom line in FIG. 19) is in communication with the controller 610 and/or in communication (either directly or indirectly) with a controller of another exercise apparatus. The illustrated sensor assembly 640 is in the form of a sole that includes an array of sensors 650. Based on the signals from the sensor assembly 640, the controller 610 can control operation of the step-up mechanism 616.

Referring to FIG. 20, the sensors 650 can be embedded in, bonded to, or otherwise incorporated into a main body 642, illustrated as part of an insole. The sensors 650 can be evenly spaced (see FIG. 20) or unevenly spaced about the main body 642. The main body 642 can be an insole (e.g., a removable insole), part of an exercise apparatus, or the like. The sensors 650 can be used to determine how much weight is applied by the user, the weight distribution along the step-up mechanism 616, the speed of the user's gait, the rate of weight transfer, the relationship between applied forces, combinations thereof, or the like.

The sensors 650 can be force sensors, pressure sensors, strain gauges, proximity sensors, or other types of sensing elements capable of detecting a desired parameter and sending at least one signal indicative of the detected parameter. FIGS. 19 and 20 exemplify one arrangement of sensors, but the number and location(s) of sensors can vary. For example, the sensors may be located on the insole, outsole, midsole, or upper of the footwear, among other locations. The controller 610 can be similar or identical to the controllers disclosed in International Application No. PCT/US2009/032748 and U.S. application Ser. No. 12/865,695 (U.S. Pub. No. 2011/009233) and receive output from the sensors 650.

The step-up mechanism 616 of FIG. 19 can be collapsed based on one or more parameters (e.g., time delay, applied forces, relationship between forces, changes of applied forces, absolute applied force, combinations thereof, or the like). A time delay can be initiated based upon a force relationship, an absolute applied force, combinations thereof, or the like. For example, a time delay can be initiated when most of the user's weight is on the user's heel or when the user's body weight is generally centered forward of the rear third of the shoe.

In certain embodiments, once a force relationship is established, the controller 610 initiates a time delay. After the time delay lapses, the step-up mechanism 616 begins to collapse. For example, when the user applies a significant amount of weight (e.g., more than 50%, 75%, or 90% of the user's body weight) to a forward end 627 of the step-up mechanism 616, the controller 610 can delay collapsing of the step-up mechanism 616 for a certain length of time (e.g., 0.2 second, 0.25 second, 0.5 second, 1 second, 2 seconds, etc.).

The step-up mechanism 616 can begin to collapse after a length of time measured from, for example, initial contact, certain weight transfer, or other selected event. In other embodiments, the controller 610 controls the rate of collapse of the step-up mechanism 616 independent of, or dependent on, the amount of weight applied by the user. The controller 610 can be used to collapse the step-up mechanism 616 at a constant rate, at a rate that varies with respect to the amount of applied force, or the like.

A processing system 611 (shown in dashed line) can contain a power supply, memory, and the controller 610. The power supply can be located inside the controller 610 or located externally and connected to the controller 610 via leads. The controller 610 can receive input from sensor leads connected to the sensors 650. In some embodiments, the processing system 611 contains a wireless transmit/receive device capable of sending and/or receiving data to/from other exercise apparatus(es), other external devices, a network, or the like. The controller 610 can control a step-up mechanism 616, resistance control device, or other component through a control output lead connected to the mechanism 616. In some embodiments, the controller 610 includes a user input/output lead used to interact with an input/output device ("I/O device") to allow the user to set and monitor settings. These settings may include, without limitation, level of exercise, apparatus expansion parameters (e.g., maximum expansion height, minimum expansion height, etc.), exercise program selections, recalibration settings, combinations thereof, or the like. Exercise programs can include, without limitation, settings, routines, and preprogrammed levels of exercise. The levels of exercise can be selected based on targeted cardiovascular activity, targeted calories burned, targeted muscles, combinations thereof, or the like. By way of example, the user can select a program for burning a certain amount of calories over a certain length of time. Other programs can be used to target muscles for rehabilitation, strength training, or the like. When a user selects a desired program, the controller 610 can store the user's selection in memory and can periodically update or optimize stored programs or settings. Different types of optimization algorithms can be used to adjust programs, analyze data, compile reports, or otherwise evaluate user data (including preferences), exercise parameters, performance (including performance history), or the like. A display can display, for example, number of steps taken, distance traveled, vertical work performed, calories burned, and the like. For example, the controller 610 can include a display.

Figure 21:
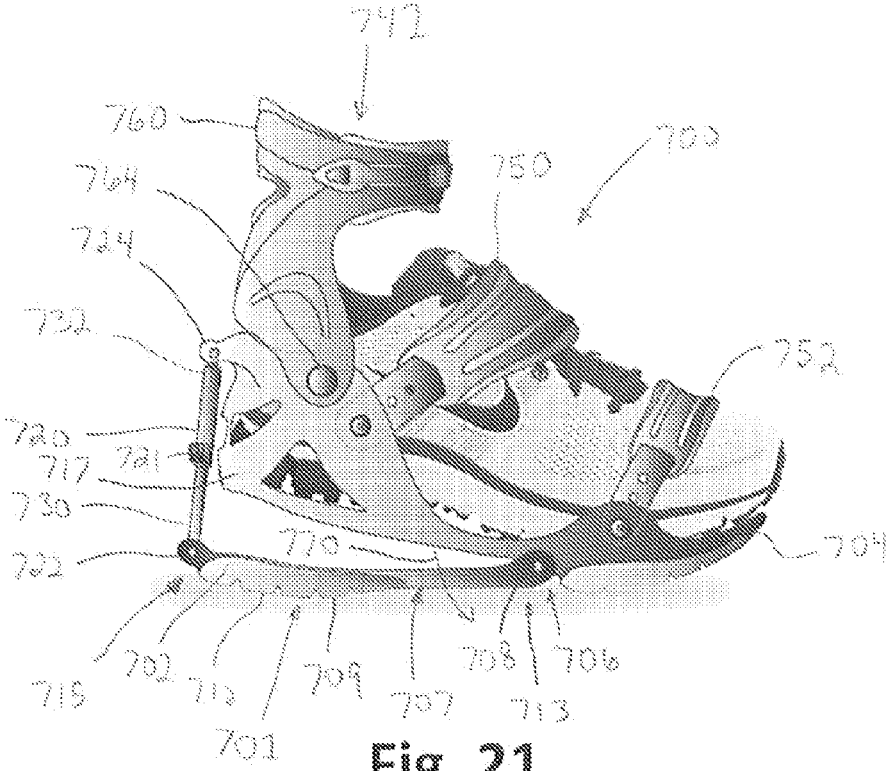
FIG. 21 is a side elevational view of a wearable exercise apparatus with a collapsible resistance mechanism in an open configuration.
Figure 22:
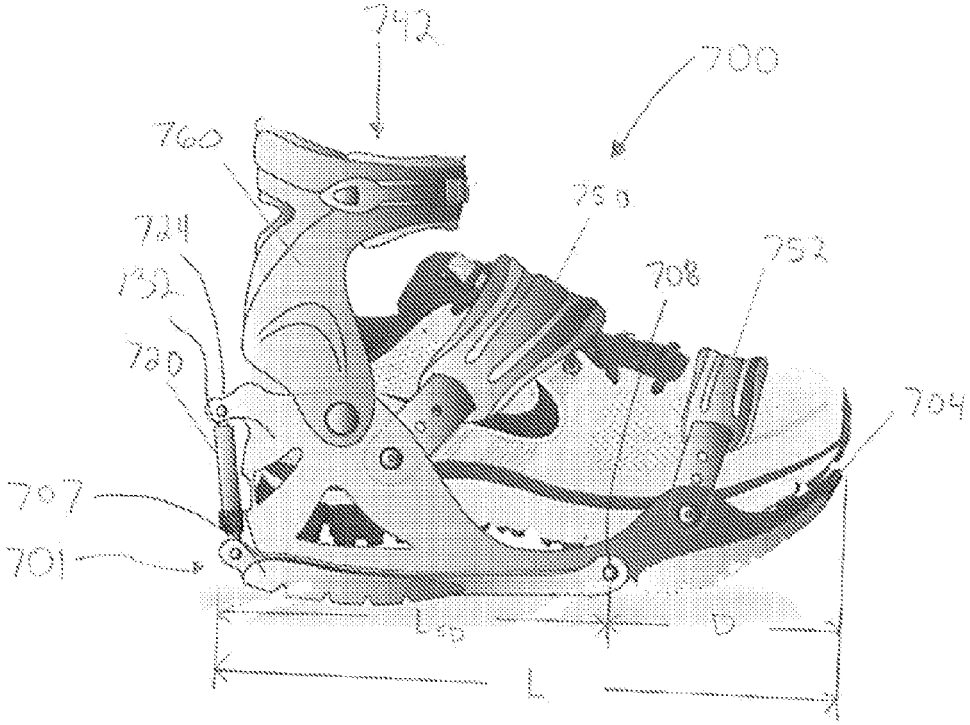
FIG. 22 is a side elevational view of the wearable exercise apparatus of FIG. 21 with a collapsible resistance mechanism in a closed configuration.

FIGS. 21 and 22 show a wearable exercise apparatus 700 that includes an articulating collapsible resistance mechanism 701 having a swing arm mechanism 702 and a support platform 704. The swing arm mechanism 702 includes a sole plate 707, a resistance device 720, and a pin 708 rotatably coupling the sole plate 707 to the support platform 704.

The sole plate 707 of FIG. 21 has a lower contact surface 709, a forward portion 713, and a heel portion 715. The forward portion 713 is rotatable about an axis of rotation defined by the pin 708. The sole plate 707 can be made, in whole or in part, of a rigid material including, without limitation, one or more metals (e.g., steel, aluminum, or the like), polymers, composites (e.g., carbon fiber reinforced composites), combinations thereof, or other material suitable for allowing the sole plate 707 to withstand significant forces and maintain its shape throughout operation.

A traction element 712 of the sole plate 707 can be made, in whole or in part, of one or more polymers, rubber, elastomers, or other materials capable of providing sufficient traction. In multi-piece embodiments, the traction element 712 can include a hard plastic body coated with rubber. In one-piece embodiments, the traction element 712 can be made of a single material (e.g., plastic, rubber, elastomers, combinations thereof, or the like) made by a molding process (e.g., an injection molding process, compression molding process, etc.) or machining.

FIG. 22 shows the pin 708 approximately below the ball of the user's foot at a location forward of a heel support region 717 of the support platform 704. In other embodiments, the pin 708 is located generally under the user's toes such that the collapsible resistance mechanism 701 closes throughout most or substantially all of the process of transferring the user's weight to the front of the foot. The pin 708 can be at other locations. The distance D from the front of the exercise apparatus 700 to the axis of rotation can be equal to or less than about 50% of an overall length L of the exercise apparatus 700. A ratio of the distance D to the length L can be equal to or less than about 0.6, 0.4, 0.3, 0.2, or 0.1. Other distances and ratios can be selected, if needed or desired. The length $L_{SP}$ of the sole plate 707 can be at least about 2 inches, 4 inches, 5 inches, or the like. The position of the pin 708 can be selected based on the desired amount of travel or rotation of the sole plate 707, timing of closing, or other criteria.

Referring again to FIG. 21, the pin 708 extends through holes in the sole plate 707 and holes in the support platform 704. In other embodiments, the connection between the sole plate 707 and the support platform 704 is a living hinge. For example, the sole plate 707 and support platform 704 can be monolithically formed to have a one-piece construction. In yet other embodiments, the sole plate 707 can be bonded, adhered, or otherwise coupled to the support platform 704. To provide additional movement, a pivot mechanism 706 can include one or more displacement members, cushioning components, or shocks to allow the sole plate 707 to translate relative to the support platform 704. Non-limiting displacement members include rubber spacers, spring elements (e.g., helical springs), or the like.

The resistance device 720 has a lower end 730 rotatably coupled to a sole plate mount 722. An upper end 732 of the resistance device 720 is rotatably coupled to a platform mount 724. The resistance device 720 controls the transition of the exercise apparatus 700 between different configurations, including the open configuration of FIG. 21, an intermediate configuration, and the closed configuration of FIG. 22. The user can place substantially all or most of his or her mass onto the exercise apparatus 700 before the resistance device 720 allows the collapsible resistance mechanism 701 to move towards the closed configuration. In other embodiments, the resistance device 720 provides lesser resistance such that the user may not have to place a significant amount of his or her mass on the collapsible resistance mechanism 701 before the beginning of compression.

The resistance device 720 can include, without limitation, one or more shock absorbers, springs (e.g., gas springs, piston spring assemblies, etc.), dampening mechanisms (e.g., dampeners), solenoids, bladders (e.g., bladders filled with compressed gas and/or liquid), combinations thereof, or the like. Resistance device 720 may have function or implementation as devices described in FIGS. 55 through 60. In other embodiments the resistance device may be communicatively coupled to a controller which directs the resistance device. The resistance device 720 may have an initial resistance (i.e., before beginning of compression) that is greater than the resistance during the intermediate configuration phase or towards the end of its travel. The performance profile can be selected based on desired feel, performance, dampening, or the like. In adjustable embodiments, the resistance device 720 can be adjusted to modify, for example, the performance profile. If the resistance device 720 uses a working fluid, the user can manually adjust the internal pressure of the working fluid to vary a dampening profile. In other embodiments, the resistance device 720 provides substantially constant resistance. Additionally, the resistance device 720 can include a locking device 721.

A restraining system 742 includes restraining elements 750, 752, illustrated as straps. An upper brace 760, illustrated as a lower leg brace, can provide ankle support and is rotatably coupled to a foot brace 762. When a user's ankle rotates, the upper brace 760 can rotate about a pivot 764. Alternative restraining systems can include, without limitation, one or more belts, laces, buckles, hook and loop type fasteners, or the like.

In operation, the sole plate 707 rotates about the pivot mechanism 706, as indicated by the arrow 770 of FIG. 21, when the collapsible resistance mechanism 701 expands or compresses. The support platform 704 can rotate on an angle equal to or greater than 5 degrees, 10 degrees, or 20 degrees. Other angles of rotation are also possible. The resistance device 720 allows the user's heel to move in a controlled manner downwardly towards the sole plate 707. As shown in FIG. 22, when the collapsible resistance mechanism 701 is fully collapsed, the sole plate 707 lies flat along a rearward portion 717 of the support platform 704. When the exercise apparatus 700 is lifted off of the ground, the sole plate 707 can return to the opened configuration.

Figure 23:
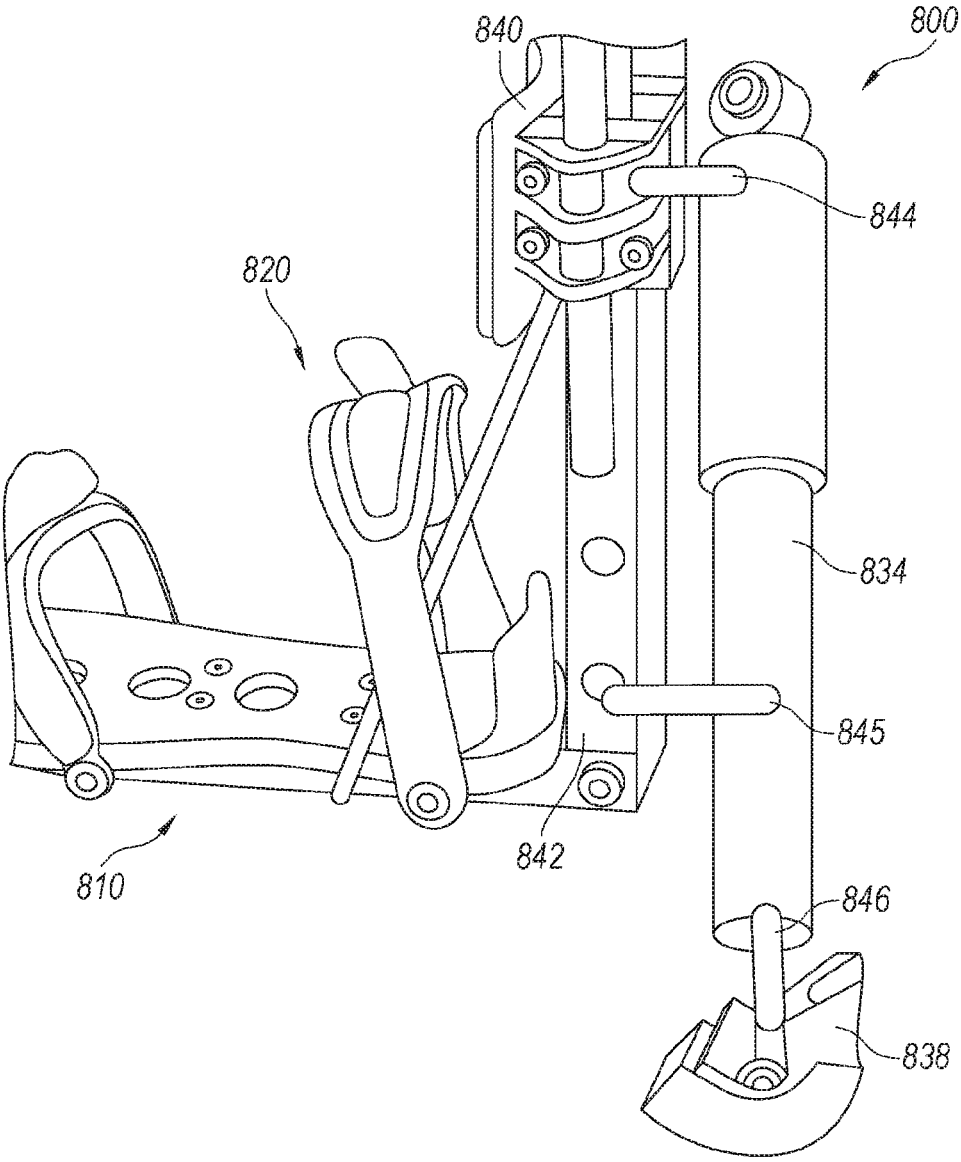
FIG. 23 is a side elevational view of a rear portion of a wearable exercise apparatus, in accordance with one embodiment.

FIG. 23 shows a rear portion of an exercise apparatus 800, in accordance with one embodiment. The exercise apparatus 800 includes a user support component 810, a restraining system 820, a collapsible resistance mechanism 834, and a heel contact dampener 838. The collapsible resistance mechanism 834 can control movement of the exercise apparatus 800 between an open configuration, an intermediate configuration, and a closed configuration. The collapsible resistance mechanism 834 can automatically expand once the apparatus 800 is lifted off the support surface.

The restraining system 820 includes a carriage 840 movable along a rail 842. The carriage 840 is fixedly coupled to an upper end 844 of the collapsible resistance mechanism 834. An intermediate portion 845 of the collapsible resistance mechanism 834 is fixedly coupled to the rail 842. In this manner, the collapsible resistance mechanism 834 is mounted to be aligned with the wearer's leg.

Figure 24A:
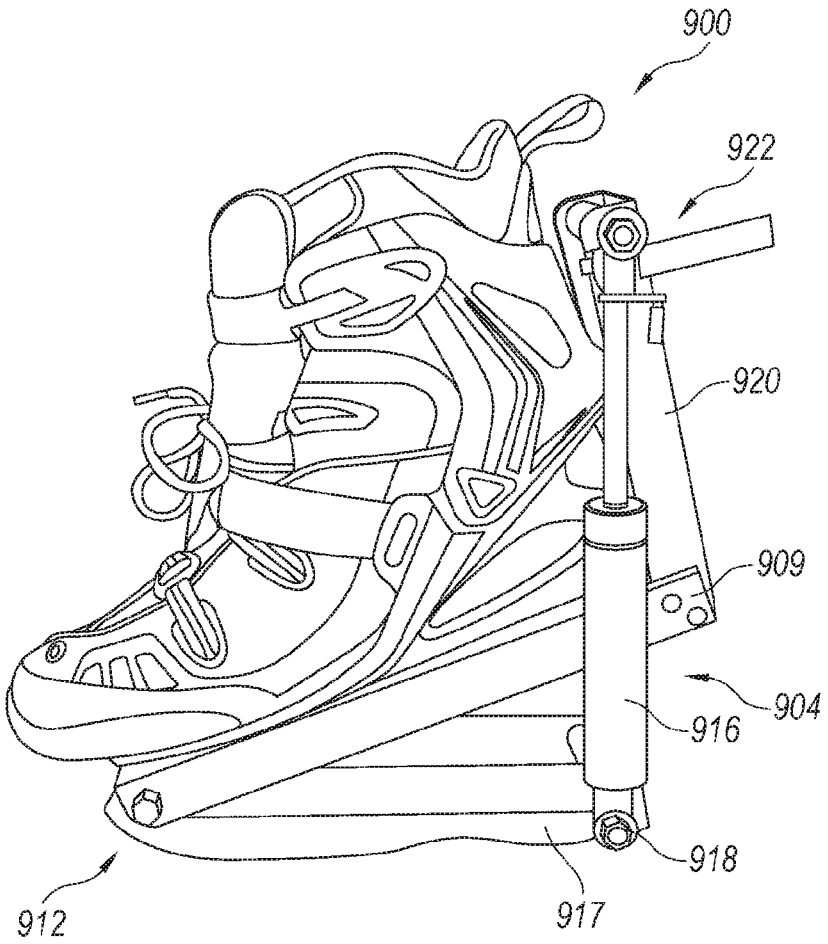
FIGS. 24A and 24B are pictorial views of a wearable exercise apparatus in different configurations, in accordance with one embodiment.
Figure 24B:
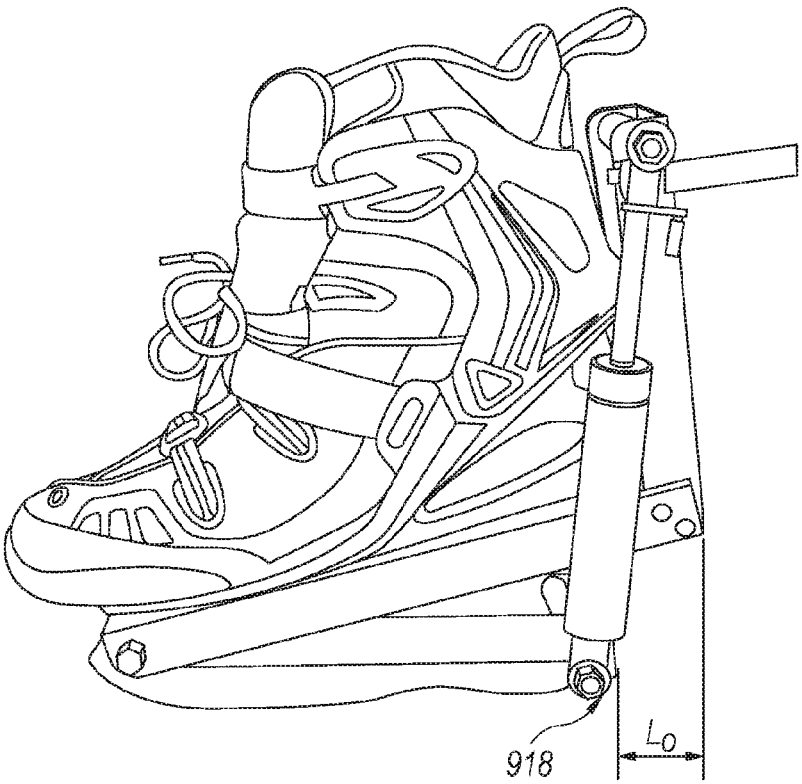

FIGS. 24A and 24B show a wearable exercise apparatus 900 in an open configuration and an intermediate configuration, respectively. FIG. 24A shows an exercise apparatus 900 that includes a collapsible resistance mechanism 904 with a generally V-shaped configuration. A sole plate 917 is coupled to a support platform 909 by a pivot 912. The sole plate 917 extends along substantially most or all of the length of the support platform 909 as shown in FIG. 24B. A resistance device 916 extends from a rearward end 918 of the sole plate 917 to an upper mount 920 of a restraining system 922. As shown in FIG. 24B, the length of offset $L_O$ can be selected to achieve the desired performance and level of comfort. In other embodiments, the distance $L_O$ is about 0.0 inch, 0.5 inch, 1 inch, 2 inches, or 3 inches, or ranges encompassing such lengths. When the collapsible resistance mechanism 904 is in a fully closed position, the rear portion of the support platform 909 extends rearwardly past the resistance device 916 and the rearward end 918.

Figure 24C:
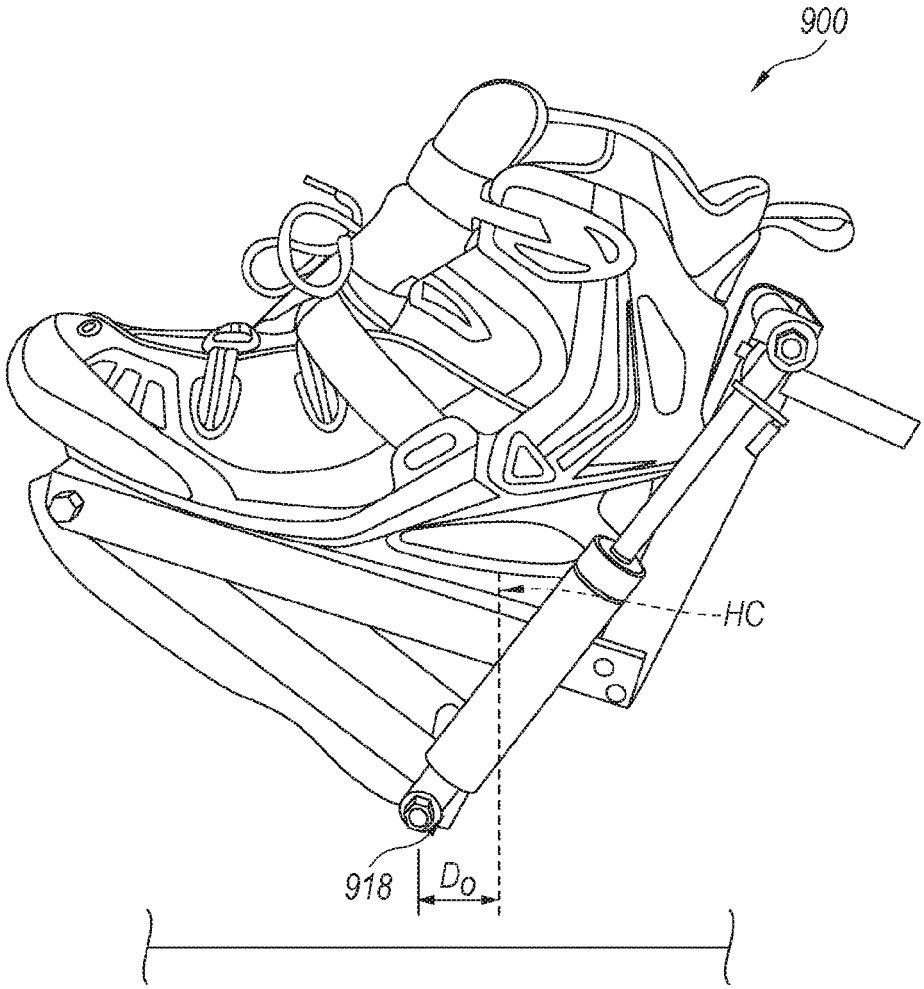
FIG. 24C is a side view of the wearable exercise apparatus of FIG. 24A on a support surface.

In some embodiments, the length $L_O$ is selected such that the rearward end 918 is positioned generally under the user's heel when the sole plate 917 strikes the ground. When a user initially places the rearward end 918 on the ground, the center of the user's heel can be generally centered over the rearward end 918, as shown in FIG. 24C. This prevents the exercise apparatus 900 from tending to cause a person's foot to slide forward in the exercise apparatus 900. A distance $D_O$ is the horizontal distance between the rearward end 918 and the center of the wearer's heel. The distance $D_O$ can be about 0 inch, 0.5 inch, 0.75 inch, 1 inch, or ranges encompassing such distances.

Figure 25:
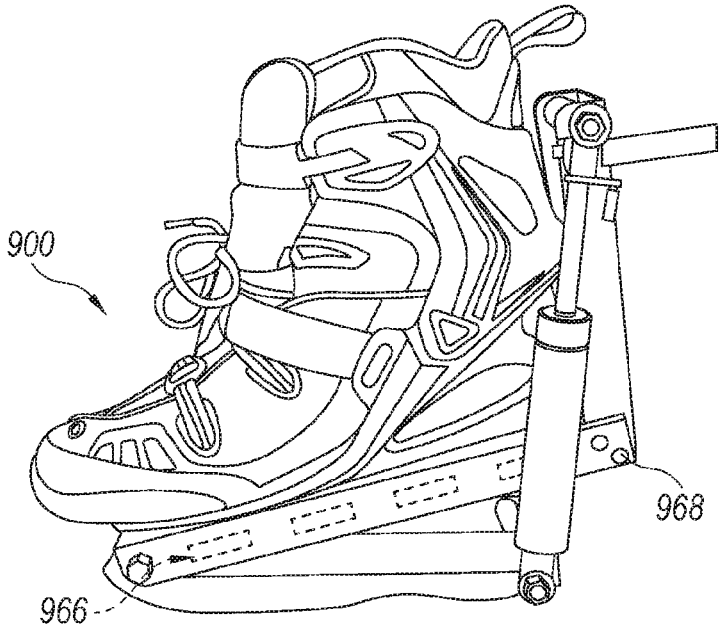
FIG. 25 is a side pictorial view of a wearable exercise apparatus with sensors, in accordance with one embodiment.

FIG. 25 shows a wearable exercise apparatus 900 with one or more sensors 966. The sensors 966 can be, without limitation, force sensors (e.g., force-resistance sensors, magnetic resistance sensors, pressure sensors, etc.), load cells, displacement sensors, strain gauges, position sensors (including proximity sensors), accelerometers, gyroscopes, or any other type of detection devices capable of detecting a measurable force, acceleration, moment, or the like. A wide range of different types of sensors can be used to obtain information about various aspects of the user's gait, body motion, cadence, physical characteristics, or the like.

The illustrated sensors 966 are positioned along a support platform 968. However, sensors can be installed at a wide range of different locations, including in a resistance device, sole plate, restraining system, upper, or the like.

Figure 26:
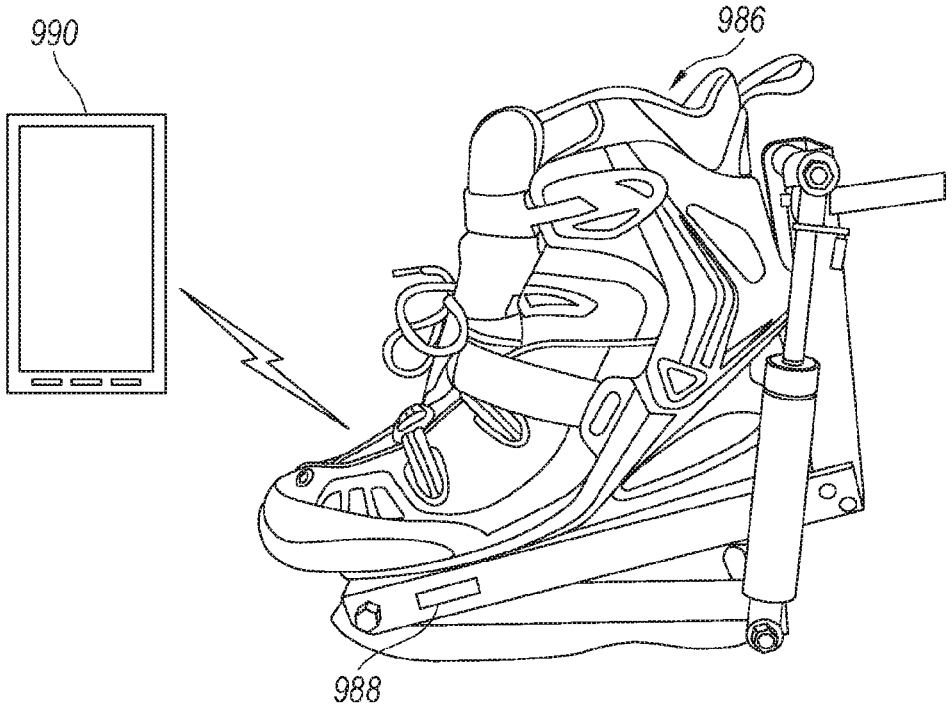
FIG. 26 is a side pictorial view of a wearable exercise apparatus with a controller and a sensor, in accordance with one embodiment.

FIG. 26 shows a wearable exercise apparatus 986 with a sensor 988 and a controller 990. The sensor 988 can communicate with the controller 990, which in turn can control operation of the exercise apparatus 986 and/or another exercise apparatus, based at least in part on the data from the sensor 988. The illustrated controller 990 is in the form of a smartphone capable of wirelessly communicating with the sensor 988.

Figure 27:
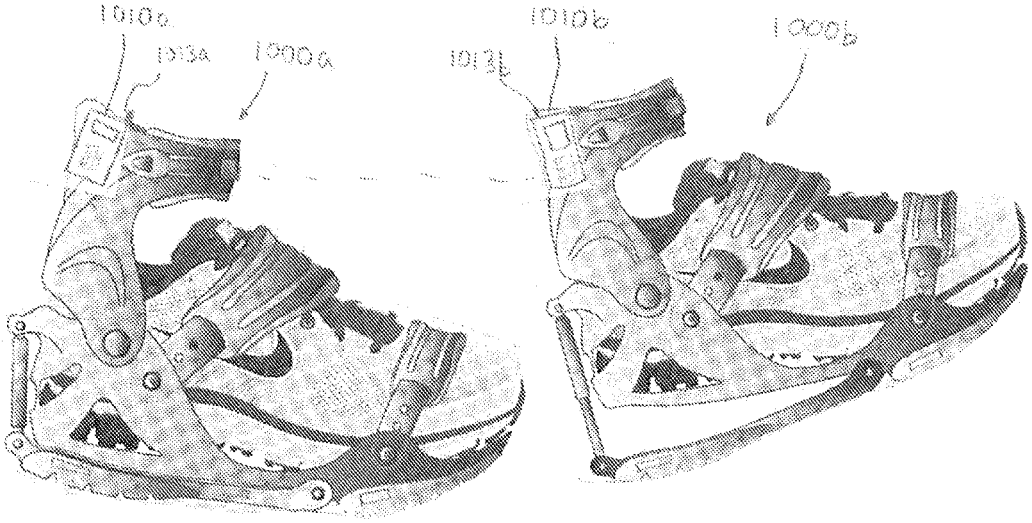
FIG. 27 is a side elevational view of two wearable exercise apparatuses in communication with one another.

FIG. 27 shows two exercise apparatuses 1000*a*, 1000*b* (collectively 1000) capable of communicating with one another to adjust walking speeds, control user stability, raise or lower the user's center of gravity, or otherwise adjust performance. In some modes of operation, each exercise apparatus 1000 can be controlled based at least in part on sensor data obtained by the other exercise apparatus 1000 to set a high walking speed (e.g., to maximize walking speeds) such that the raised user can be lowered as soon as possible. This may also enhance stability because the user's center of gravity is quickly lowered. Each exercise apparatus 1000*a*, 1000*b* includes a controller/sensor system 1010*a*, 1010*b*, respectively. The controller/sensor systems 1010*a*, 1010*b* (collectively, 1010) communicate with each other. For example, the controller 1010*a* can receive information from the sensor 1010*a* and transmit data to the controller 1010*b*. In some embodiments, the controller 1010*a* will transmit data (e.g., processed data, unprocessed data, etc.) to the other controller 1010*b*. In some embodiments, the controller 1010*b* processes data and sends the resulting information to the other controller 1010*a*.

The controllers 1010 can communicate with one another through transmit/receive devices 1013*a* and 1013*b*. Selections made by the user through an I/O device I, illustrated as a key pad, can be transmitted using wireless communication. The function of the exercise apparatuses 1000 can be controlled based on user settings and sensor data obtained from both exercise apparatuses. The controller 1010 of each apparatus can transmit raw sensor data or results of computations to the alternate apparatus.

A user can use I/O devices to set, modify, and monitor settings for each exercise apparatus. The settings can include, without limitation, level of exercise, step height, and the like. In some models, the two exercise apparatuses may not communicate with one another. The function of each apparatus is based on settings the user selects through the I/O device and input from sensor(s) relayed to the controller via sensor lead(s). In some embodiments, the controllers 1010*a*, 1010*b* may not have transmit/receive devices.

Figure 28:
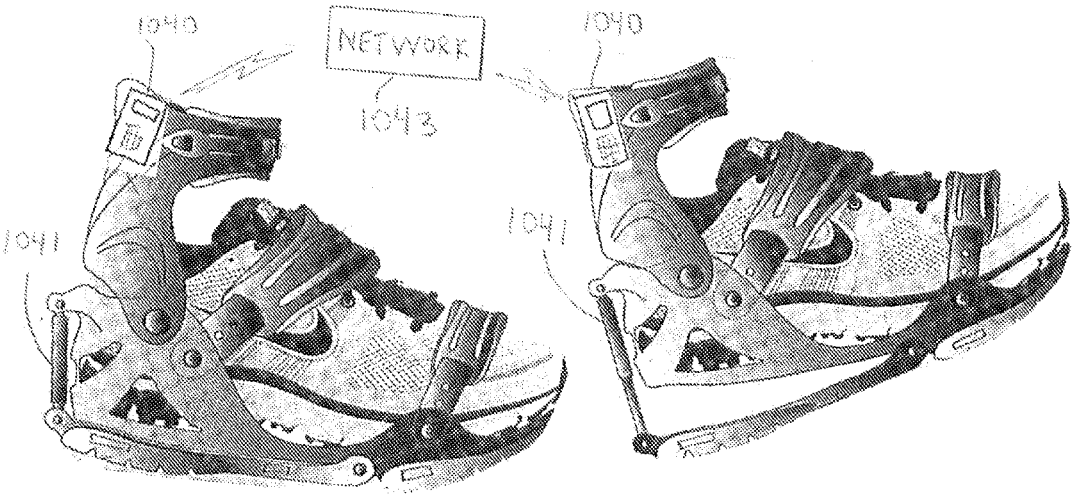
FIG. 28 is a side elevational view of two wearable exercise apparatuses, each containing a controller/sensor system in communication with a network.

FIG. 28 shows two exercise apparatuses, each containing a controller/sensor system 1040 in communication with an external controller 1043, illustrated as a network. Each exercise apparatus may include one or more sensors that transmit data wirelessly to the external controller.

Alternatively, the external controller 1043 can be a smartphone, iPod, Blue Tooth capable device, or other programmable device. The external controller 1043 can include an I/O device. The user can set, modify, and monitor settings using the I/O device. The external controller 1043 may be capable of displaying exercise results or programs. The program(s) can be updated wirelessly.

Figure 29:
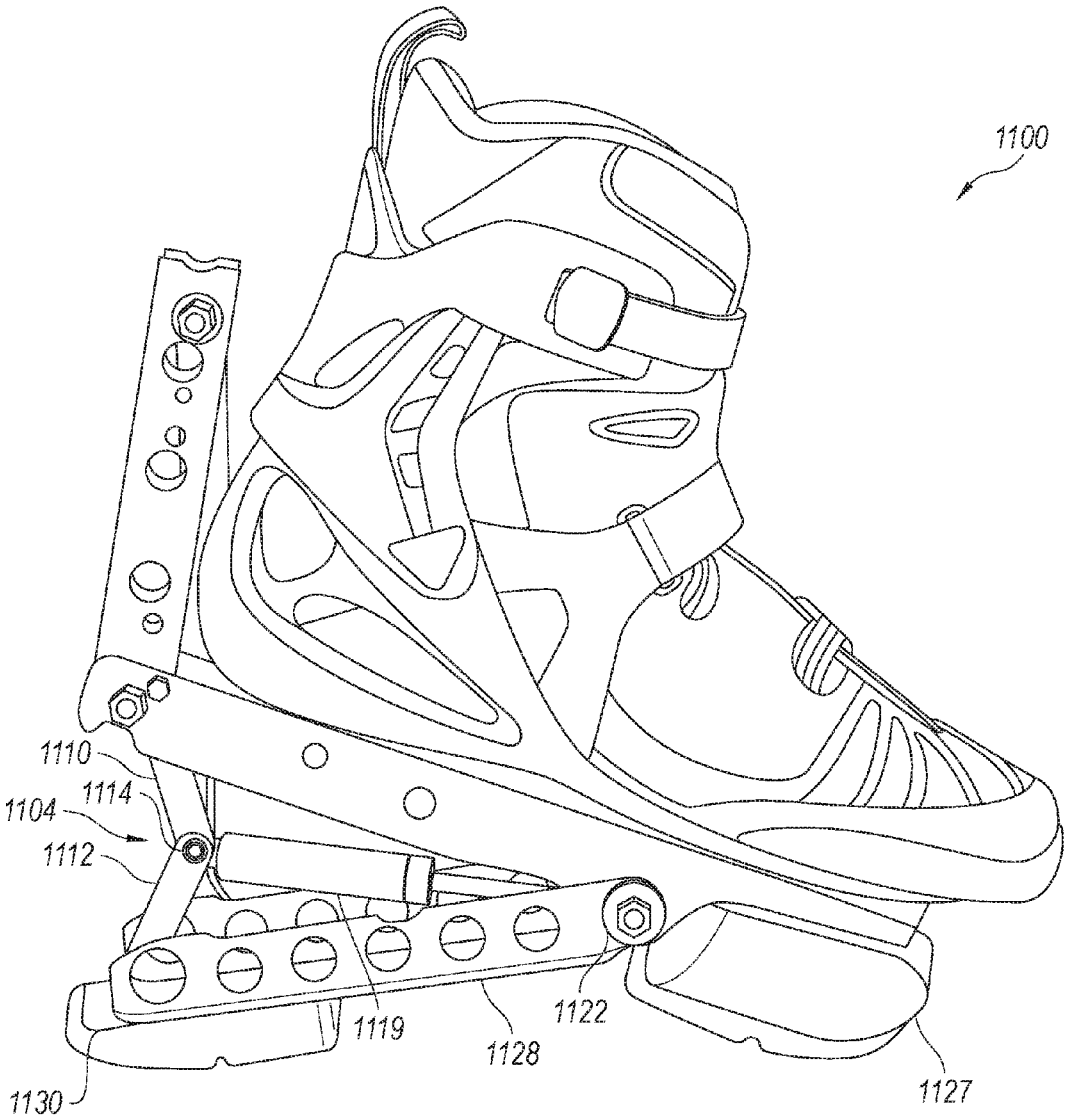
FIG. 29 is a side pictorial view of a wearable exercise apparatus in an expanded configuration.

FIG. 29 is a pictorial view of a wearable exercise apparatus 1100 in an expanded configuration. The apparatus 1100 includes a rearward linkage assembly 1104 having an upper linkage 1110 and a lower linkage 1112 that cooperate to define a linkage rotational axis 1114. The linkages 1110, 1112 can be made of a rigid material, including, without limitation, one or more metals, polymers, composites (e.g., carbon reinforced fiber composite), or combinations thereof. Pins, hinges, or other types of pivot components can define the rotational axis. Such pivot components can be separate from the linkages. In other embodiments, the pivot components can be integrally formed with the linkages. Additionally or alternatively, the pivot components can be integrally formed with a heel component. All of these components can be made of a polymer with mechanical properties that allow the desired movement by the geometry (thinner material) or by bonding a polymer having different mechanical properties that gives flexibility to a rigid polymer used for the linkages and/or rotatable heel component and/or user support component.

When a sole plate in the form of a swing arm 1128 is in the closed position, a ground contact component 1127 and a heel component 1130 can keep the user's foot generally level. As shown in FIG. 29, a front portion of the ground contact component 1127 can be rounded to allow the user's foot to roll gently forward. In the illustrated embodiment, the ground contact component 1127 can be made, in whole or in part, of a polymer, elastomer, and/or rubber, as well as other types of materials that can be altered by an externally applied force.

A resistance device 1119 is disposed between the linkage rotational axis 1114 and a resistance device coupler 1122. The resistance device 1119 can control movement of the linkage assembly 1104 and, thus, the transition of the exercise apparatus 1100 between the open, intermediate, and closed configurations. The resistance device coupler 1122 can be located at any suitable position to secure the resistance device 1119 to appropriate location(s) along the user support platform. When the linkage assembly 1104 is in the uncollapsed or open configuration, the orientations of the linkages 1110, 1112 are substantially vertical to reduce or limit the forces acting upon the resistance device 1119 to a fraction of the vertical forces acting upon the exercise apparatus 1100. This can enable the use of small and low-resistance devices despite the relatively high forces resulting from the user's mass acting on the apparatuses.

Figure 30:
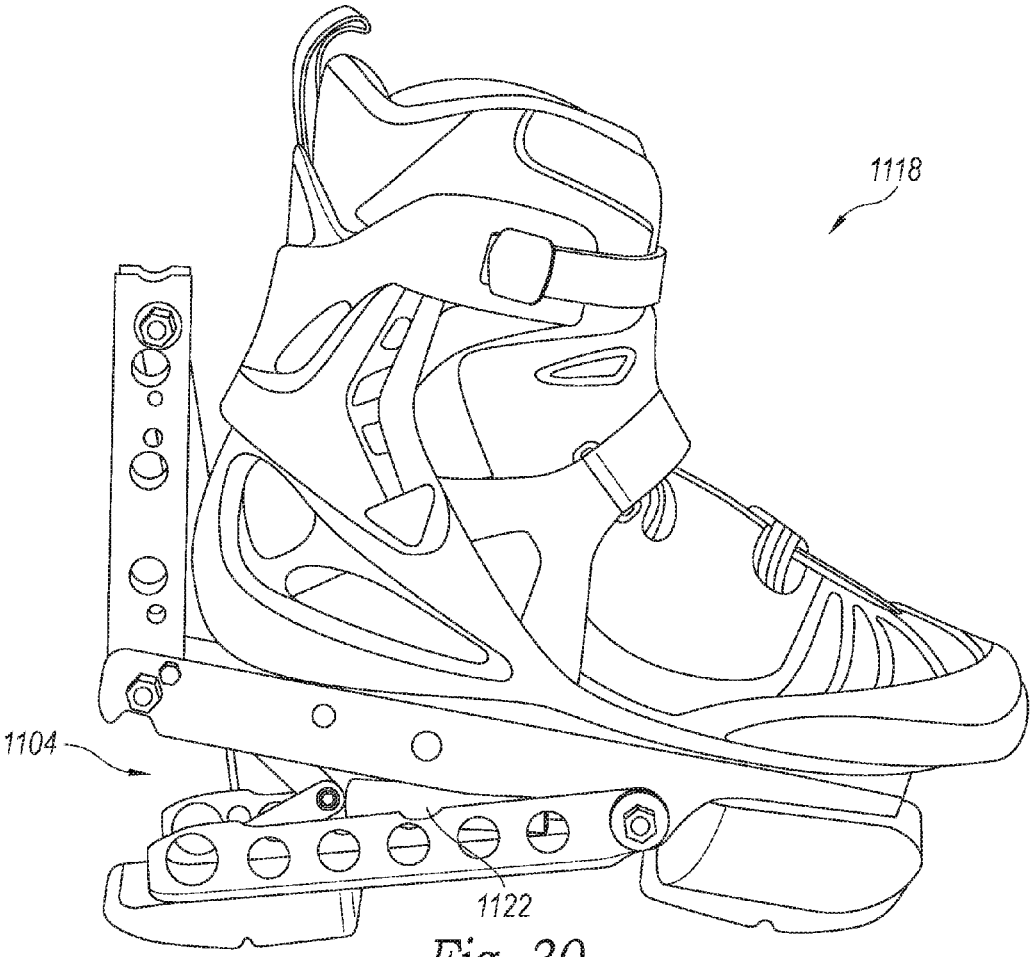
FIG. 30 is a side pictorial view of a wearable exercise apparatus in a partially closed configuration.

FIG. 30 shows an exercise apparatus 1118 in an intermediate configuration. Once a resistance device 1119 allows the exercise apparatus 1118 to begin moving towards the closed configuration, the linkage assembly 1104 can begin to collapse or fold, thereby distributing vertical forces applied by the user horizontally into the resistance device coupler 1122. Although the linkage assembly 1104 is positioned towards the rear of the exercise apparatus 1118 and biased towards the front of the exercise apparatus 1118, the linkage assembly 1104 may be located at other locations and may be biased towards the front, rear, lateral, or medial portions of the exercise apparatus 1118.

Figure 31:
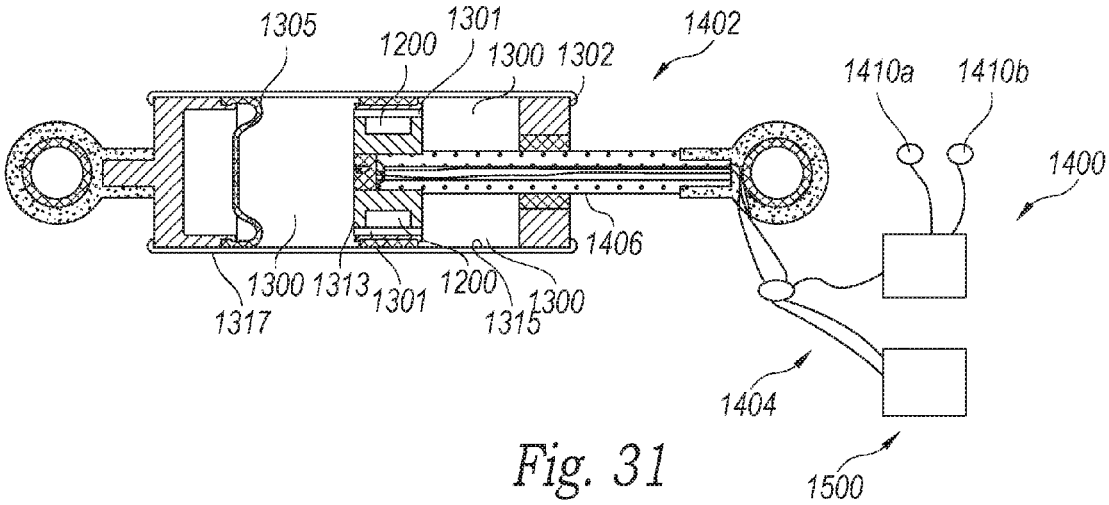
FIG. 31 is a schematic view of an energy absorption control system, in accordance with one embodiment.

FIG. 31 is a schematic view of a control system that could be used to control the resistance provided by a collapsible resistance mechanism of a footwear exercise apparatus. Control system 1400 includes a resistance device in the form of an energy absorber 1402 with an internal electric coil 1200 and a sensor/controller system 1404 in communication with the internal electric coil 1200. The energy absorber 1402 can dampen linear forces by limiting movement of a piston 1406. The movement of the piston 1406 can be regulated by the travel of a flowable material 1300 through one or more passageways, illustrated in FIG. 31 as an annular orifice 1301.

The flowable material 1300 can be a magnetorheological fluid, a ferrous fluid, or any other type of flowable material. Flowable materials can contain particles or other substances that can be affected by an externally applied field or force to alter the characteristics (e.g., viscosity) of the flowable material. In magnetically controlled embodiments, the flowable material 1300 carries metallic particles capable of being altered by an applied magnetic field produced by the internal electric coil 1200. The magnetic field causes alignment of the metallic particles, thus changing the viscosity of the flowable material 1300. By way of example, the viscosity can be increased to reduce the flow rate through the orifice 1301.

This reduces the speed at which a head 1313 moves through a chamber 1315 of a housing 1317. This slows the rate of compression or expansion of the energy absorber 1402. To lock the energy absorber 1402, the strength of the magnetic field can be increased to increase the viscosity of the flowable material 1300. The flowable material 1300 is inhibited from flowing through the orifice 1301. This substantially prevents movement of the head 1313 to keep the energy absorber 1402 in a particular configuration. The magnetic field can be reduced or eliminated to allow the flowable material 1300 to flow freely through the orifice 1301. This allows rapid expansion and compression of the energy absorber 1402.

A sensor/controller system 1500 can use data received from sensors 1410*a*, 1410*b* to determine an appropriate amount of current to apply to the internal electric coil 1200. Current to the internal electric coil 1200 can be increased to a level that substantially locks the energy absorber 1402 while the user steps onto the exercise apparatus. The current can be turned off or reduced to allow the exercise apparatus to move towards the compressed configuration after the user has lifted a certain amount of weight, for example, substantially most of his or her weight. In some embodiments, the applied current is varied to have a non-uniform resistance profile. To prevent abrupt closing of an exercise apparatus, the applied current can be increased as the collapsible resistance mechanism approaches the fully closed configuration. For a rapid controlled collapsing, there is no applied current at the beginning of collapse. As the collapsible resistance mechanism approaches the closed configuration, a current can be applied to decrease the rate of collapse until the collapsible resistance mechanism is fully closed. To keep the collapsible resistance mechanism in the closed configuration to prevent propelling of the user, the magnetic field can be maintained to prevent movement of the head 1313. When a period of time has elapsed after the user has lifted the exercise apparatus off the ground, the magnetic field can be eliminated to allow the collapsible resistance mechanism. The energy absorber 1402 can allow the collapsible resistance mechanism to expand after the sole plate has moved away from the ground. By way of example, a sole plate of a collapsible resistance mechanism can swing to the fully opened position while the toe region of the support platform is on the ground. In other embodiments, the energy absorber 1402 can keep the collapsible resistance mechanism in the closed configuration for a period of time after the user lifts the exercise apparatus off the ground. In some embodiments, expansion of the energy absorber 1402 is restricted by maintaining a current to the internal electric coil 1200 for a period of time after the user lifts the exercise apparatus off the contact surface to minimize or eliminate a propelling force created by expansion of the energy absorber 1402.

A counteracting system (a sensor/controller system) can produce a magnetic field that counteracts the field so as to reduce the magnetic charge and therefore the viscosity of the flowable material 1300. Additionally or alternatively, magnets (e.g., electromagnets, permanent magnets, or the like) can be moved relative to the substance 1300 to adjust the substance's flow characteristics. An actuator device can move a magnet away from or towards the orifice 1301, the chamber 1315, or other portion of other regions proximate to the flowable material 1300.

Figure 32:
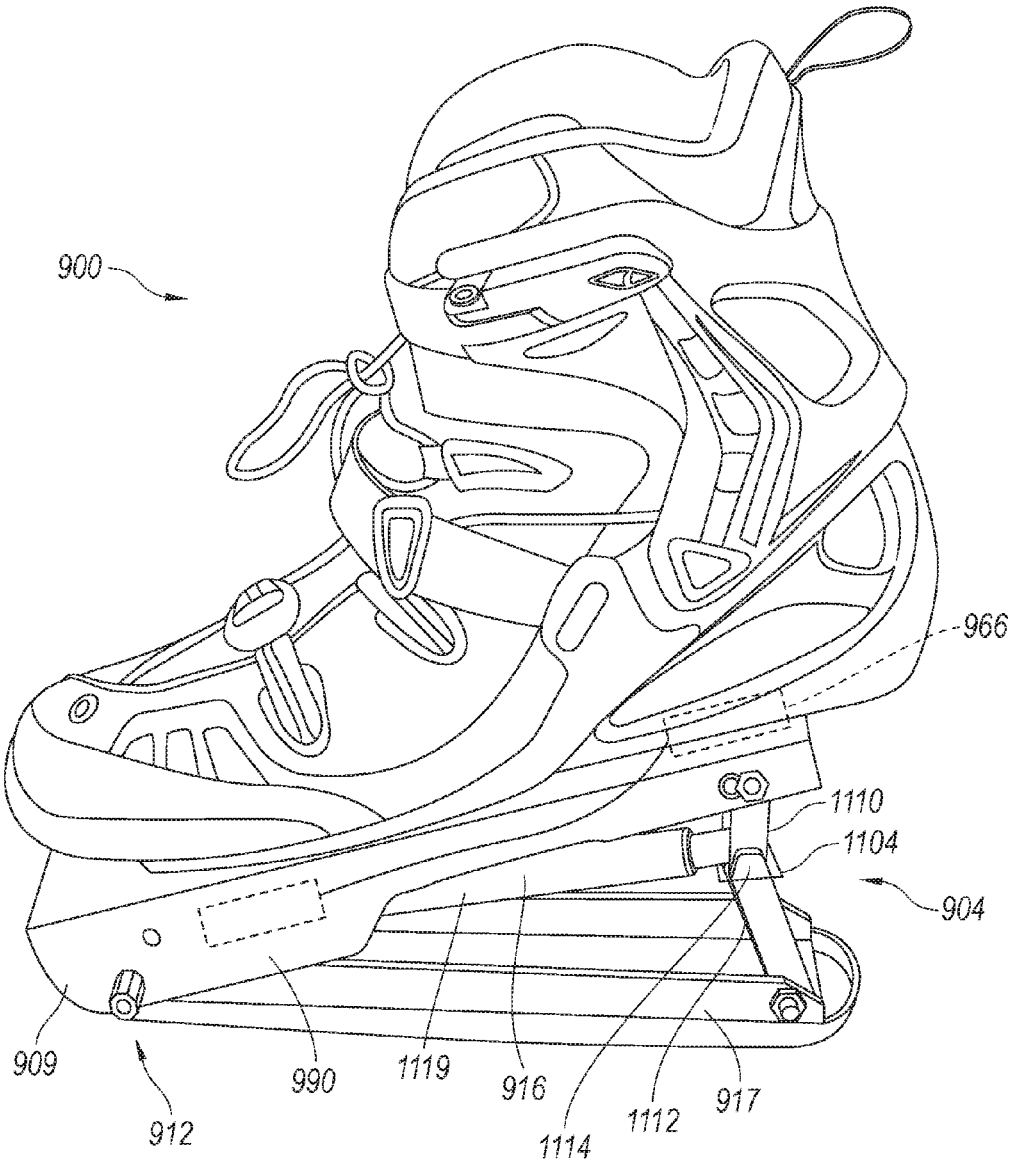
FIG. 32 is a side pictorial view of a wearable exercise apparatus in accordance with one embodiment.

FIG. 32 is a pictorial view of an exercise apparatus 900 with a collapsible resistance mechanism 904 in an expanded configuration. The apparatus contains a sole plate 917 rotatable with respect to a support plate 909 about an axis 912. The collapsible resistance mechanism includes a rearward linkage system 1104 and a linear resistance device 916. Resistance device 916 is capable of expanding when unweighted. The orientation of linkage elements 1110 and 1112 with respect to the orientation of the resistance device 916 can be such that forces on the resistance device 916 can be a fraction of the downward forces the user places on exercise apparatus 900. When these reduced forces are less than the resistance provided by resistance device 916, the collapsible resistance mechanism 904 can remain in the expanded configuration.

Exercise apparatus 900 can include a sensor 966 located generally under the user's heel and communicatively coupled to a controller 990. To cause the collapsible resistance mechanism 904 to begin to compress, the controller 990 can direct a motor with a drive device to pull linkage 1119 forward. This can change the orientations of linkages 1110 and 1112 such that the forces on resistance device 916 are greater than the resistance it provides. This can allow the collapsible resistance mechanism 904 to collapse under the user's weight.

Controller 990 may initiate closing of the collapsible resistance mechanism 904 after a delay from the time it receives data from sensor 966 indicating the user has begun to step onto exercise apparatus 900. The controller 990 may store data received from the sensor and/or times the data was received for use in controlling operation of collapsible resistance mechanism 904. Controller 990 may use the duration of the intervals between times the user has stepped on the mechanism or other part of the exercise apparatus in determining the length of a delay from the time the user steps on the exercise apparatus until the time it directs a motor to initiate closing of collapsible resistance mechanism 904. To provide a comfortable experience or to create the desired level of exercise, the controller may choose longer delays when the user is walking at slower speeds and decrease the delay when the user is walking at faster speeds.

Figure 33:
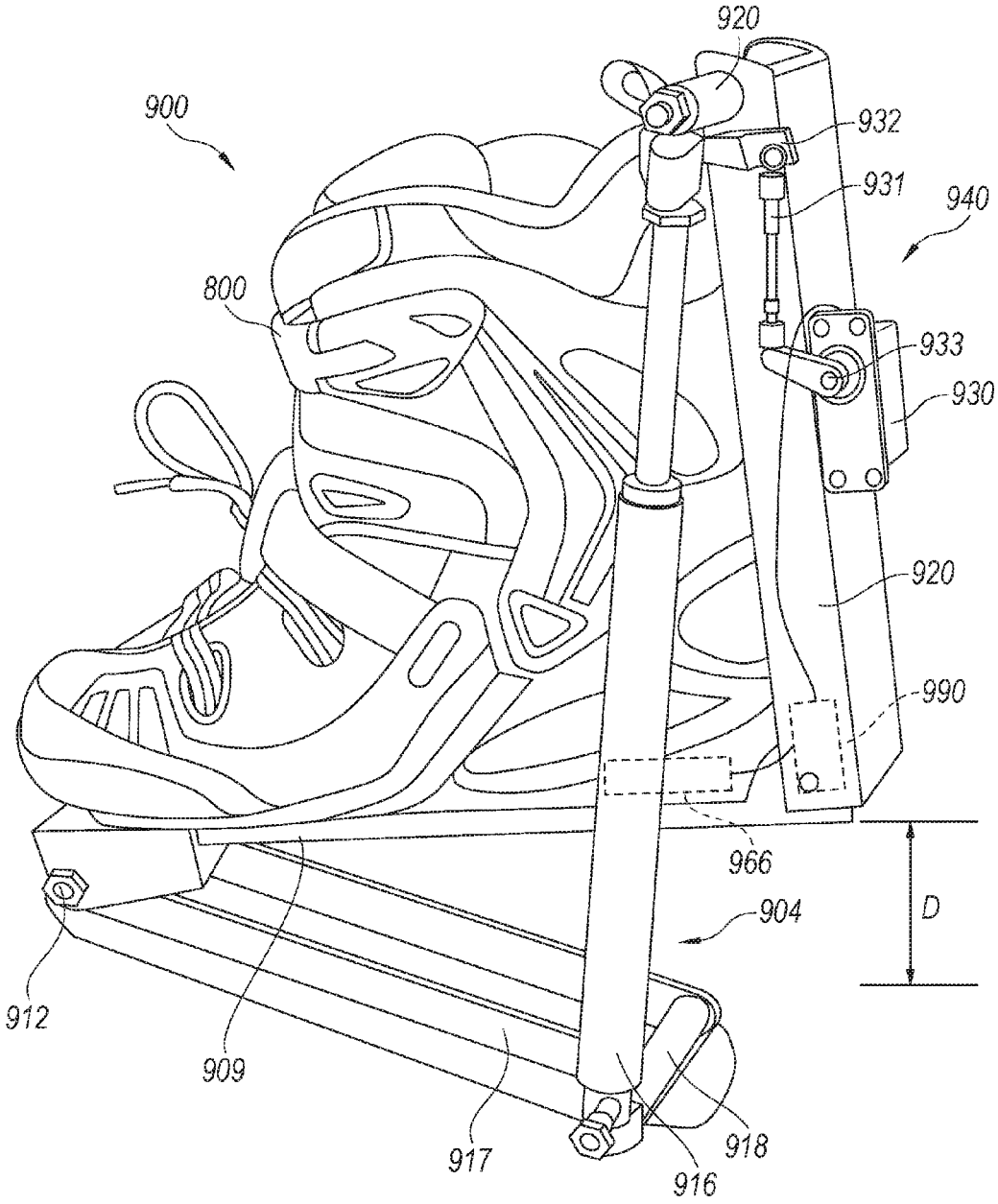
FIG. 33 is a side pictorial view of a wearable exercise apparatus in accordance with one embodiment.

FIG. 33 is a pictorial view of an exercise apparatus 900 in an expanded configuration. The apparatus includes a foot retaining element 801 with laces, straps, and buckles that can be used to secure the user's foot to the apparatus 900. The apparatus 900 includes a sole plate 917 rotatable with respect to a support plate 909 about an axis 912 defined by a pin assembly. One end of resistance device 916 is rotatably connected to the end of sole plate 917 and the other end is rotatably connected to vertical support component 920 which is fixedly connected to support platform 909 such that the distance D between the rear end of sole plate 917 and the rearward portion of support platform 909 is determined based on the expansion state of resistance device 916.

The expansion state of collapsible resistance mechanism 904 can be determined based on forces applied by the user on resistance device 916 and the resistance provided by device 916. When the resistance provided by resistance device 916 is greater than the forces applied to resistance device 916, distance D cannot be reduced. When the resistance of device 916 is less than the forces acting upon it, device 916 can compress, causing collapsible resistance mechanism 904 to move towards a compressed configuration. Resistance device 916 is capable of self-expanding when the exercise apparatus (and therefore resistance device 916) is unweighted.

The resistance provided by resistance device 916 can be varied by the operation of a component (e.g., an internal valve) which controls movement of a piston. For example, exterior operation of a valve can be accomplished by resistance control assembly 940, which includes components 930, 931, 932, and 933. Depressing lever arm 932 downward will move the valve towards the open configuration, thereby reducing the resistive force provided by mechanism 916. Motor 930 of resistance control assembly 940 includes a rotatable arm 933. Rotatable arm 933 is rotatably coupled to a linkage 931 that is rotatably coupled to lever arm 932.

Therefore resistance of device 916 can be affected by the operation of motor 930.

Operation of resistance control assembly 940 can be controlled by controller 990 which is communicatively coupled to motor 930. Controller 990 can send signals to control motor 930 which will in turn control the position of the valve of resistance device 916, thereby controlling the resistance that device 916 provides. Resistance device 916 may or may not exert a propelling force as it expands.

Controller 990 is communicatively coupled to one or more sensors 966 capable of measuring one or more characteristics including but not limited to forces applied, spatial relationships, acceleration/deceleration, relationships or proximity to elements of exercise apparatus 900 or relationships or proximity to elements of other exercise apparatuses.

Controller 990 can allow the sole assembly to close by reducing the resistive force of resistance device 916 after the user completes the exercise involved in stepping completely onto exercise apparatus 900. In some embodiments or modes of operation, the controller 990 may vary the resistance of device 916 several times during a single gait. In one embodiment, the controller 990 may minimize resistance of device 916 after the user has stepped up and increase resistance of device 916 as the sole assembly nears its closed configuration. In one embodiment, the controller 990 may close the valve of resistance device 916 to prevent expansion of device 916 for a short period of time once the sole assembly has reached its closed configuration to prevent propelling forces to maximize exercise received by the user.

The controller 990 can be capable of receiving new exercise programs or modified exercise parameters (desired level of exercise, desired simulation, muscles to target, etc.) through a plug-in connection (e.g. USB) located on the controller or wirelessly. Other embodiments include input devices such as a keyboard, a keypad, LEDs, LCDs, touch screens, knobs, or buttons to allow the user to set operational parameters of the apparatus.

Figure 34:
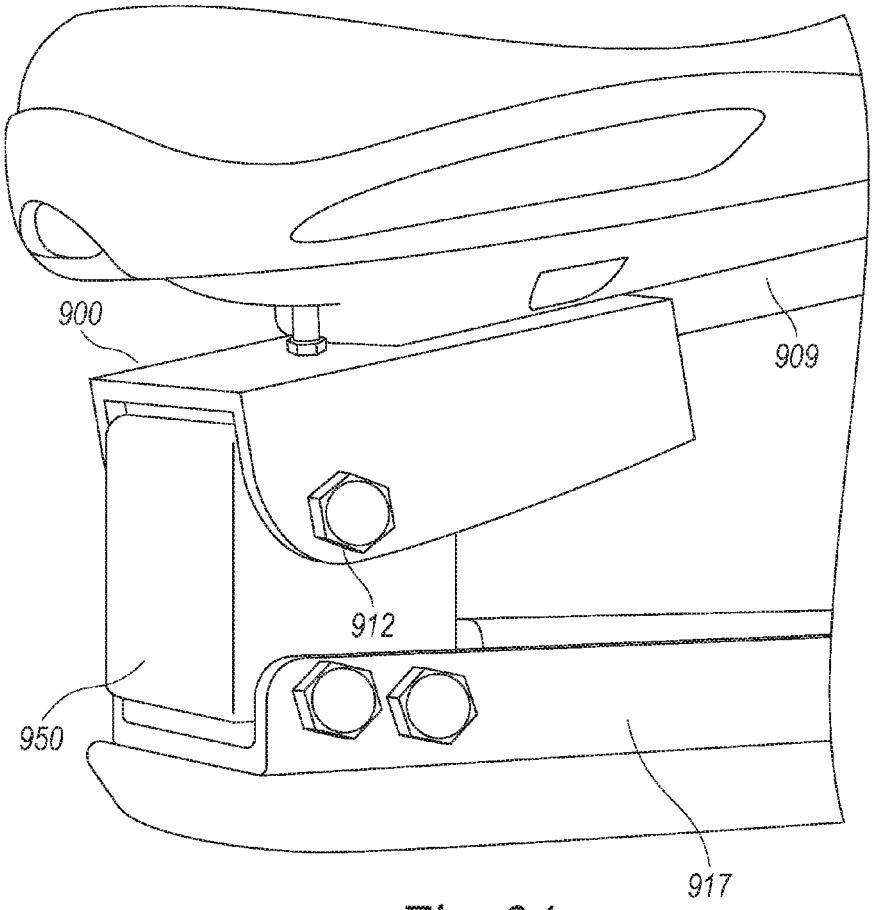
FIG. 34 is a side pictorial view of a portion of a wearable exercise apparatus in accordance with one embodiment.

FIG. 34 is a pictorial view of the front of an exercise apparatus 900 according to one embodiment. The apparatus 900 includes a support plate or platform 909, a sole plate 917, and a rotational axis 912 defined by a pin assembly inserted through holes in sole plate 909 and dampening element 950. Dampening elements 950 may comprise one or more materials including, without limitation, rubbers, plastics, EVAs, foams, fluid or gas filled bladders, and the like. In some embodiments a dampening element 950 may include rigid upper and lower elements suitable for fixedly connecting to elements 909 and 917 which are bonded to a central dampening component with compressible characteristics. In other embodiments a compressible component of element 950 may be bonded to an upper or lower rigid component but not both.

While FIG. 34 exhibits a configuration in which the rotational axis 912 is located at the intersection of components 909 and 950, alternatively other embodiments may rotate about an axis at the intersection of components 950 and 917 and that yet others may rotate about axes at both the intersections of both 909/950 and 917/950.

FIGS. 35 through 38 are pictorial views of an exercise apparatus 900 according to one embodiment containing frontward and rearward collapsible resistance mechanisms 904' and 904 respectively. In the embodiment shown in these figures, both collapsible resistance mechanisms are comprised of linkage assemblies 1104 and 1104' and linear resistive devices 916 and 916'. Those familiar in the art will recognize that in embodiments with a plurality of collapsible resistance mechanisms, the resistance mechanisms not necessarily be of the same type. The exercise apparatus of FIGS. 35 through 38 may have controllers that operate the collapsible resistance devices.

Figure 35:
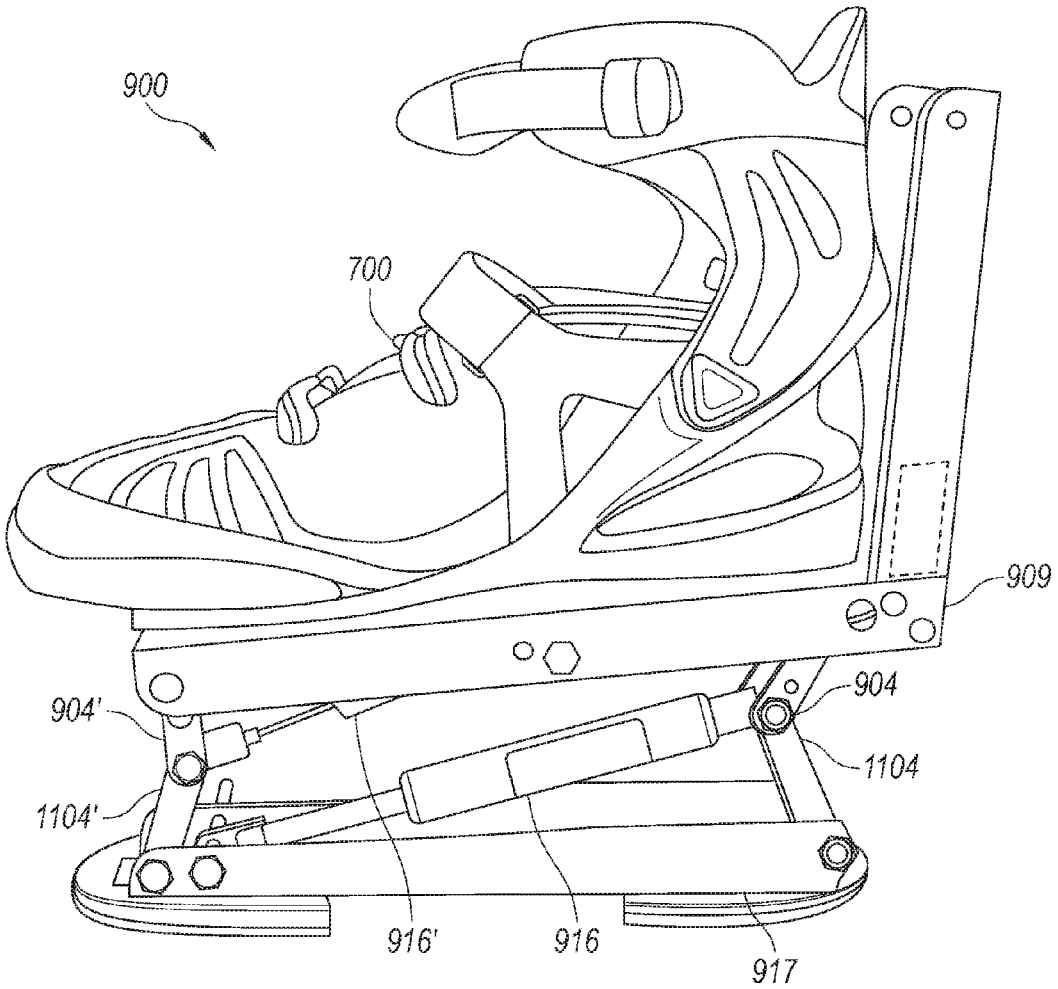
FIGS. 35 through 38 are side pictorial views of a wearable exercise apparatus in different configurations.
Figure 36:
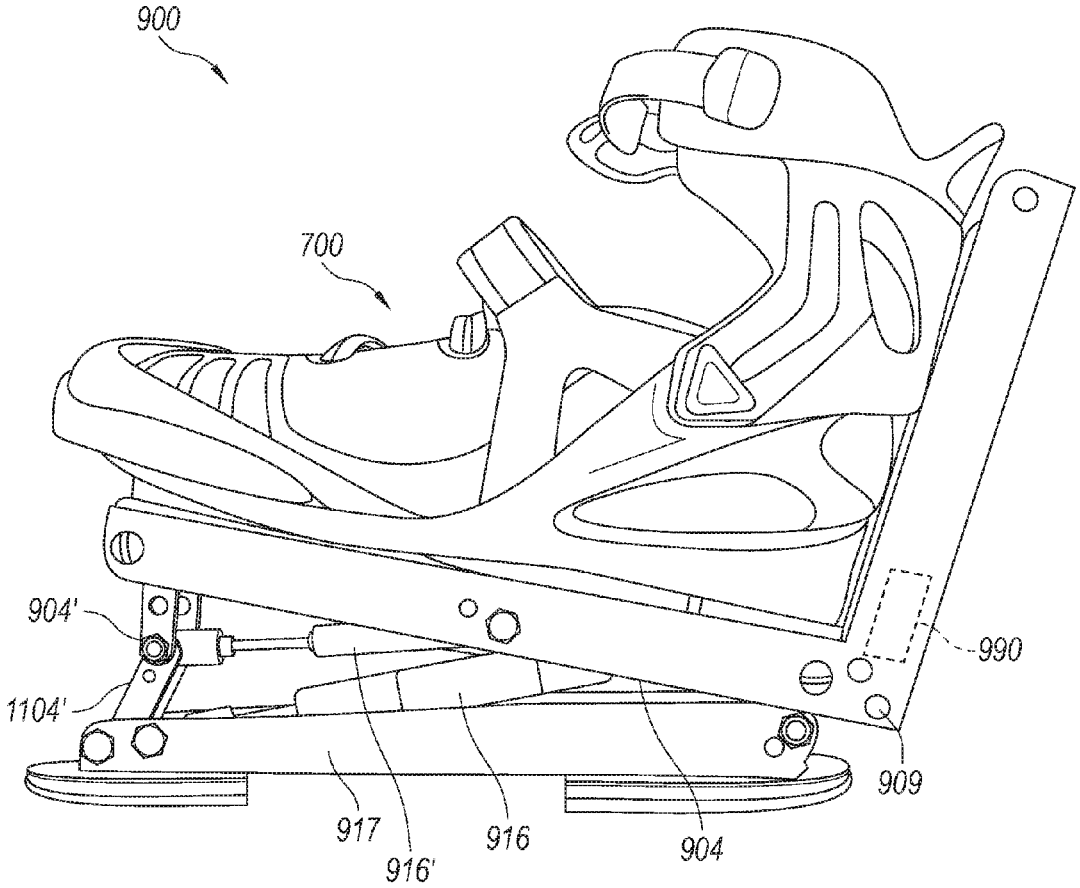
Figure 37:
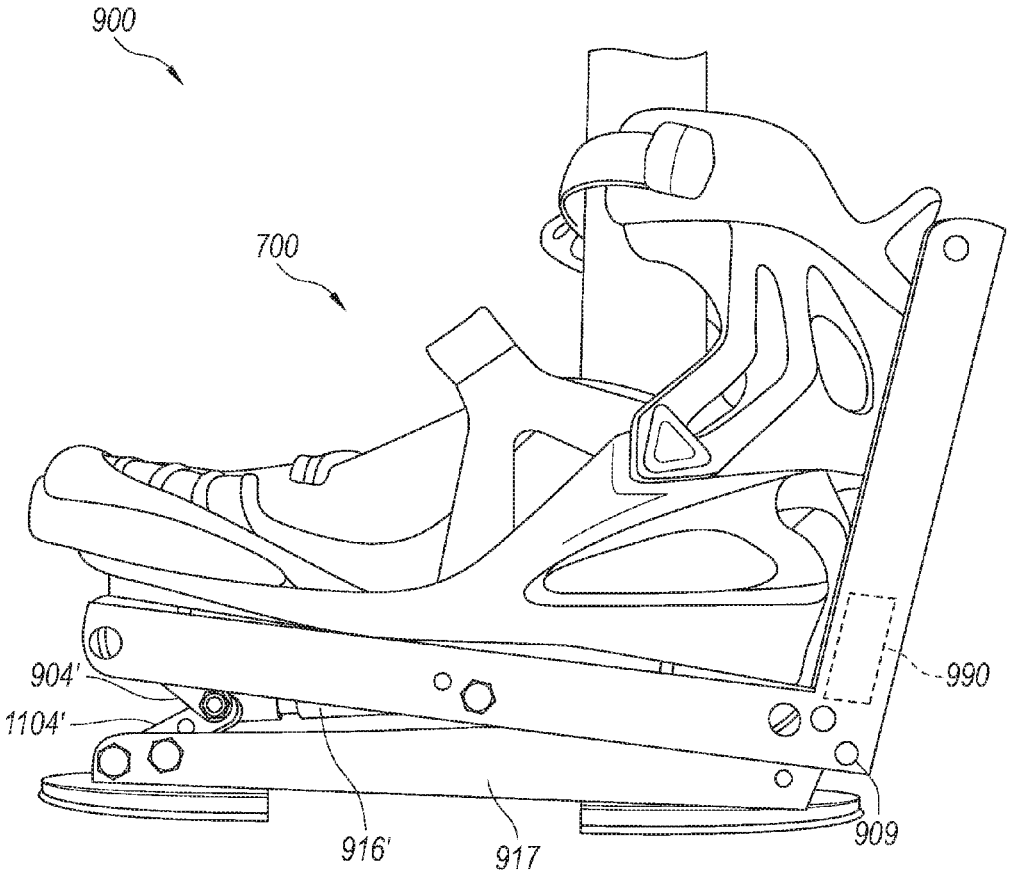
Figure 38:
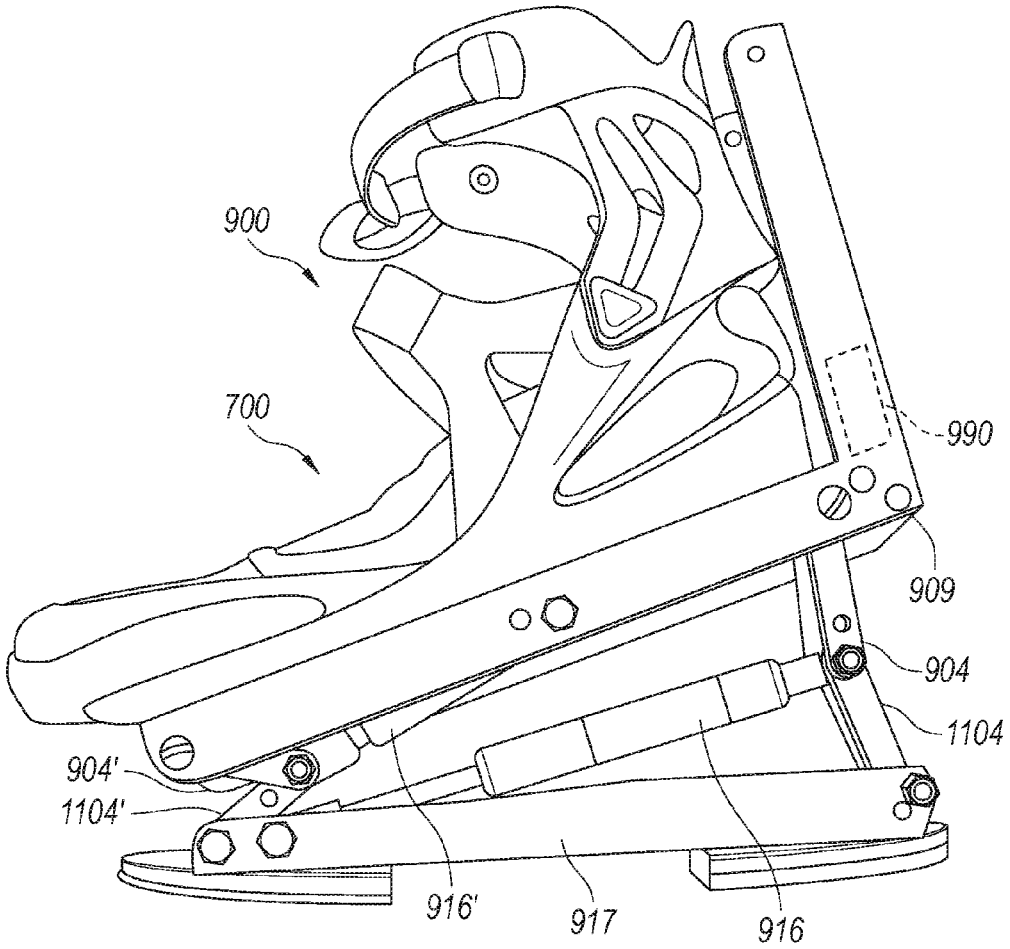

FIG. 35 shows an exercise apparatus 900 with both collapsible resistive mechanisms 904' and 904 in expanded configurations. FIG. 36 shows an exercise apparatus 900 with a rearward collapsible resistance mechanism 904 in a compressed configuration and a forward collapsible resistance mechanism 904' in an expanded configuration. FIG. 37 shows an exercise apparatus 900 with both collapsible resistance mechanisms 904' and 904 in closed configurations. FIG. 38 shows an exercise apparatus 900 with a rearward collapsible resistance mechanism 904 in an expanded configuration and a forward collapsible resistance mechanism 904' in a compressed configuration. While these figures and others in this application often show the support plate 909 as a separate component from the restraining means 700, it should be understood that a support plate or platform can be integrally formed with a bottom portion of restraining means 700.

In embodiments with multiple collapsible resistance mechanisms, one or more of the mechanisms (e.g., all of the mechanisms) may be independently controlled. The resistance profile of one collapsible resistance mechanism may be entirely different than the resistance profile of other collapsible mechanisms(s). The resistance profile of one collapsible mechanism may change over time while the resistance of one or more other collapsible mechanisms may remain constant over time. For instance, the resistance provided by a rearward collapsible mechanism may be reduced after the user has stepped onto the exercise apparatus while a forward collapsible resistance mechanism may provide a constant resistance throughout the user's gait (other than changes to the resistance due to changes in forces applied to the mechanism during the gait). The constant resistance may be selected based on the user's weight such that the forward collapsible mechanism can begin to compress once the user begins to transfer a substantial portion of their weight to a forward portion of the exercise apparatus. In other modes of operation, the resistance profile of a forward collapsible resistance mechanism may be reduced after a user transfers a substantial portion of their weight to a forward portion of the exercise apparatus. In other modes of operation, a resistance device may remain locked in an open or closed configuration.

FIGS. 39 through 42 show an exercise apparatus 900 according to one embodiment. The exercise apparatus includes a rearward collapsible resistance mechanism 904 and a forward variable height component 960. Variable height component 960 can be a collapsible resistance mechanism with controlled resistance levels or can be a component without variable resistance (for instance foam, rubber, EVA, a bladder, etc). Exercise apparatus 900 is substantially similar to apparatuses 900 disclosed in FIGS. 33, 24A-24C and FIGS. 35-38. Exercise apparatus 900 contains a controller 990 which can control resistance profiles of one or more collapsible resistance mechanisms. The function of rearward collapsible resistance mechanism 904 is substantially similar to that of collapsible resistance mechanism 904 of FIG. 33.

Distinguishing exercise apparatus 900 of FIGS. 39-43 from exercise apparatuses disclosed in FIGS. 33, 24A-24C, and FIGS. 35-38 is a diagonal connection element 950. Connection element 950 can include one a bar, plate, linkage, or other type of component that is rotatably coupled to a forward portion of support plate 909 and rotatably coupled to a rearward portion of sole plate 917. Diagonal element 950 can maintain a geometric relationship between elements 909 and 917 such that fore and aft forces on variable height element 960 are minimized or kept at or below a maximum level. This can allow for use of variable height elements 960 not suitable for withstanding fore or aft shear forces that may be encountered when a user walks, jogs, or runs, or otherwise travels or steps on and off exercise apparatus 900. This can enable, for instance, the use of EVA or bladders that otherwise might rip, stretch, puncture, or otherwise deteriorate if repeatedly subject to fore and aft shear forces. While the embodiments in these figures exhibit one set of locations for attachment of connection element 960 to elements 909 and 917, the connection locations can be varied and still provide one or more of the benefits described herein.

Figure 39:
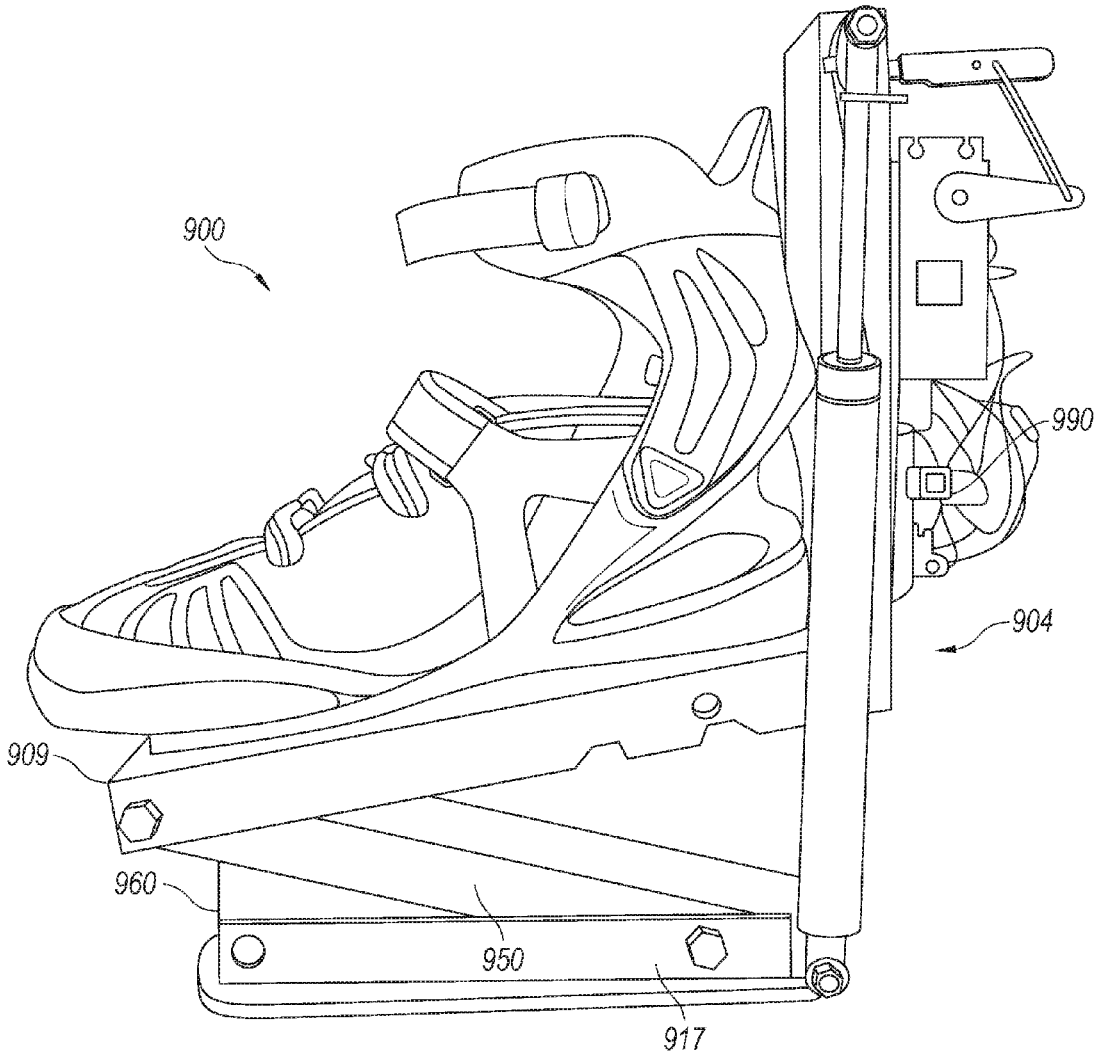
FIGS. 39 through 42 are side pictorial views of a wearable exercise apparatus in different configurations.
Figure 40:
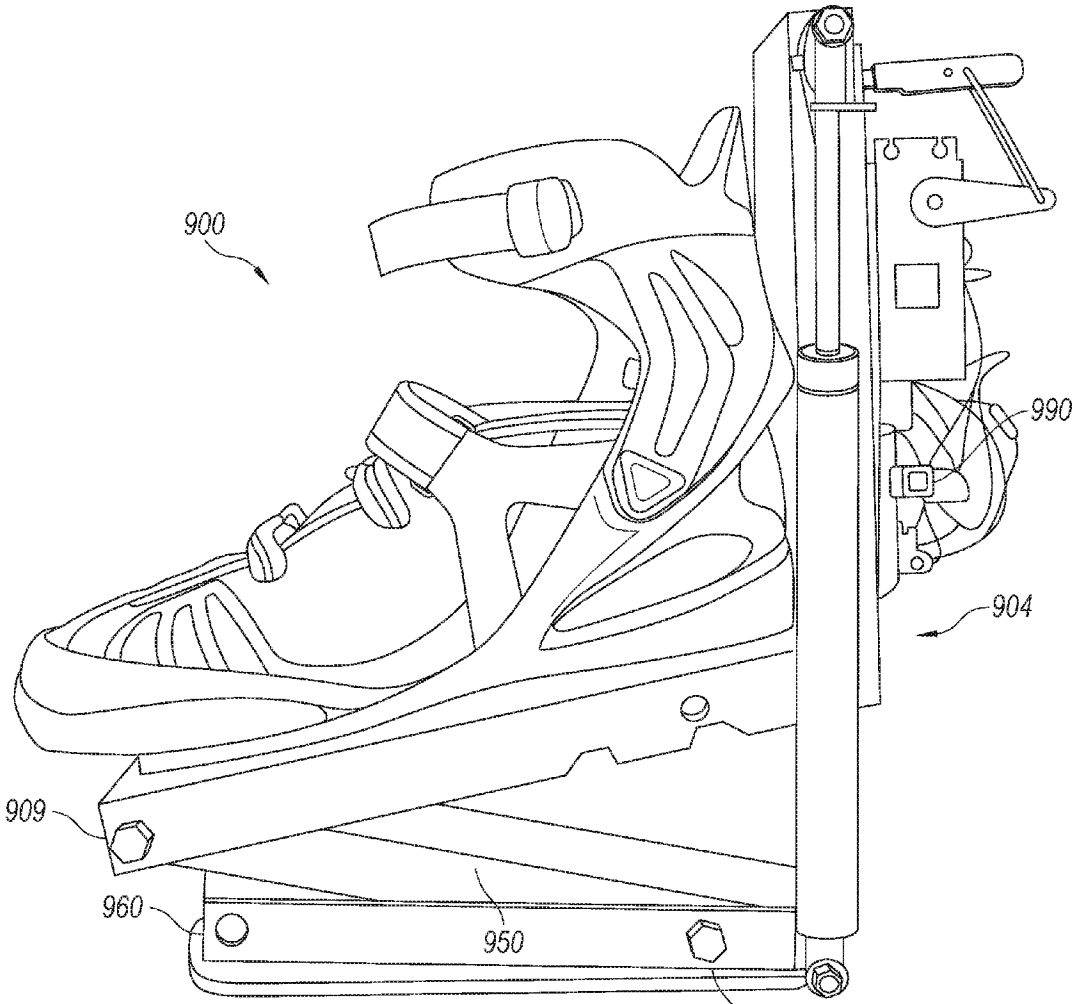
Figure 41:
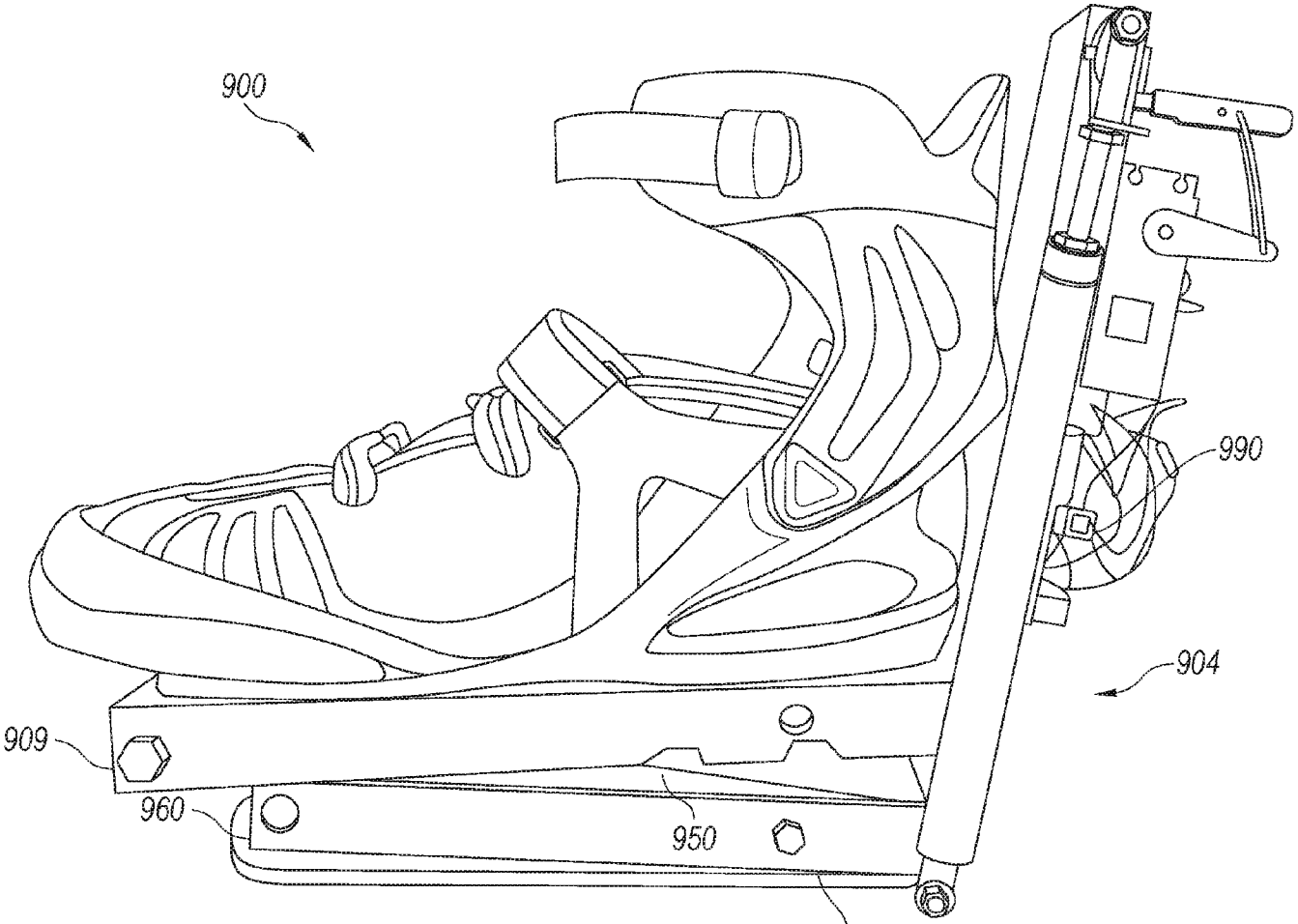
Figure 42:
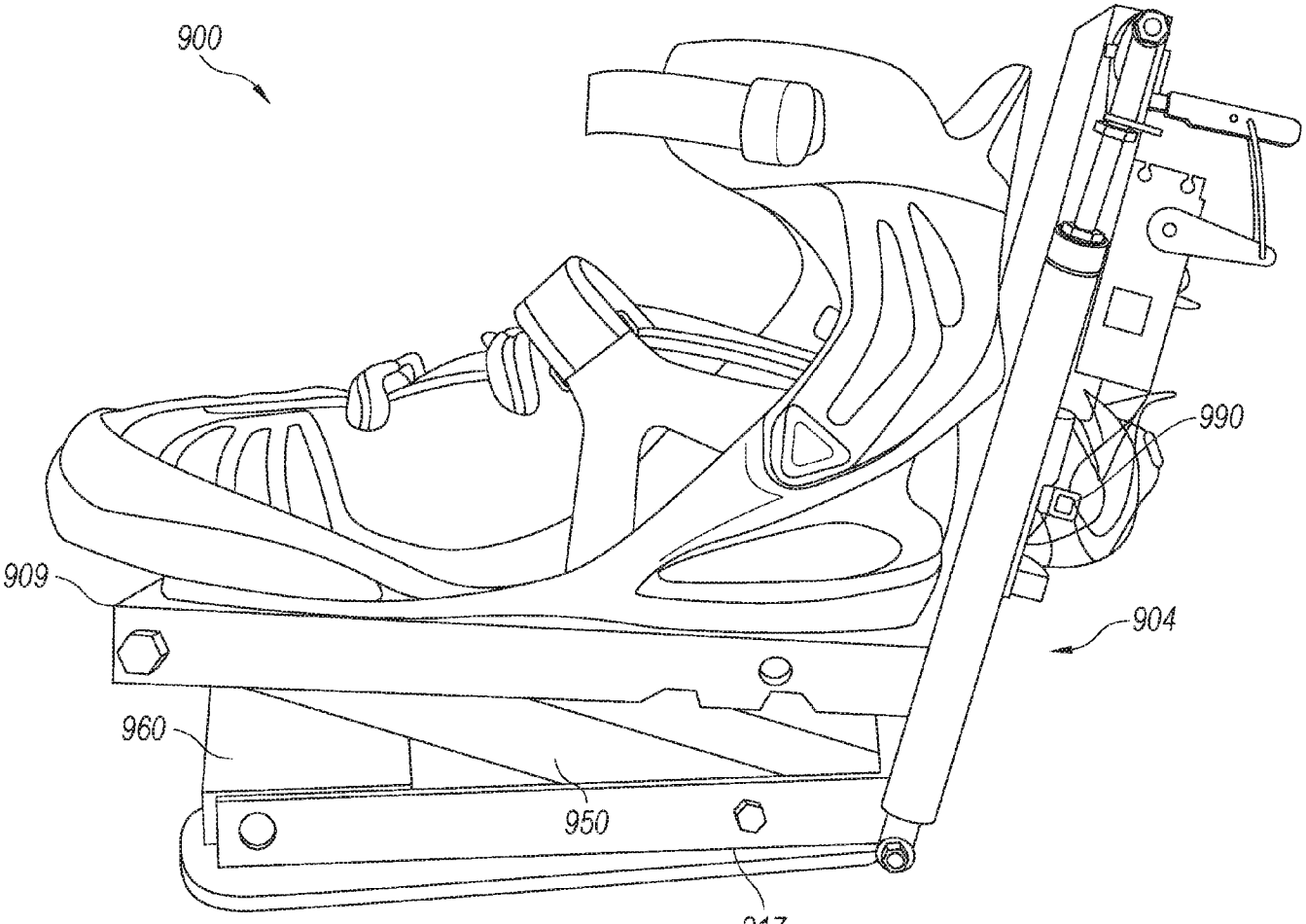

FIG. 39 shows an exercise apparatus 900 with both collapsible resistive device 904 and variable height element 960 in expanded configurations. FIG. 40 shows an exercise apparatus 900 with resistance device 904 in the expanded configuration and variable height element 960 in a closed configuration. FIG. 41 shows an exercise apparatus with both resistive device 904 and adjustable height element 960 in closed configurations. FIG. 42 shows an exercise apparatus with resistance device 904 in a partially expanded configuration and variable height element 960 in an expanded configuration. These different configurations can be achieved based on control of the exercise apparatus by controller 990 and forces applied by the user to exercise device 900.

Figure 43:
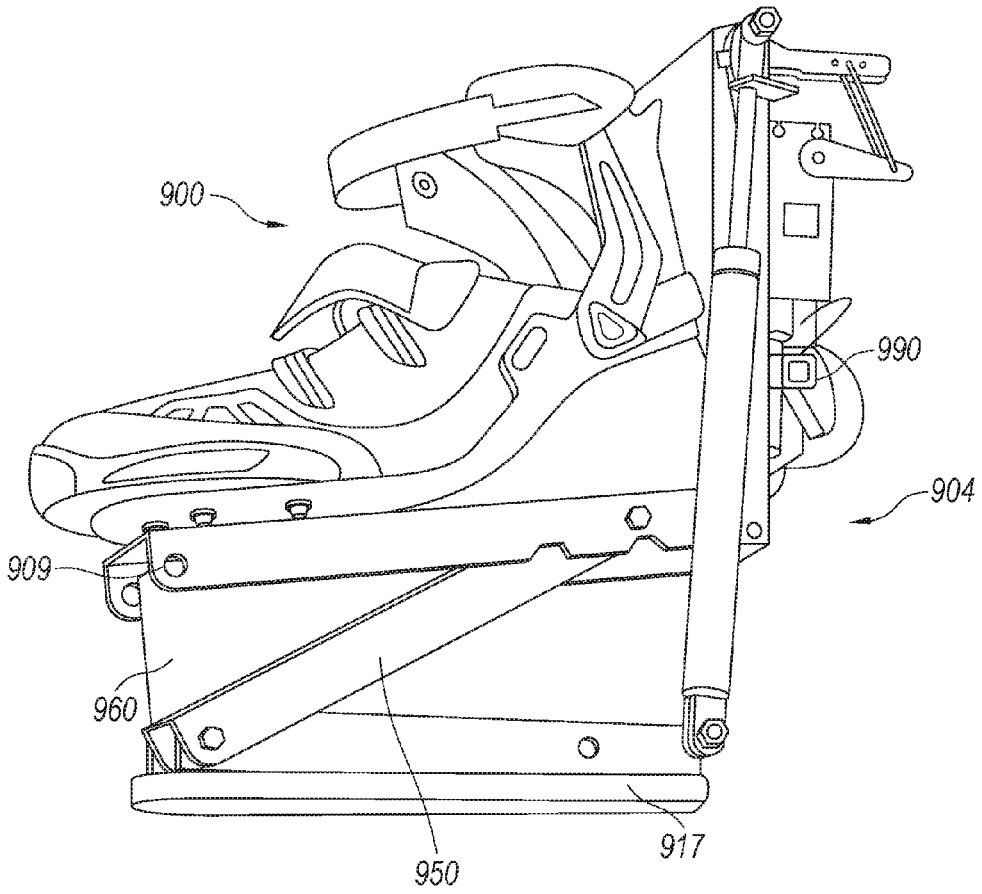
FIG. 43 is a side pictorial view of a wearable exercise apparatus in accordance with one embodiment.

FIG. 43 shows an exercise apparatus 900 according to one embodiment. Exercise apparatus 900 contains a rearward collapsible resistance mechanism 904 and a forward variable height element 960. Element 960 may be a collapsible resistance mechanism or may include components that compress when force is applied. Exercise apparatus 900 is substantially similar to the apparatus disclosed in FIGS. 39 through 42. Exercise apparatus 900 of FIG. 43 is distinguished from those of FIGS. 39 through 42 by the orientation of diagonal connection element 950. Diagonal element 950 is rotatably connected to a rearward portion of support plate 909 and rotatably connected to a forward portion of sole plate 917. Diagonal element 950 maintains a relationship between elements 909 and 917 such that there is minimal relative front to back movement with respect to elements 909 and 917 when the distance between elements 909 and 917 increase or decrease. Diagonal element 950 not only minimizes this movement but makes this movement predictable. Restricted and predictable front to back movement between the lower surface of plate 909 and the upper surface of sole 917 can enable the design and use of variable height elements disposed between these upper and lower elements that are unable to withstand unpredictable or significant shear forces. The length of diagonal element 950 as well as locations it can be attached to elements 909 and 917 can be varied.

Figure 44:
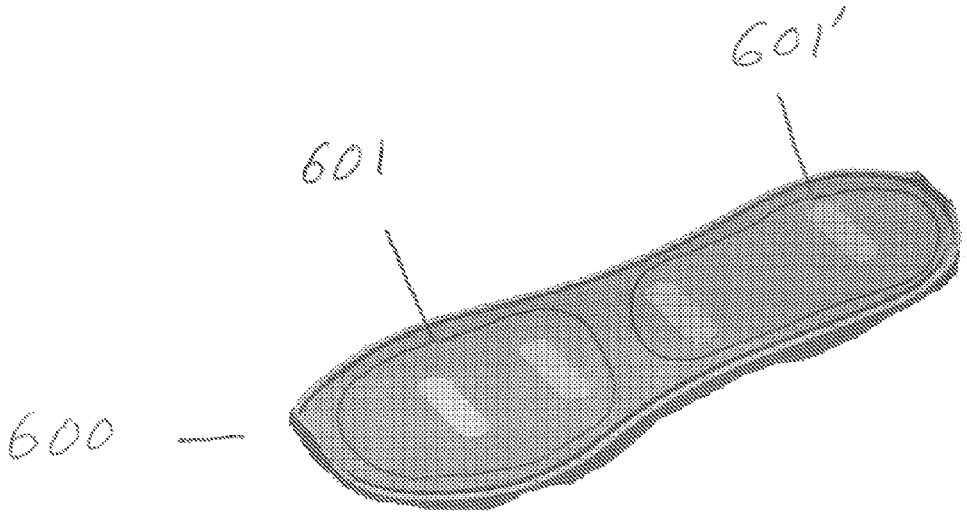
FIG. 44 is a horizontal cross sectional view of an upper portion of a sole of an exercise apparatus.
Figure 45:
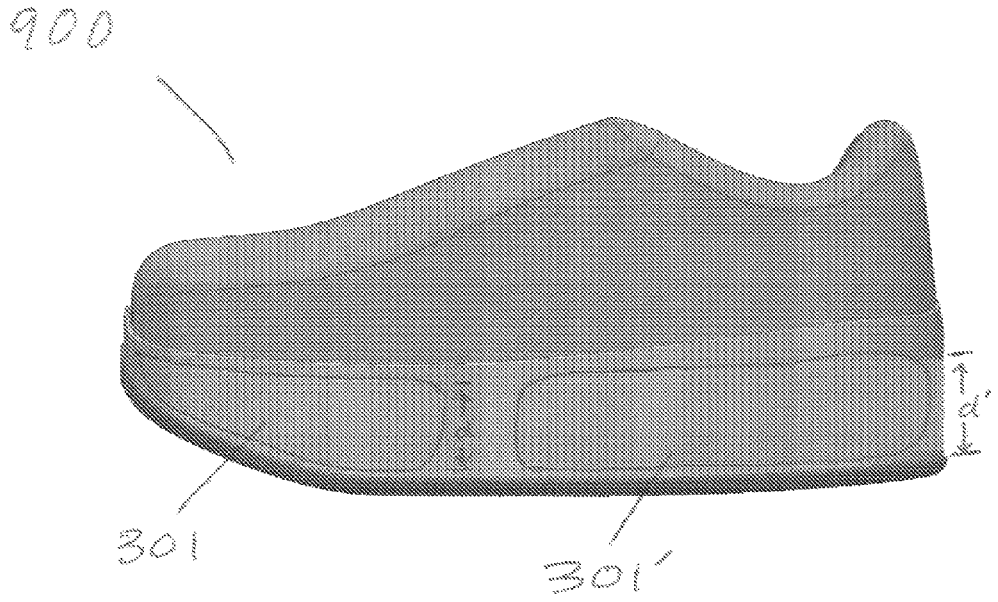
FIG. 45 is a side view of an exercise apparatus in accordance with one embodiment

FIG. 44 shows a horizontal cross section of an upper portion of a sole 600 of an exercise footwear apparatus containing two collapsible resistance mechanisms. A front collapsible resistance mechanism is located under ovular shape section 601. A rear collapsible resistance mechanism is located under ovular shape section 601'. As the user steps or stands on the exercise apparatus, the amount of resistance provided by the collapsible resistance mechanisms under these portions of the upper sole affects the angle of the user's foot with respect to the contact surface, the distance between the user's foot and the contact surface, and the amount of exercise delivered to different muscles groups FIG. 45 shows a side view of an exercise apparatus 900 with two variable resistance areas 301 and 301'. The resistance provided by area 300 can affect distance d while the user steps on, transfers weight along, stands on or steps off of variable resistance area 300. The resistance provided by area 301' can affect distance d' while the user applies forces to area 301'. A collapsible resistance mechanism designed to vary the forces in areas 301, 301', or any other location of an exercise apparatus may contain components that are not fully contained within the variable resistance area. For instance, parts of a mechanism designed to control the resistance in area 301' may have components that extend into area 301, other parts of the midsole, or into the upper of the exercise footwear apparatus. If the device designed to control resistance in area 301' employs a bladder, the bladder may be in fluid communication (perhaps selectively communicative) with other chambers of the same bladder, other bladders, or reservoirs located outside of resistance area 301'.

Some collapsible resistance mechanisms of wearable exercise apparatuses include bladders. Reducing the resistance provided by a bladder while the bladder is supporting the user's weight can cause the resistance device to move towards the compressed configuration. In some embodiments, reducing the resistance provided by a collapsible resistance mechanism is accomplished by reducing the volume of the fluid in the bladder. Bladders may be filled with one or more fluids (e.g., a liquid, a gas, liquid/gas mixture, etc.), gels, or the like. In some embodiments, reducing the volume of fluid in a bladder is enabled by opening one or more valves.

The resistance profile of some bladders may change during the user's gait. For instance, the resistance of a bladder may be reduced after a period of time has elapsed after the bladder is supporting a portion of the user's weight. In this way the bladder will compress, lowering the user's center of gravity. In other cases, a bladder's level of resistance may remain constant throughout a user's gait. For example, in some modes of operation, a bladder located forward of the arch of the shoe may maintain a constant volume of fluid throughout a gait. The volume of fluid, in some embodiments or modes of operation, may change over time based on characteristics of the user (weight, stride length, etc.), characteristics of the user's gait (cadence, angle of foot at heel strike, angle of foot at toe off, etc.), or based on exercise programs or exercise variables (for instance level of desired exercise, muscles the user wants to target during exercise, desired simulation, etc).

Some exercise apparatuses employing bladders contain controllers capable of receiving data from one or more sensors and/or input from the user in determining the level of resistance provided by one or more bladders of the exercise apparatus. A controller may calibrate the behavior of the exercise apparatus by recording sensor data or using equations based on sensor data. Calibration adjustments may include increasing or decreasing volume in one or more bladders, increasing or decreasing flow capacity of a flow regulator, or by opening or closing a valve.

In some embodiments, a collapsible resistance mechanism in the form of a bladder provides variable resistance against the user's mass upon the bladder to control the user's center of gravity. In some embodiments or modes of operation the resistance can be selectively reduced by allowing the fluid in the bladder to escape to an auxiliary reservoir or secondary bladder. In some embodiments an auxiliary reservoir or secondary bladder has elastic properties such that when the resistance bladder is unweighted pressure in the auxiliary reservoir/secondary bladder is higher than that of the resistance bladder. The volume in the resistance bladder can be restored by this pressure difference via a one way valve or by keeping a controllable valve open until the bladder has been restored to the intended volume. When a compressible gas is used in a bladder, pressure in an auxiliary reservoir or secondary bladder will exceed the pressure in the resistance bladder regardless of whether the exterior chamber has elastic properties. If the auxiliary reservoir/secondary bladder is in communication with the resistance bladder when the resistance device is unweighted, gas will move back into the resistance bladder.

Figure 46:
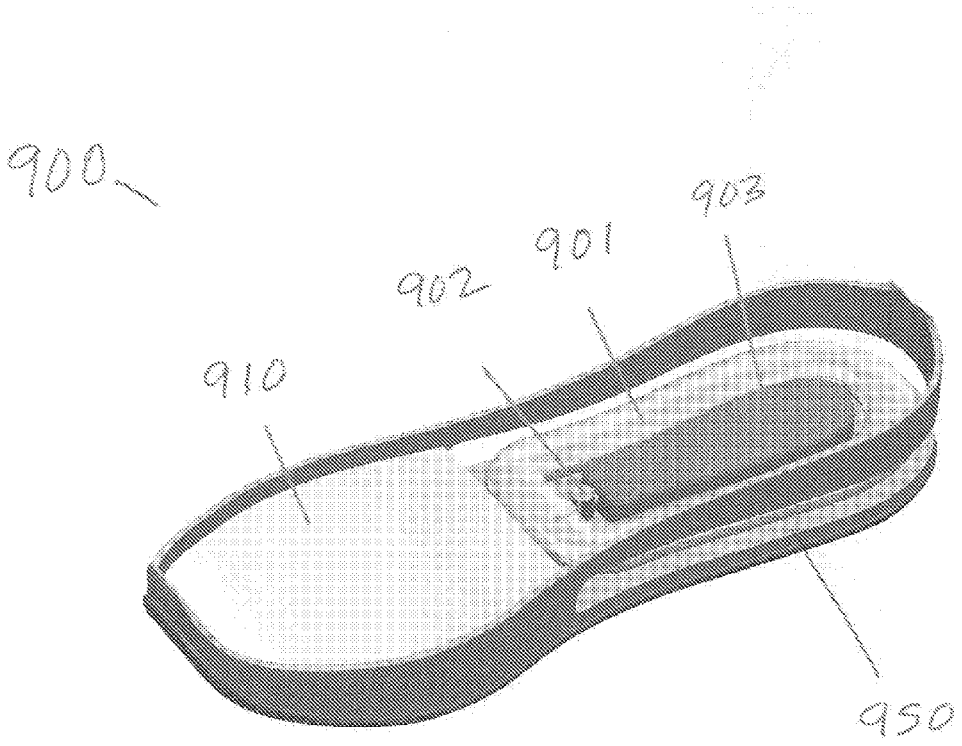
FIG. 46 is a cutaway view of an exercise apparatus with a rear collapsible resistance mechanism in an expanded configuration.
Figure 47:
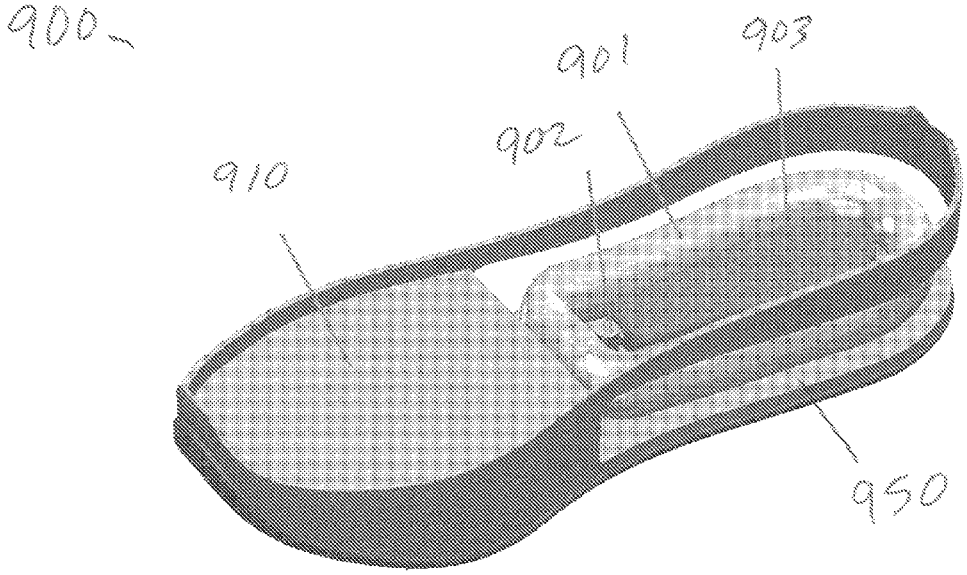
FIG. 47 is a cutaway view of an exercise apparatus with a rear collapsible resistance mechanism in a compressed configuration.

FIGS. 46 and 47 show portions of an exercise apparatus 900 containing two collapsible resistance mechanisms. Top and side portions of the sole are cut away to exhibit the rear collapsible resistance mechanism 950. Variable resistance device 950 includes a bladder 901, valve 902 (e.g., a two way valve, a one way valve, etc.), and auxiliary reservoir 903. When valve 902 is closed the bladder provides the greatest resistance to forces on mechanism 950, resulting in a greater distance from the user's foot to the contact surface. FIG. 47 shows resistance mechanism 950 in an expanded configuration. When the mechanism is weighted and valve 902 is opened, the forces of the user exerted on bladder 901 cause fluid to escape to reservoir 903. This lowers the height of resistance mechanism 950 thereby reducing the distance between the user's foot and the contact surface. A compressed configuration of resistance mechanism 950 is exhibited in FIG. 46.

Return of fluid to bladder 901 can be accomplished by keeping the valve 902 open while the device is unweighted. Alternatively, a one way valve (e.g., a check valve, a duckbill valve, etc.) can be employed.

The forward collapsible resistance mechanism of exercise apparatus 900 of FIGS. 46 and 47 (not shown, located under sole portion 910) could be generally similar to the collapsible resistance mechanism 950. Forward located collapsible resistance mechanisms can be operated in a manner to absorb energy as the user steps from the exercise apparatus. In some modes of operation, forward collapsible resistance mechanisms begin to reduce their resistance as the user's weight is transferred to the forward resistance device. In some modes of operation, the rate of resistance reduction and/or total amount of resistance reduction provided by forward resistance devices may be based on sensor data, the user's weight, characteristics of their gait, or user input variables, (desired level of exercise, selected exercise program, targeted muscles, etc.).

Figure 48:
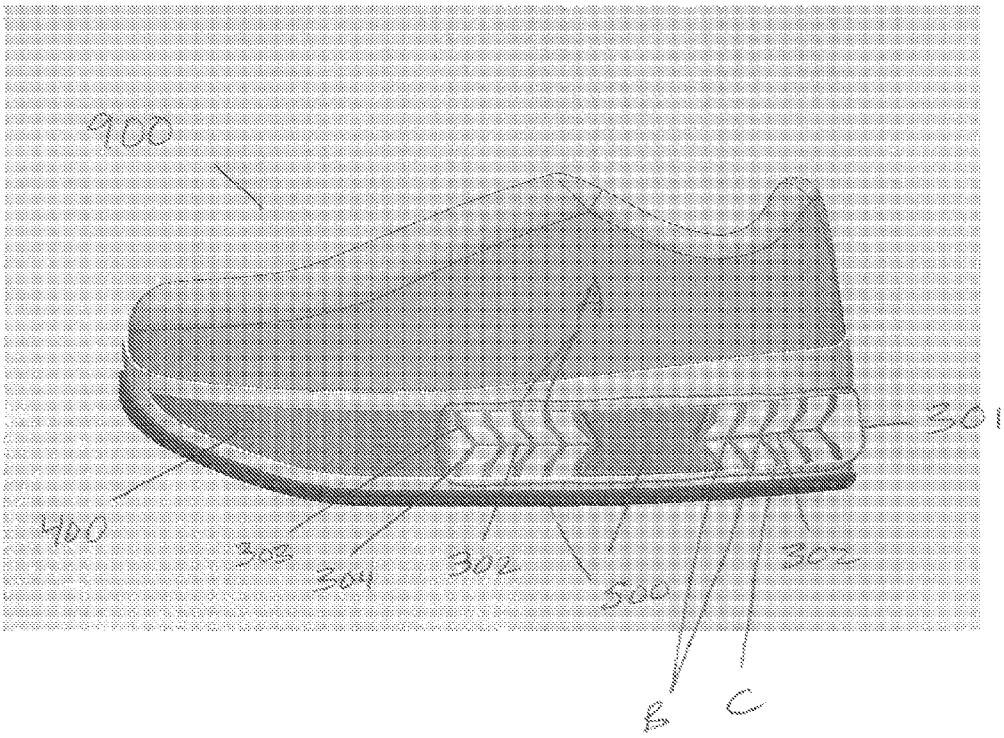
FIG. 48 is a side elevational view of an exercise apparatus with a rear collapsible resistance mechanism in an expanded configuration
Figure 49:
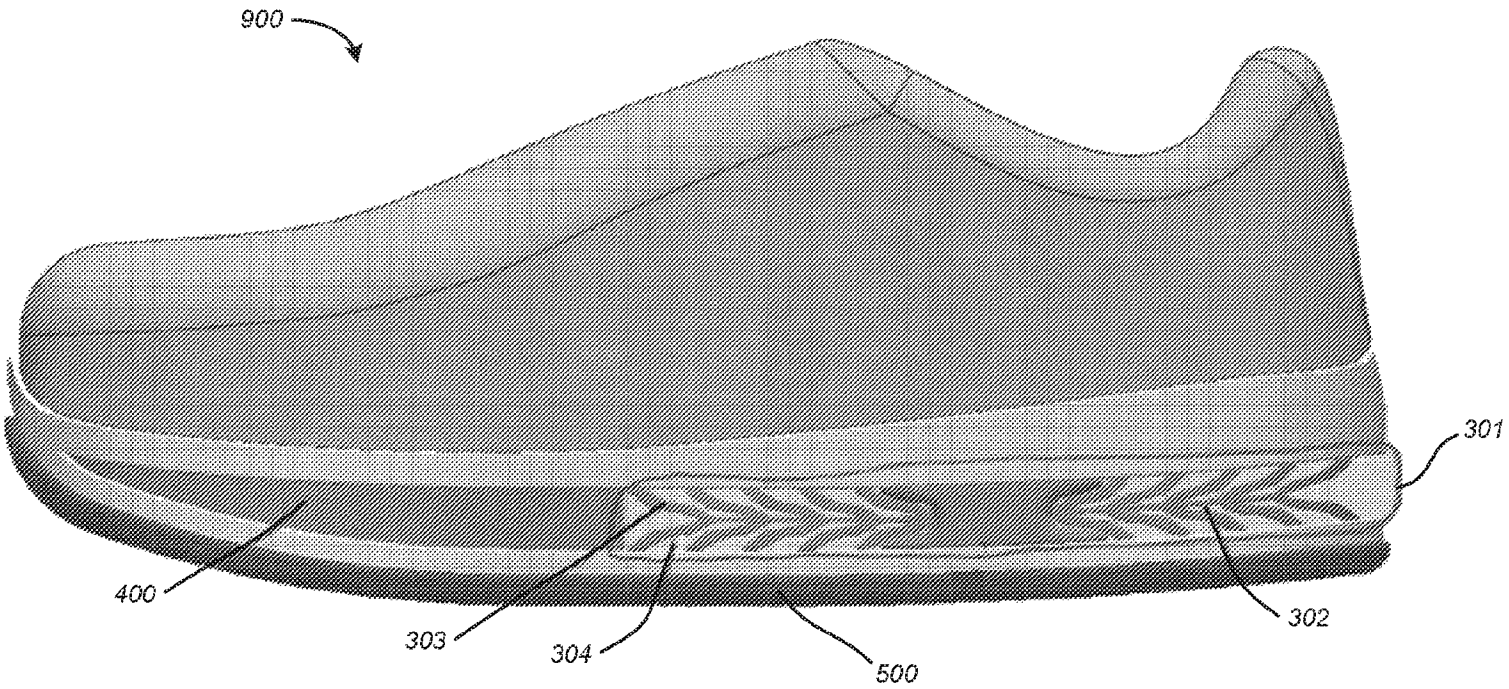
FIG. 49 is a view of an exercise apparatus with a rear collapsible resistance mechanism in a compressed configuration.

FIGS. 48 and 49 show portions of an exercise apparatus 900 including two collapsible resistance mechanisms. Portions of sole 500 are cut away to show components of rear collapsible resistance mechanism 301. Collapsible resistance mechanism 301 includes upper and lower linkage elements 303 and 304 respectively, horizontal connection elements 302 which intersect with lower ends of upper elements 303 and upper ends of lower elements 304 at joints B. Upper ends of elements 303 are attached to a rigid upper portion of sole 500 at joints A. Lower ends up elements 304 are attached to a rigid lower portion of sole 500 at joints C. Elements 301, 302, 303, 304, and upper and lower rigid parts of sole 500 can be made of rigid polymer. Joints A, B, and C must be flexible to allow hinging at those joints. Hinging can be accomplished by bonding an elastomeric at these joints, using pin assemblies, or by using geometry (for example, thinner dimensions of the polymer at joints A, B, and C than the straight segments of 302, 303, and 304 to allow flexibility at these thinner points). The number of linkage elements can vary from the number shown in FIGS. 48 and 49.

Downward forces on collapsible resistance mechanism 301 are transferred through the linkages and joints towards central bladder assembly 500. The resistance provided by bladder assembly 500 therefore controls the resistance provided by collapsible resistance mechanism 301. With configurations that include relatively vertical orientations of linkage elements 303 and 304, the forces acting on bladder assembly can be a fraction of the downward forces on resistance device 301. Footwear bladders are often filled to 30 to 35 psi and vertical linkage orientations are capable of reducing forces on bladder assembly below 30 psi. Bladder assembly 500 contains a valve which allows fluid in the bladder to escape to an external reservoir, thereby allowing resistance device 301 to collapse, thereby lowering the user's center of gravity. FIG. 49 exhibits the exercise apparatus of FIG. 48 in a collapsed configuration.

Figure 50:
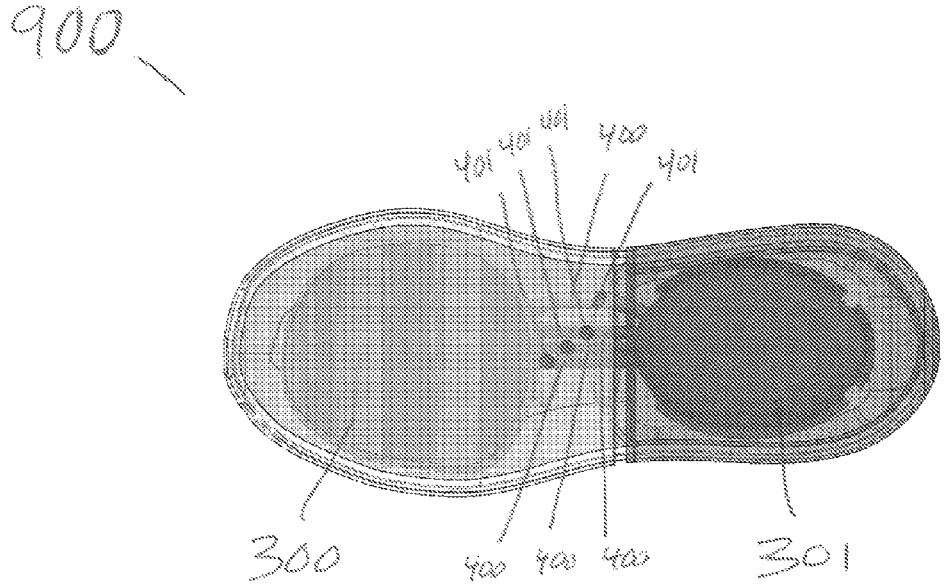
FIG. 50 is a bottom view of an exercise apparatus in accordance with one embodiment.

In some embodiments with multiple collapsible resistance mechanisms including resistance bladders, the bladders are in communication with each other subject to the flow rate of one or more valves disposed between the bladders. FIG. 50 is a bottom view of an exercise apparatus 900 containing a front resistance device 300 and a rear resistance device 301. There is a plurality of connections 400 disposed between the two bladders, each containing a valve 401. Control of fluid flow between front bladder 300 and rear bladder 301 creates height and resistance profiles in the bladders to accomplish the exercise benefits that are the subject of this specification. In embodiments with a controller, one or more of the valves can be solenoid valves communicatively coupled to the controller. The controller can use data from one or more sensors on the exercise apparatus and/or wireless data received from another exercise apparatus in determining valve states over time to produce the desired exercise characteristics of exercise apparatus 900.

In some modes of operation, for a period of time after the user's heel contacts the ground a valve's flow remains unchanged until the user has stepped completely onto the exercise apparatus. For instance a valve disposed between bladders 301 and 300 may remain closed for a period of time as the user steps onto the rear portion of exercise apparatus 900. When the valve's flow is increased, fluid may be forced from bladder 301 to 300. In some modes of operation, as the user transfers weight to the front of the footwear apparatus or as the user begins stepping off of the footwear apparatus, the controller can open a valve or increase flow of a valve to allow fluid in bladder 300 to be forced by the user's weight to bladder 301, thereby absorbing energy as the user steps off of the apparatus. The flow volume at various stages as the user travels on the exercise apparatuses may be determined by sensor data obtained over time and/or user inputs. Some bladders have internal sensing devices such as those described in U.S. Pat. No. 5,813,142 to Demon or others. The pressure in a bladder at various points of the user's gait or when the apparatus is unweighted may in part determine the timing of valve operation and/or how far a valve is opened at various points in time.

Figure 51:
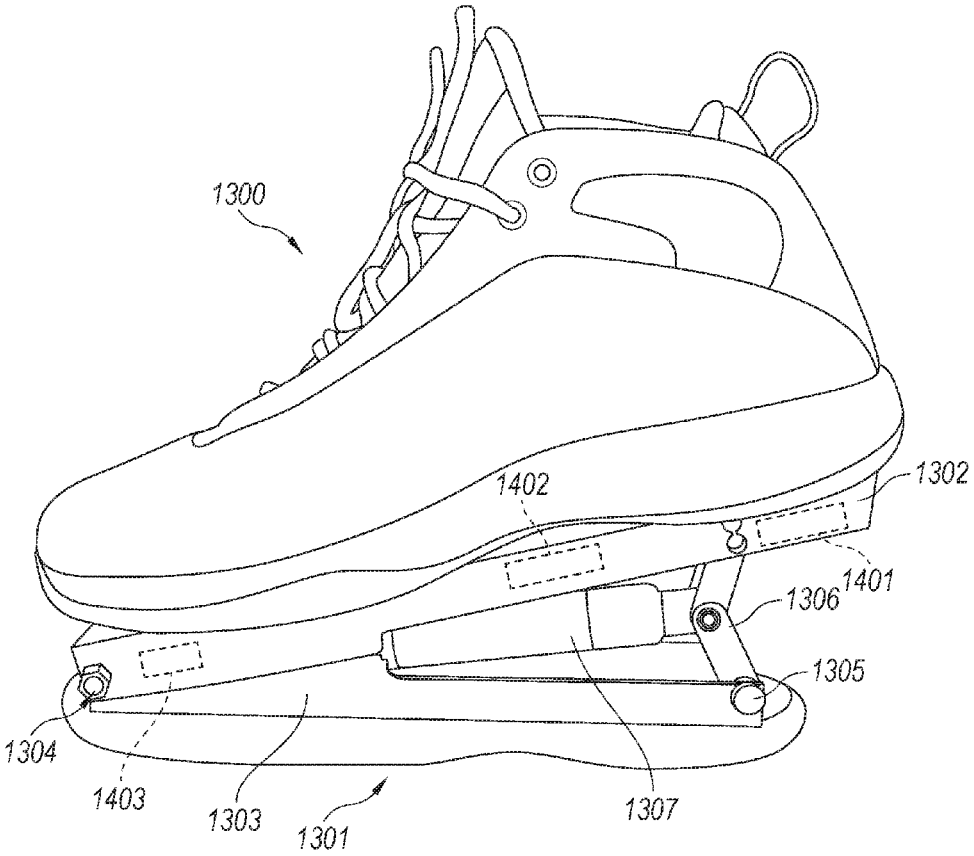
FIG. 51 is a pictorial view of an exercise apparatus in accordance with one embodiment.
Figure 52:
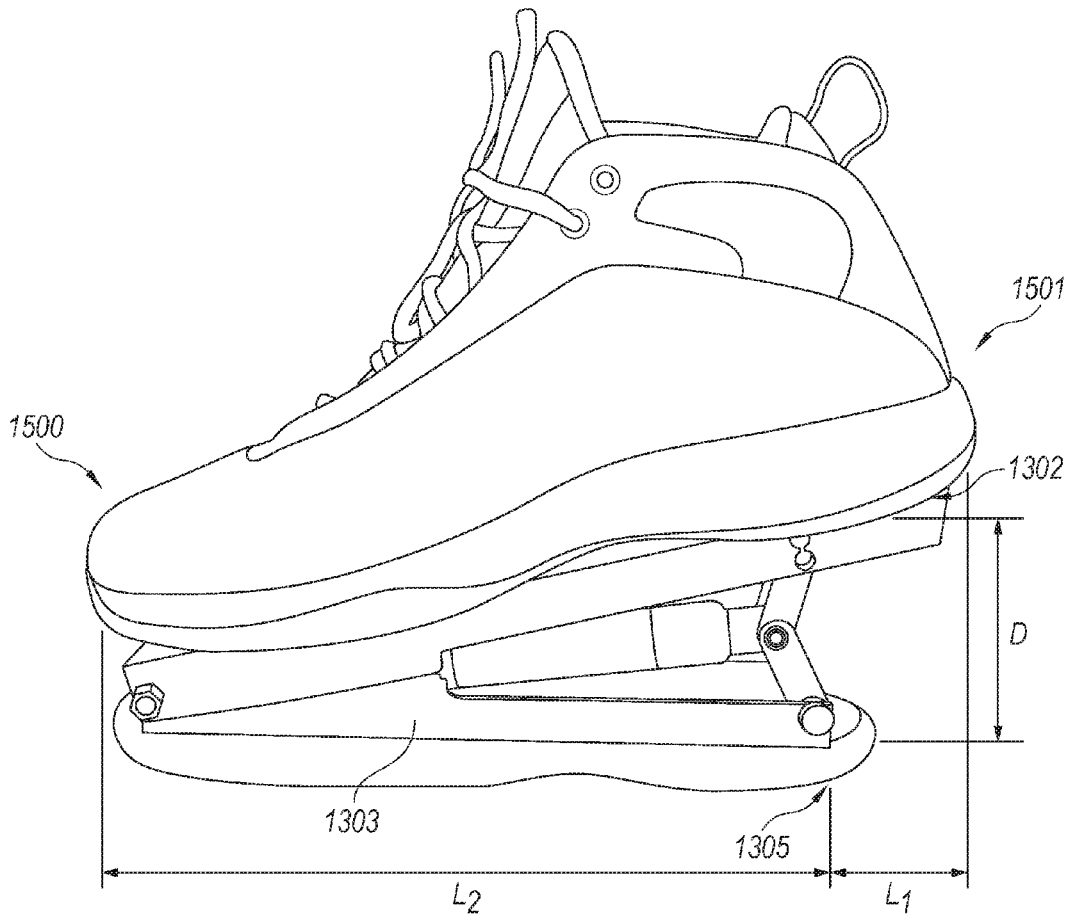
FIG. 52 is a pictorial view of an exercise apparatus in accordance with one embodiment.

FIGS. 51 and 52 show a wearable exercise apparatus 1300 in accordance with one embodiment. Cardiovascular exercise can be delivered through the control of an articulating collapsible resistance mechanism 1301. The height D between support platform 1302 and the rearward portion of 1305 of sole plate 1303 can be controlled to configure the exercise device between expanded and compressed configurations. Sole plate 1303 is attached to support platform 1302 by a pin assembly at rotational axis 1304. Rotational axis 1304 is generally located under the portion of the footwear's upper designed to hold the user's toes. In other embodiments the axis can be located at other locations.

Resistance mechanism 1301 includes a linkage assembly 1306, which can transfer a substantial portion of the user's forces on the apparatus onto linear resistance device 1307. When the resistance generated by resistance device 1307 exceeds the linear forces acting upon resistance device 1307, distance D of FIG. 52 cannot be reduced and the exercise apparatus is prohibited from moving towards a compressed configuration. When the resistance generated by resistance device 1307 is lower than the forces acting upon device 1307, the exercise apparatus can move towards the compressed configuration, thereby reducing distance D. The linear resistance device expands when unweighted which expands the exercise apparatus towards the expanded configuration.

Variable linear resistance devices are capable of expanding when unweighted and can be referred to as "locking gas springs" or "lockable gas springs." Exemplary locking gas springs are offered by Bansbach, LS Technologies, and Ameritool among other companies. Each of these products can contain a lever that controls the resistance of the device. For instance, the linear resistance device 1307 of FIG. 51 operates via a lever in this way.

Other linear resistance devices with mechanical or electromechanical delay mechanisms can be used to delay collapse of the exercise apparatus for a period of time after the user steps onto or stands on the exercise apparatus 1300. For example, the linear resistance devices described in images 55-62 or linear resistance devices using delay systems as described in International Application No. PCT/US2009/032748 and U.S. application Ser. No. 12/865,695 (U.S. Pub. No. 2011/009233).

The exercise apparatus of FIG. 51 includes a sensor 1401 communicatively coupled to controller 1402 and an actuating device 1403 communicatively coupled to controller 1402 (collectively "control system"). The control system can contain a power supply. The actuating device 1403 configures the lever of resistance device 1307 to provide the desired function of exercise apparatus 1300. In one mode of operation, sensor 1401 sends signals to controller 1402 and controller 1402 directs actuator 1403 to configure the lever of resistance device 1307, selectively allowing the exercise apparatus to move towards the compressed configuration. In some modes of operation the controller directs the actuating device to reduce the resistive force of linear resistance device 1307 after a period of time has elapsed after one or more sensors has detected a change in a parameter monitored by the sensor(s).

In other embodiments, the actuator is located internal to the linear resistance device. For instance, the actuator may be a solenoid valve, pressure switch, or coil cooperating with a ferrous material in the linear resistance device to change the viscosity of a fluid in the linear resistance device.

While one sensor is shown in FIG. 50, it is understood that some embodiments can contain multiple sensors and that they may be located in the sole, midsole, upper, other locations, or the like. The sensors 650 can be force sensors, pressure sensors, strain gauges, proximity sensors, force sensitive resistors, or other types of sensing elements capable of detecting a desired parameter and sending at least one signal indicative of the detected parameter.

In some modes of operation, the controller uses sensor data from more than one step in determining the resistance profile of resistance device 1307 over time. In one mode of operation, the controller determines when to allow the exercise apparatus to begin compressing based at least in part on how fast the user is walking.

Referring to FIG. 52, distance L1 defines the distance from the rearward portion 1305 of the sole plate 1303 to the rearward portion of the internal of the upper of the footwear 1501. L2 defines the distance from element 1305 to the front portion of the internal of the footwear's upper 1500. The ratio R=L1/(L1+L2) determines a balance point of the user's mass as they step onto or stand on the expanded exercise apparatus. R=L1/(L1+L2) can be selected to facilitate a natural gait or comfortable walking experience. Ratios R that are too small may throw the user's mass uncomfortably or unsafely forward as the user steps onto or stands on the exercise apparatus. In some embodiments the ratio R can be 0.1, 0.2, 0.3, 0.4, or ranges encompassing such ratios. Other ratios can be selected, if needed or desired.

Figure 53:
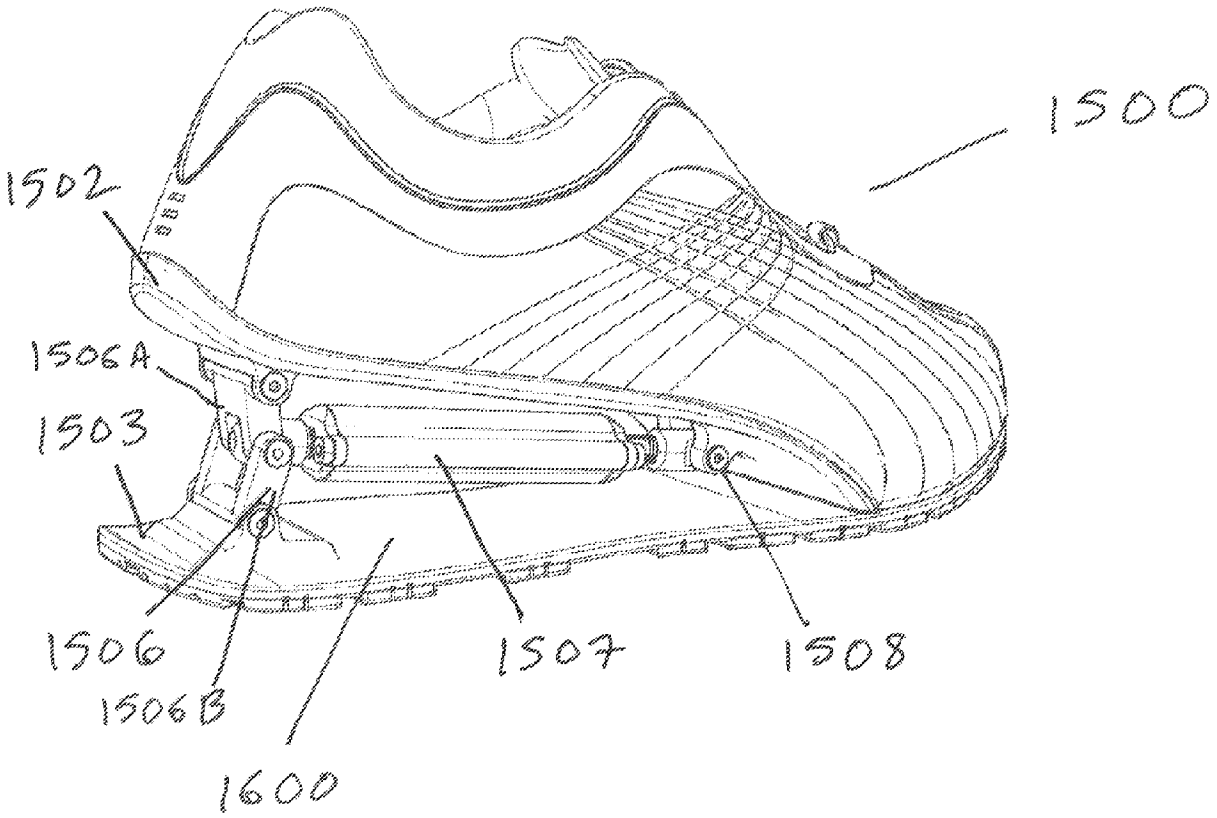
FIG. 53 is a view of a wearable exercise apparatus in an expanded configuration.
Figure 54:
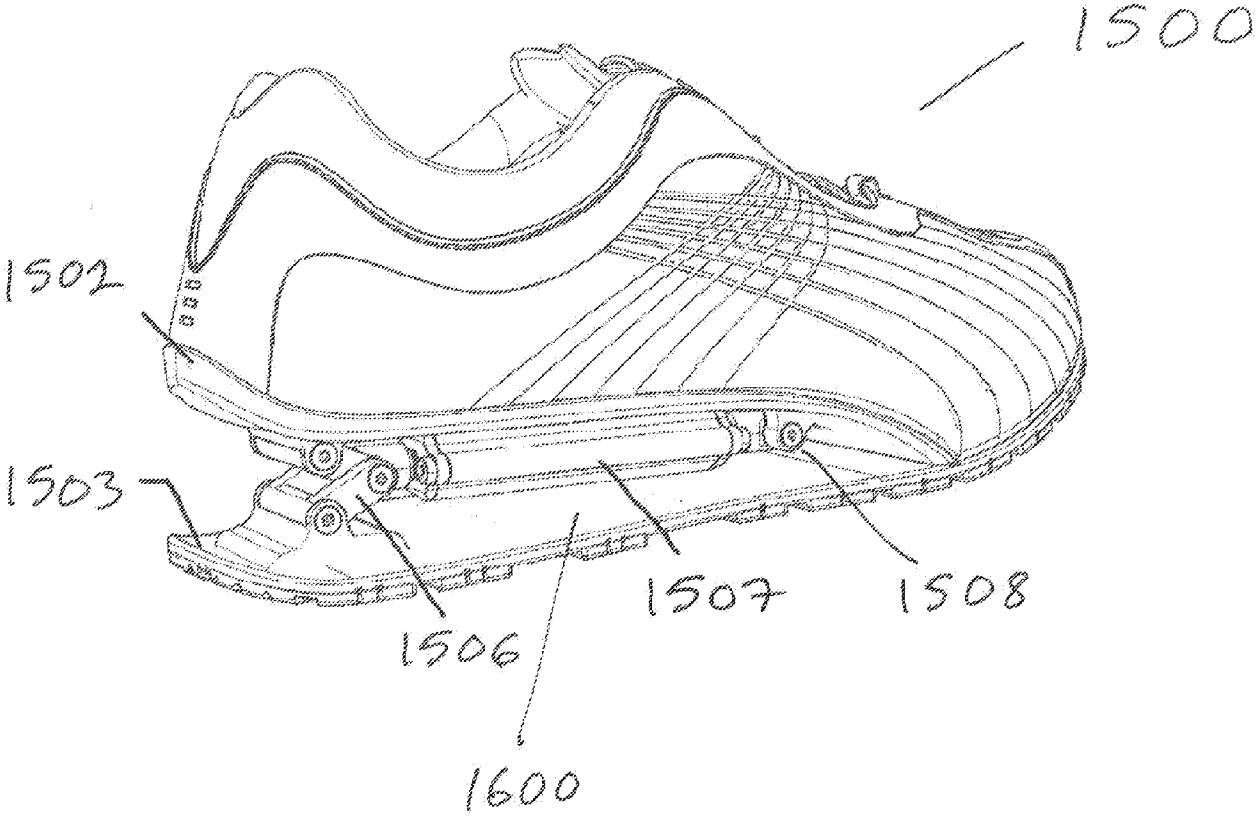
FIG. 54 is a view of a wearable exercise apparatus in a compressed configuration.

FIGS. 53 and 54 show an exercise apparatus in accordance with one embodiment. FIG. 53 shows exercise apparatus 1500 in an expanded configuration. FIG. 54 shows exercise apparatus 1500 in a compressed configuration. The expansion state, as defined by the distance between upper sole 1502 and lower sole 1503, can be controlled by collapsible resistance mechanism 1600. Mechanism 1600 can be configured to delay compression of the exercise apparatus for a period of time after a user steps onto the exercise apparatus to create vertical work as the user wears the exercise apparatus. Mechanism 1600 contains an upper sole 1502, lower sole 1503, linkage system 1506, linear resistance device 1507, and coupling device 1508. Linkage system 1506 contains an upper linkage member 1506A and lower linkage member 1506B. Upper linkage member 1506A is rotatably connected to upper sole 1502 and to lower linkage member 1506B. Lower linkage member 1506B is rotatably connected to lower sole 1503 and upper linkage member 1506A. Linear resistance device 1507 is rotatably connected to linkage system 1506 at the intersection of linkage members 1506A and 1506B, and also coupled to coupling device 1508. A substantial portion of vertical forces acting upon exercise apparatus 1500 are transferred to linear resistance device 1507 by linkage system 1506, which allows resistance device 1507 to control movement of exercise apparatus 1500 between expanded, partially expanded, and compressed configurations.

To create vertical work as the user walks or steps onto exercise apparatus 1500, linear resistance device 1507 can contain a delay feature to prohibit compression of resistance device 1507 (which can restrict the reduction off the distance between upper sole 1502 and lower sole 1503) for a period of time after substantial forces act upon it. Linear resistance device 1507 can be substantially similar to common shock absorbers, gas springs, lockable gas springs, dampeners, to linear resistance devices described in FIGS. 55-60, or other linear resistance devices capable of variable linear resistance. In other embodiments a linear resistance device is in communication with a control system including one or more sensors and a controller that directs the linear resistance device.

The connection between upper sole 1502 and lower sole 1503 is a living hinge. For example, upper sole 1502 and lower sole 1503 can be monolithically formed to have a one-piece construction. In other embodiments, the upper sole 1502 can be bonded, adhered, or otherwise coupled to the lower sole 1503 either directly or indirectly (i.e. through the bonding, adhering, or coupling of materials interposed between upper sole 1502 and lower sole 1503).

Figure 55:
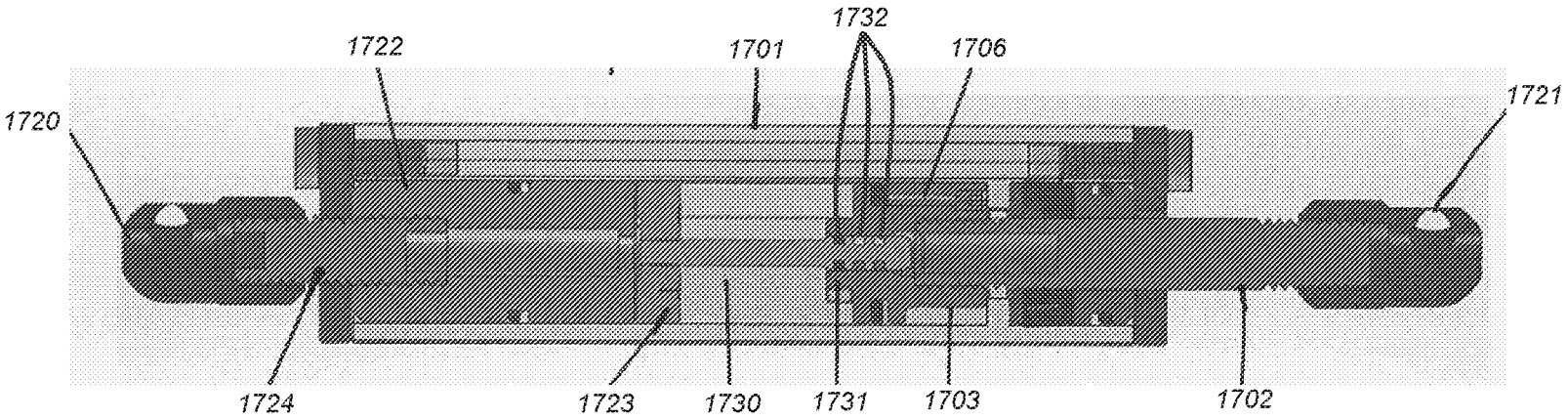
FIG. 55 is a cutaway view of a linear resistance device.
Figure 56:
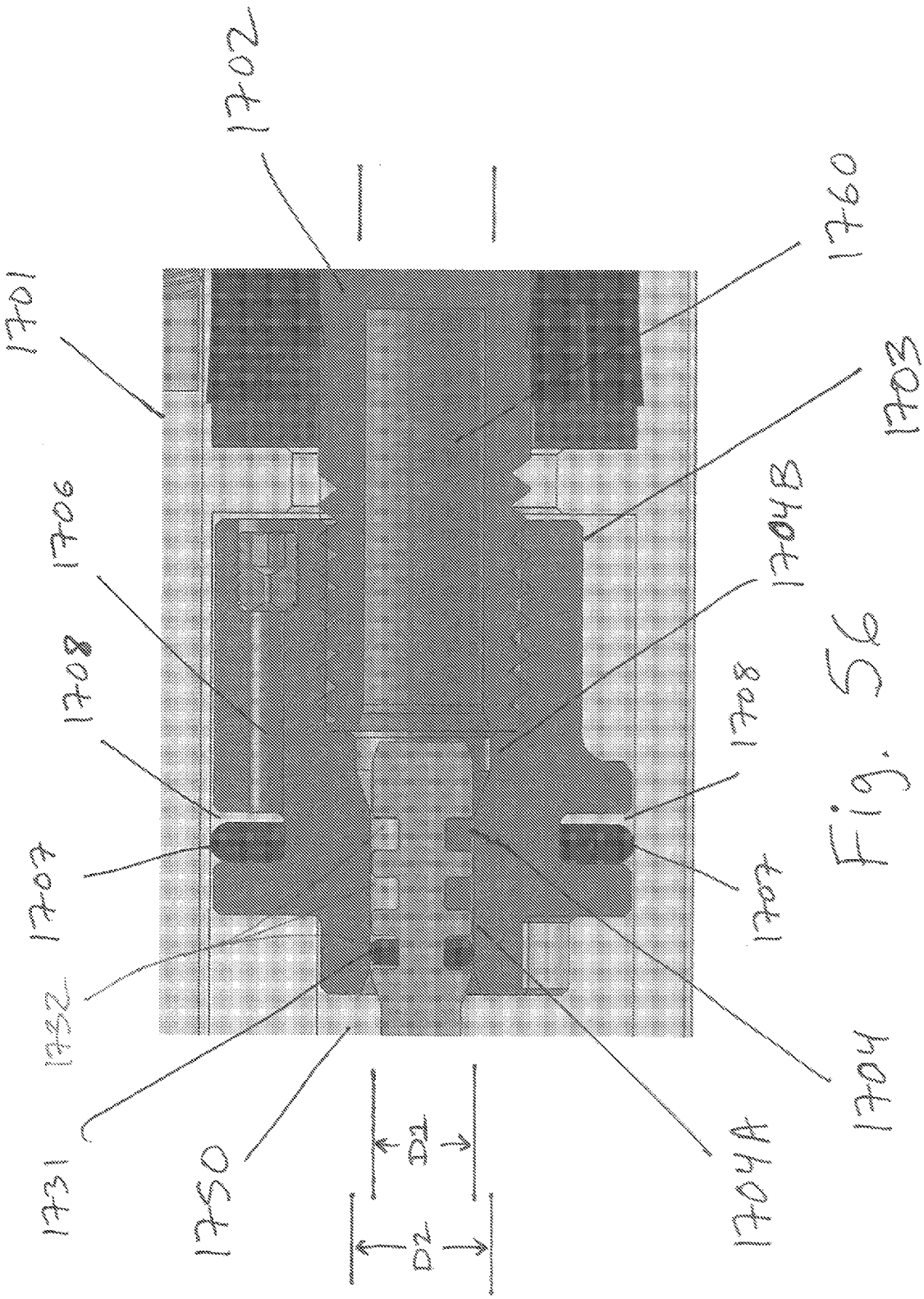
FIG. 56 is a cutaway sectional view of a portion of a linear resistance device.
Figure 57:
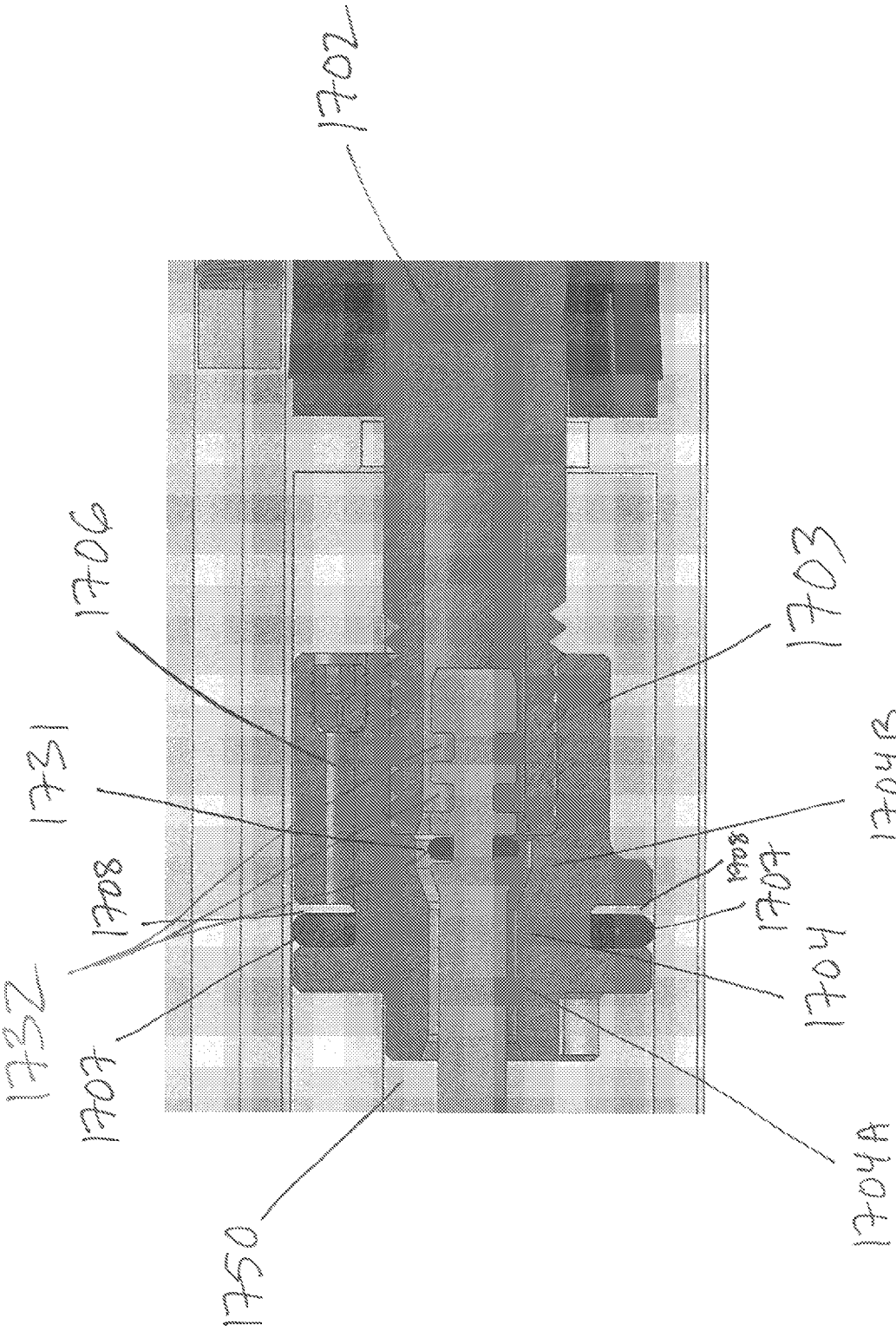
FIG. 57 is a cutaway sectional view of a portion of a linear resistance device.

FIGS. 55-57 show cutaway views of a linear resistance device that can be used to control the height of a portion of a wearable exercise apparatus. FIGS. 55 and 56 show the linear resistance device 1700 in an expanded configuration in full length and sectional views, respectively. FIG. 57 shows the linear resistance device in an intermediate configuration in a sectional view.

Linear resistance device 1700 can include housing 1701, shaft 1702, and coupling eyelets 1720 and 1721. Shaft 1702 is fixedly attached to both piston 1703 and coupling eyelet 1721. Coupling eyelet 1720 is fixedly attached to the non-shaft end of linear resistance device 1700. As forces act upon linear resistance device 1700, the distance between coupling eyelets 1720 and 1721 can be reduced subject to movement of fluid across piston 1703. Housing 1701 can contain fluids such as compressible gases (e.g., air, nitrogen, oxygen, and the like) and/or liquids such as water, hydraulic fluid, oil, and the like.

Piston engagement element 1730 is threaded into a housing 1723 which is bolted onto end cap 1722. End cap 1722 is adjustably located within the housing 1701 by selectable configuration of threaded attachment element 1724. The depth which element 1724 is screwed into the housing 1701 can determine the depth piston engagement element 1730 engages with piston engagement receptor orifice 1704. In this way fluid flow, and therefore performance characteristics of linear resistance device 1701, can be adjusted.

Other embodiments use different engagement element shapes and/or attachment means. For example, piston engagement element 1730 may be directly attached to end cap 1722, integrally formed with end cap 1722, or integrally formed with housing 1701. In some embodiments, other adjustment means are used to set the depth of piston engagement element. In some other embodiments the depth of element 1730 is not adjustable.

In some embodiments piston engagement element 1730 is not entirely fixedly attached. For instance it may be restricted from substantial movement towards or away from the ends of the housing but may have some "play" to allow piston engagement element 1730 to stay aligned with piston 1703. For instance, the attachment end of piston engagement element 1730 could be a ball coupled within a socket.

Piston 1703 includes a piston engagement receptor orifice 1704. Piston engagement element 1730 and piston engagement receptor orifice 1704 can be aligned such that as piston 1703 moves within the housing 1701, piston engagement element 1730 interfaces with piston engagement receptor orifice 1704.

Piston 1703 contains a circumferential groove 1708 which holds a seal 1707 that substantially limits the flow of fluid across the interface between piston 1703 and housing 1701 as the piston travels within the housing. Referring to FIG. 56, when linear resistance device 1700 moves towards the compressed configuration (during which piston 1703 moves left), seal 1707 moves to the right of groove 1708. During movement towards the compressed configuration, fluid flow between the left side of groove 1708 and seal 1707 and further through fixed orifice 1706 in part regulates flow of fluid across the piston. Other embodiments use other methods to in part regulate fluid across or around the piston. For instance, selecting an appropriate o-ring size and/or groove depth in the exterior of the piston can control the desired fluid flow between the piston and housing.

Movement of fluid across piston 1703 can be regulated at least in part by the interface 1750 of piston engagement element 1730, piston engagement receptor orifice 1704, and seal 1731 interposed between the two. The function of interface 1750 can be such that fluid flow rate across the interface 1750 can vary as the piston 1703 travels inside housing 1701. Geometries of piston engagement receptor orifice 1704 and piston engagement element 1730 can be selected such that fluid rate volume across interface 1750 can vary during different segments of the piston's travel. In the illustrated embodiment, the change in flow rate can be affected by the variable diameter of piston engagement receptor orifice 1704. Referring to FIG. 56, D1 is the diameter along one segment 1704A of orifice 1704 and diameter D2 is the diameter along a second segment 1704B.

In the expanded configuration of FIGS. 55 and 56, seal 1731, located in groove 1732 of piston engagement element 1730, is adjacent to segment 1704A of orifice 1704 with a diameter D1. As depicted in FIG. 57, as linear device 1700 compresses, when piston 1703 has moved to a position such that seal 1731 is no longer adjacent to segment 1704A of orifice 1704, fluid flow across interface 1750 can increase. This can allow the resistive force of the linear resistance device to be decreased, allowing faster compression of the device.

For a desired function of a linear resistance mechanism 1700 contained in a wearable exercise apparatus, a substantial difference in diameter D1 and D2 can be selected to initially minimize vertical movement of a portion of the exercise apparatus and subsequently accelerate vertical movement of a portion of the exercise apparatus. The volume of fluid allowed across interface 1750 as the seal 1731 is adjacent to an initial segment 1704A of orifice 1704 can be substantially zero or non-zero. The volume of fluid allowed across interface 1750 as the seal 1731 is no longer adjacent to segment 1704A can be substantially greater. If the initial volume of flow is non-zero, the secondary fluid flow can be 5×, 10×, or 50× the initial fluid flow, or ranges encompassing such ratios. Other ratios can be selected, if needed or desired.

Piston engagement element 1730 contains 3 grooves 1732 for holding one or more seals to allow for varying configurations or adjustments. It is understood that an engagement element could have a greater or lesser number of grooves 1732.

Piston 1703 can have a one-piece construction and is threaded onto the shaft 1702. In other embodiments, the piston can have a multi-piece construction and attached to the shaft using different methods. For instance, the piston may be made of a plurality of components and/or the shaft and piston may be stamped together, or both. Any portion of the shaft or any other component that is inserted into or attached adjacent to the piston can be considered part of the piston. For instance, cavity 1760 of FIG. 56 can be considered an extension of piston engagement receptor orifice 1704. In some embodiments, all or part of the piston engagement orifice 1704 is contained in the shaft 1702.

In the current embodiment, coupling eyelets 1720 and 1721 are threaded onto the linear resistance device. In other embodiments one or the other, but not both are threaded on. In yet other embodiments neither is threaded on. For example, a coupler eyelet may be integrally formed or stamped onto a shaft or end cap. In yet other embodiments the coupler connections are not eyelets. For instance, one or both coupler connections may be a ball or socket.

Figure 58:
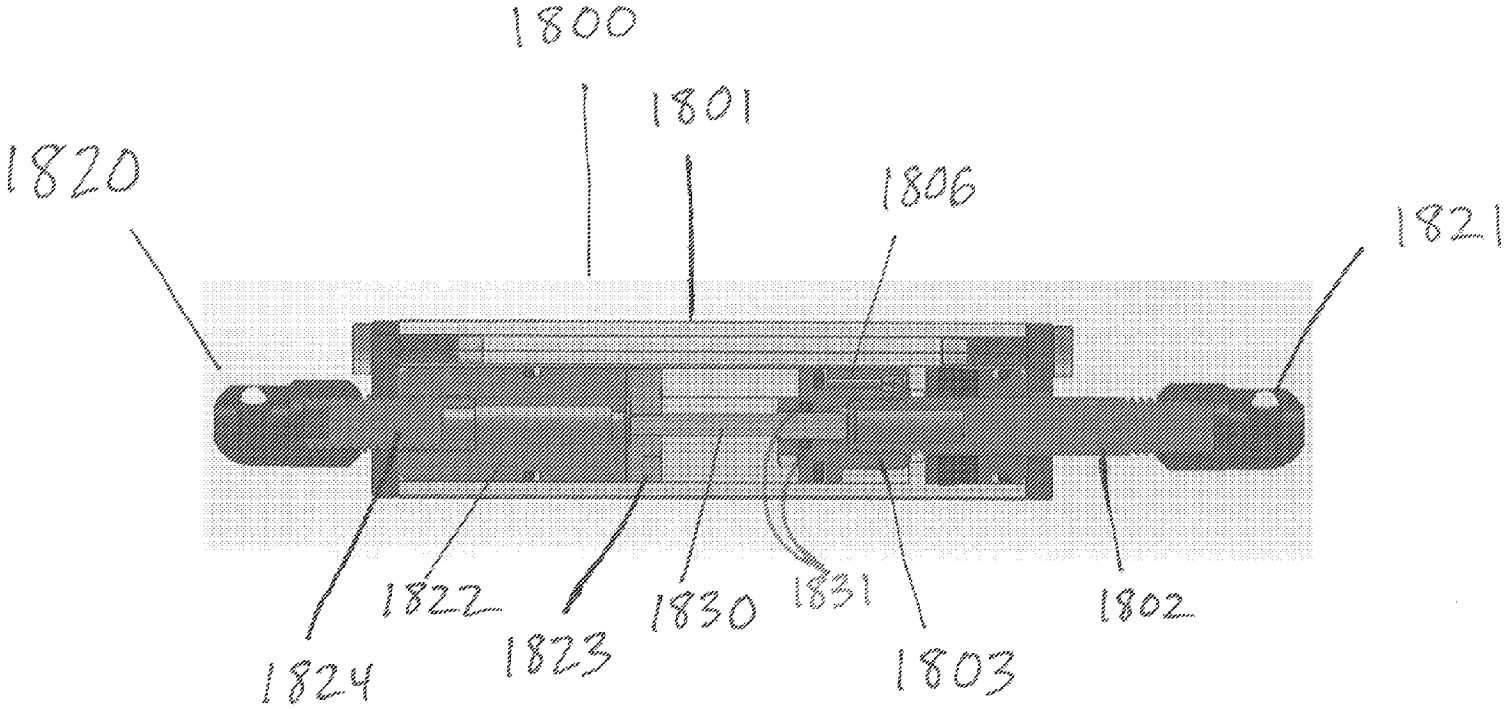
FIG. 58 is a cutaway view of a linear resistance device.
Figure 59:
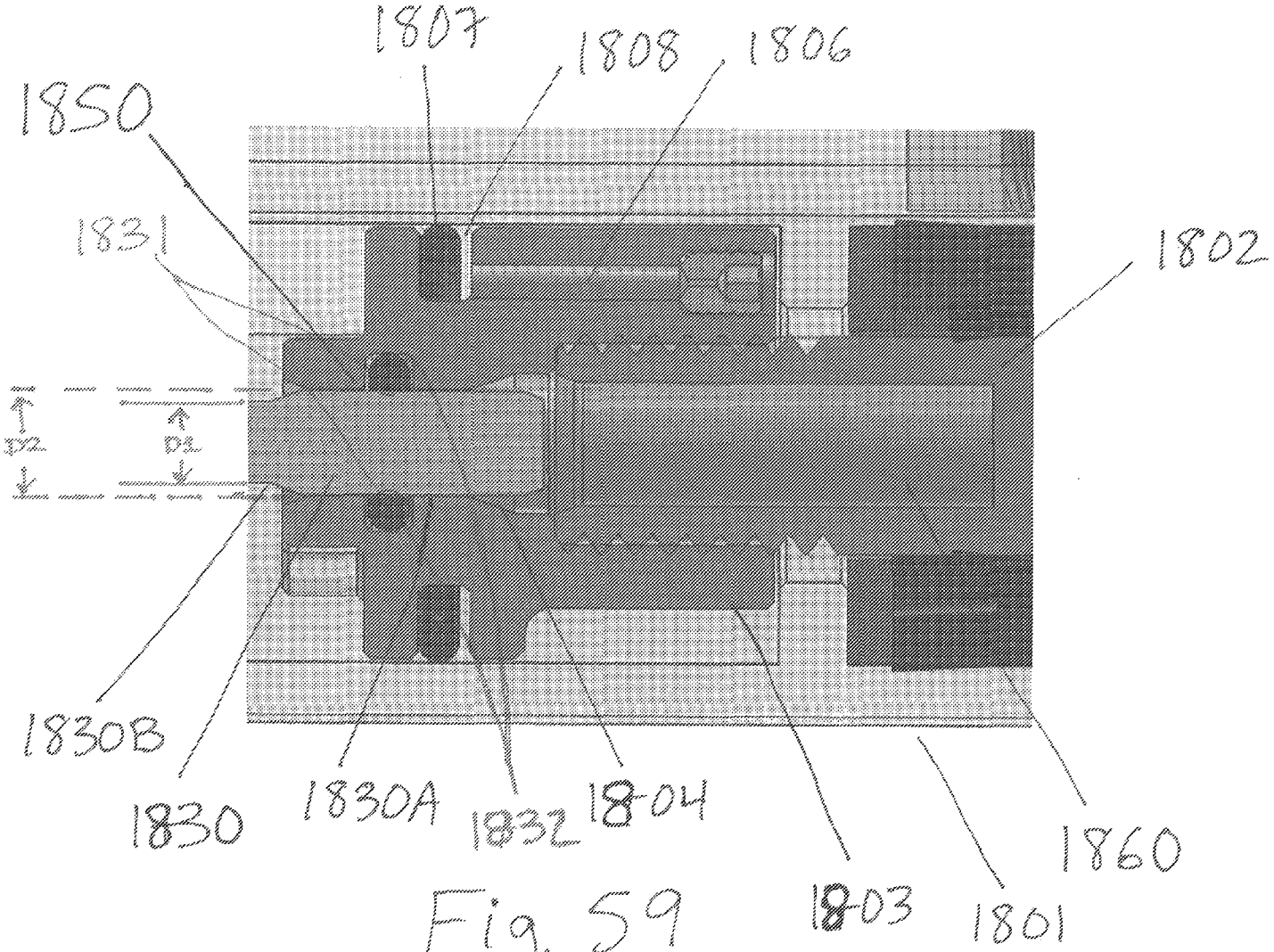
FIG. 59 is a cutaway sectional view of a portion of a linear resistance device.
Figure 60:
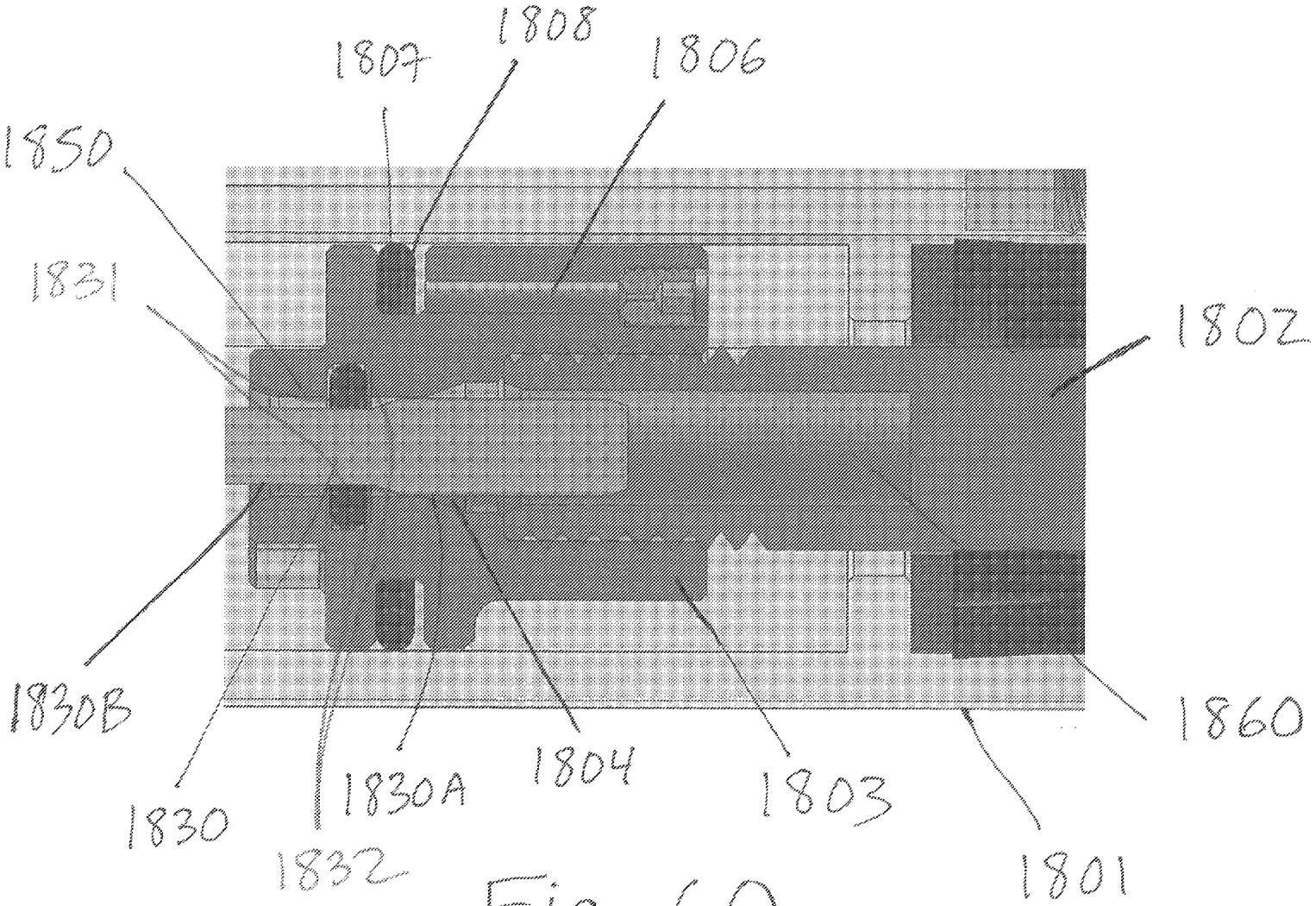
FIG. 60 is a cutaway sectional view of a portion of a linear resistance device.

FIGS. 58-60 show cutaway views of a linear resistance device similar to the linear resistance device of FIGS. 55-57. FIGS. 58 and 59 show the linear resistance device 1800 in an expanded configuration in full length and sectional views, respectively. FIG. 60 shows the linear resistance device in an intermediate configuration in a sectional view.

Distinguishing linear resistance device 1800 of FIGS. 58-60 from linear resistance device 1700 of FIGS. 55-57 is the interface 1850 that can variably regulate fluid flow across the piston 1803 as the piston moves through the housing 1800. In the interface 1750 of linear resistance device 1700 of FIGS. 55-57, the seal 1731 interposed between piston engagement element 1730 and piston engagement receptor orifice 1704 is attached to piston engagement element 1730. In the interface 1850 of linear resistance device 1800 of FIGS. 58-60, the seal 1831 interposed between piston engagement element 1830 and piston engagement receptor orifice 1804 is instead attached to piston 1803.

Piston engagement element 1830 can be attached within the housing at a location outside the range of the travel of the piston 1803. The element 1830 can be fixedly attached, rotatably attached (for instance a ball and socket joint), or adjustably attached to housing 1801 or other elements contained in housing 1801. Other engagement element shapes can be used.

Piston engagement element 1830 and piston engagement receptor orifice 1804 can be aligned such that as piston 1803 moves within the housing 1801, piston engagement element 1830 interfaces with piston engagement receptor orifice 1804.

Movement of fluid across piston 1803 can be regulated at least in part by the interface 1850 of piston engagement element 1830, piston engagement receptor orifice 1804, and seal 1831 interposed between the two. The function of interface 1850 can be such that fluid flow rate across the interface 1850 can vary as the piston 1803 travels inside in housing 1801. Geometries of piston engagement element orifice 1804 and piston engagement element 1830 can be selected such that fluid rate across interface 1850 can vary among different segments of the piston's travel. In the illustrated embodiment, the change in flow rate can be affected by the variable diameter of piston engagement element 1830. Referring to FIG. 59, D2 is the diameter along one segment 1830A of element 1830 and diameter D1 is the diameter along a second segment 1830B.

In the expanded configuration of FIGS. 58 and 59, seal 1831, located in groove 1832 of piston 1803, is adjacent to segment 1803A of element 1830 with a diameter D2. As depicted in FIG. 60, as linear device 1800 compresses, when piston 1803 has moved to a position such that seal 1731 is no longer adjacent to segment 1830A of element 1830, fluid flow across interface 1850 can increase. This can allow the resistive force of the linear resistance device to be decreased, allowing faster compression of the device.

For a desired function of a linear resistance mechanism 1800 contained in a wearable exercise apparatus, a substantial difference between diameters D2 and D1 can be selected to initially minimize vertical movement of a portion of the exercise apparatus and subsequently accelerate vertical movement of a portion of the exercise apparatus. The volume of fluid allowed across interface 1850 as the seal 1831 is adjacent to an initial segment 1830A of element 1830 can be substantially zero or non-zero. The volume of fluid allowed across interface 1850 as the seal 1831 is no longer adjacent to segment 1830A can be substantially greater. If the initial volume of flow is non-zero, the secondary fluid flow can by 5×, 10×, or 50× the initial fluid flow, or ranges encompassing such ratios. Other ratios can be selected, if needed or desired.

Piston engagement element orifice 1804 contains a groove 1832 for containing a seal. Groove 1832 can be located at other locations in orifice 1804 or in cavity 1860 of the shaft 1802. More than one seal located in more than one groove can be used.

Piston 1804 can have a one-piece or multi piece construction. Piston and shaft can be joined by threading, stamping, chemical bonding, or heat bonding. Other means of joining piston and shaft can be used. The piston and shaft may be formed as one piece. Any portion of the shaft or any other component that is inserted into or attached adjacent to the piston can be considered part of the piston. For instance, cavity 1860 of FIG. 59 can be considered an extension of piston engagement orifice 1804. In some embodiments, all or part of the piston engagement orifice 1804 is contained in the shaft 1802.

Each of the exercise apparatuses disclosed herein can have different types of programs or programmable logic devices that evaluate when the other exercise apparatus has completed or is expected to complete a full gait such that the compressed exercise apparatus can be lifted from the ground, as discussed above. The exercise apparatuses can be allowed to compress based on the completion of the gait. This increases or maximizes the vertical work and also allows the expanded exercise apparatus to close as soon as the compressed exercise apparatus is off the ground.

Embodiments of the technology and the operations described in this specification can be implemented using controllers with digital electronic circuitry, computer software, firmware, or hardware. These components can also be coupled to or incorporated into the exercise apparatuses disclosed herein. Embodiments of the subject matter described in this specification can be implemented using one or more computer programs, i.e., one or more modules of computer program instructions, encoded on a computer storage medium for execution by, or to control the operation of, the step-up apparatuses.

The controllers disclosed herein can include, without limitation, a programmed processor and a computer storage medium that can be, or can be included in, a computer-readable storage device, a computer-readable storage substrate, a random or serial access memory array or device, or a combination thereof. While a computer storage medium is not a propagated signal, a computer storage medium can be a source or destination of computer program instructions encoded in an artificially generated propagated signal. In some embodiments, a controller can contain a processor and a memory. The controller can be powered by an internal power supply (e.g., one or more batteries) or an external power supply (e.g., one or more batteries, an AC outlet, etc.). Leads can couple external power supplies to the controller. The controller can receive input from sensor leads.

The controller can include one or more wireless transmit/receive devices to send and/or receive data to/from other exercise apparatus(es) and/or other external devices. The controller can control resistance devices through a control output lead. In some embodiments, controllers include a user input/output lead ("I/O lead"). The I/O lead can be used to interact with an I/O device. The I/O device allows the user to set and monitor exercise apparatus settings. These settings may include, among other things, level of exercise, apparatus expansion parameters (e.g., maximum expansion height, minimum expansion height, etc.), exercise program selections, etc. When a user selects a desired setting, the controller can store the user's preference in its memory. The I/O lead can also be used to send data to an I/O device to display data regarding the exercise received, including number of steps taken, miles walked, vertical work performed, calories burned, and the like. A transmitter can send data to another device or component and can be part of the controller or a separate component. Footwear wearable devices can be interconnected by any form or medium of digital data communication, e.g., a communication network suitable for TX/RX devices. Examples of communication networks include a local area network ("LAN") and a wide area network ("WAN"), an inter-network (e.g., the Internet), and peer-to-peer networks (e.g., ad hoc peer-to-peer networks).

The term "programmed processor" encompasses all kinds of apparatuses, devices, and machines for processing data, including by way of example a programmable microprocessor, a smartphone, a tablet, a computer, a system on a chip, or more than one of, or combinations of, the foregoing. The apparatus can include special purpose logic circuitry, e.g., an FPGA (field programmable gate array) or an ASIC (application-specific integrated circuit). A process can receive data from one or more sensor leads, transmit/receive devices, receivers, or the like. The data can be used in computations, alone or in combination with other data (for instance, data stored in the controller's memory). Memory can be used to store a wide range of data (e.g., raw data, processed data, output from computations, calibration data, or the like). The data can be used to control aspects of the exercise apparatus to set or modify the resistance of resistance components. Memory can store information from previous sessions or steps of the exercise apparatus. The information can include raw data, processed data, best fit curves, control maps, tables (e.g., lookup tables), programs, and the like. Memory can be non-removable memory and/or removable memory. Non-removable memory includes, without limitation, random-access memory (RAM), read-only memory (ROM), a hard disk, or any other type of memory storage device. Removable memory includes, without limitation, a subscriber identity module (SIM) card, a memory stick, a secure digital (SD) memory card, and the like. Memory can be incorporated into the controller or carried by an exercise apparatus. In other embodiments, information can be accessed from, and stored in, external memory (e.g., memory that is not physically located on the exercise apparatus). For example, information can be stored on a server, smart phone or other portable device, a home computer, or an external storage device.

To enhance operation, a controller may record the amount of force upon the apparatus when the user initially stepped on it, the amount of force on the apparatus when the step-up mechanism was fully compressed, the speed with which the user walked, the angle of the footwear at the beginning, middle, and/or end of the user's gait, the length of the user's stride, or the like. In some embodiments, the controller records the relevant data occasionally to calibrate the apparatus. In other embodiments, the controller records the data with each step. In some embodiments, the controller records data from multiple steps and computes an average for a given metric, discards readings that are outside a range, and/or arrives at a parameter through other calculations/equations using data from multiple steps.

A controller may modify the descent speed and/or level of dampening multiple times during a single compression of an exercise apparatus. To facilitate lowering the user's center of gravity as fast as possible, a controller may minimize dampening forces of the apparatus for a significant portion of the device's compression. The controller may increase dampening forces near the end of the device's compression. Increased dampening at or near the end of compression can provide the user with a more comfortable experience. Increased dampening may be selected to absorb energy near the end of the user's gait to increase the level of exercise the user receives or to deliver increased exercise to specific muscles.

The timing of when dampening is modified during compression may be based on data obtained during the current step, data from previous steps on the current apparatus, data from the current step on another apparatus, and/or data from previous steps on another apparatus. For instance, sensor data from one or more previous steps on the current apparatus may be used to set an appropriate level of dampening for the current step.

The timing and/or level of dampening may be affected by data from the other exercise apparatus. When the user is stepping from the current exercise apparatus to the other one, dampening may be modified based on when the user begins stepping on the other device, how much force the user has exerted on the other device, or the like. To increase exercise while a user is stepping off a device, the step-up mechanism may be prohibited from fully compressing until the user has begun stepping up onto the other exercise apparatus. This would absorb some of the energy the user expends while stepping onto the other footwear apparatus as compared to stepping off of a fully closed apparatus.

To provide for interaction with a user, embodiments of the subject matter described in this specification can be implemented using a controller having a display device, e.g., an LCD (liquid crystal display), LED (light emitting diode) display, or OLED (organic light emitting diode) display, for displaying information to the user. The embodiments may have and a keyboard; a pointing device, e.g., a mouse or a trackball; touch screen; one or more buttons; or one or more knobs by which the user can provide input to the computer. The displayed information can include workout information (e.g., calories burned, workout time, etc.), routines (e.g., high cardiovascular routines, low cardiovascular routines, targeted muscle routines, calibration routines, etc.), workout history, user profiles, settings, or the like. In some implementations, a touch screen can be used to display information and receive input from a user. Other kinds of devices can be used to provide for interaction with a user as well; for example, feedback provided to the user can be in any form of sensory feedback, e.g., visual feedback, auditory feedback, or tactile feedback, and input from the user can be received in any form, including acoustic, speech, or tactile input.

It should be noted that, as used in this specification and the appended claims, the singular forms "a," "an," and "the" include plural referents unless the context clearly dictates otherwise. It should also be noted that the term "or" is generally employed in its sense including "and/or" unless the content clearly dictates otherwise.

Various methods and techniques described above provide a number of ways to carry out the invention. Of course, it is to be understood that not necessarily all objectives or advantages described may be achieved in accordance with any particular embodiment described herein. Thus, for example, those skilled in the art will recognize that the methods may be performed in a manner that achieves or optimizes one advantage or group of advantages as taught herein without necessarily achieving other objectives or advantages as may be taught or suggested herein.

The exercise apparatus disclosed herein can be worn to provide a workout that is appreciably similar to workouts provided by climbing stairs, climbing slopes, hiking, walking in sand or gravel, or using a StairMaster machine. For example, a user can wear the apparatuses indoors while performing everyday chores and activities. In outdoor applications, the user can wear the apparatuses on generally flat surfaces that can be found at shopping centers, malls, parks, sidewalks, or the like. The apparatuses can provide a motion that generally simulates climbing stairs to provide a vigorous workout even though the user is traveling across these generally flat surfaces. Of course, the apparatuses can be worn while traveling along uneven surfaces (e.g., while hiking) and on relatively steep inclines or declines. Traveling is broadly construed to include, without limitation, walking, running, jogging, or the like. In some embodiments, the exercise apparatuses can be used in aerobic classes. For example, a user can lock one exercise apparatus in an extended configuration and the other exercise apparatus in a collapsed configuration to perform step-up routines. The user can then step in place.

Furthermore, the skilled artisan will recognize the interchangeability of various features from different embodiments disclosed herein. Similarly, the various features and acts discussed above, as well as other known equivalents for each such feature or act, can be mixed and matched by one of ordinary skill in this art to perform methods in accordance with principles described herein. Additionally, the methods that are described and illustrated herein are not limited to the exact sequence of acts described, nor are they necessarily limited to the practice of all of the acts set forth. Other sequences of events or acts, or less than all of the events, or simultaneous occurrence of the events, may be utilized in practicing the embodiments of the invention.

U.S. application Ser. No. 12/865,695 is incorporated herein by reference in its entirety. The above-mentioned reference is attached hereto as an Appendix, the entirety of which is hereby incorporated by reference herein and made a part of this specification. The embodiments, exercise apparatus components, features, systems, devices, methods, and techniques described herein may, in some embodiments, be similar to any one or more of the embodiments, features, systems, devices, materials, methods, and techniques described in U.S. application Ser. No. 12/865,695. In addition, the embodiments, features, systems, devices, materials, methods, and techniques described herein may, in certain embodiments, be applied to or used in connection with any one or more of the embodiments, features, systems, devices, materials, methods, and techniques disclosed in the above-mentioned U.S. application Ser. No. 12/865,695. For example, the dampeners, expandable members, biasing members, and other components and features (e.g., force relationships, methods of operation, etc.) disclosed in U.S. application Ser. No. 12/865,695 may incorporate the embodiments disclosed herein.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, it is not intended that the invention be limited, except as by the appended claims.

What is claimed is:

1. A wearable footwear apparatus, comprising:

an articulating step-up sole assembly including a support platform having a toe support region and a heel support region; and a swing arm mechanism movable between an expanded configuration and an unexpanded configuration, the swing arm mechanism including a pivotable sole plate for contacting the ground, the sole plate having a forward portion and a heel portion, the forward portion being rotatably coupled to the support platform at a location forward of the heel support region, and a resistance device coupled to the pivotable sole plate and having a locked state and an unlocked state, wherein the resistance device in the locked state keeps the swing arm mechanism in the expanded configuration while a user raises most of the user's body mass onto the swing arm mechanism, wherein after the user has raised most of the user's body mass onto the swing arm mechanism held open by the resistance device, the resistance device switches to the unlocked state in which the resistance device operates to allow the heel support region to move towards the heel portion of the sole plate to lower the user's body towards the ground.

2. The footwear apparatus of claim 1 wherein the sole plate is rotatable about an axis of rotation that is positioned proximate to the toe support region.

3. The footwear apparatus of claim 2 wherein the axis of rotation is positioned underneath the user's toes or ball of the user's foot during use.

4. The footwear apparatus of claim 1, further comprising a pin extending through the sole plate and the support platform.

5. The footwear apparatus of claim 1 wherein the support platform rotates an angle of at least 10 degrees relative to the sole plate as the swing arm mechanism moves from the expanded configuration to the unexpanded configuration.

6. The footwear apparatus of claim 1 wherein a rearward end of the heel portion is positioned forward of the back of the user's heel when the swing arm mechanism is in the unexpanded configuration.

7. The footwear apparatus of claim 1 wherein a rearward end of the heel portion is positioned approximately below the center of the user's heel when the swing arm mechanism is in the unexpanded configuration.

8. The footwear apparatus of claim 1 wherein the swing arm mechanism has a V-shaped configuration and the sole plate is rotatable about an axis of rotation that is located underneath the toes or ball of the user's foot.

9. The footwear apparatus of claim 1 wherein the resistance device comprises a locking device that keeps the swing arm mechanism in the expanded configuration until the locking device unlocks in response to body movement of the user.

10. The footwear apparatus of claim 1 wherein the resistance device comprises a locking device that keeps the swing arm mechanism in the expanded configuration for a predetermined length of time after the user steps on the footwear apparatus.

11. The footwear apparatus of claim 1, further comprising:

a locking mechanism that keeps the swing arm mechanism in the expanded configuration when locked and that allows the swing arm mechanism to move to the unexpanded configuration when unlocked; and a release mechanism connected to the locking mechanism, wherein the release mechanism unlocks the locking mechanism in response to at least one of movement of the user's body or a predetermined period of time.

12. The footwear apparatus of claim 1, further comprising:

a foot restraining system having at least one strap for wrapping around and holding the user's foot against the support platform.

13. The footwear apparatus of claim 1, further comprising:

a shoe upper connected to the articulating step-up sole assembly.

14. The footwear apparatus of claim 1, wherein the resistance device automatically switches from the locked state to the unlocked state in response to the user transferring weight forwardly along the articulating step-up sole assembly.

15. The footwear apparatus of claim 1, wherein the resistance device includes a piston spring assembly and a locking device, wherein the locking device substantially eliminates compression of the piston spring assembly when the resistance device is in the locked state such that the swing arm mechanism begins to collapse an appreciable amount after most of the user's weight is supported by the articulating step-up sole assembly.

16. The footwear apparatus of claim 1, further comprising:

a sensor; and a controller communicatively coupled to the sensor and being programmed to control operation of the footwear apparatus based on one or more signals from the sensor.

17. An exercise system, comprising:

a first footwear apparatus wearable on a foot of a user, the first footwear apparatus including a first articulating step-up sole assembly and at least one first sensor, wherein the first articulating step-up sole assembly includes a first resistance device having a locked state and an unlocked state, wherein the first resistance device in the locked state keeps the first articulating step-up sole assembly in a V-shaped configuration while the user raises most of the user's body mass onto the first articulating step-up sole assembly, and wherein the first resistance device in the unlocked state allows the first articulating step-up sole assembly to begin collapsing from the V-shaped configuration to a lowered configuration after most of the user's body mass is held up by the first articulating step-up sole assembly;

a second footwear apparatus wearable on the other foot of the user, the second footwear apparatus including a second articulating step-up sole assembly and at least one second sensor, wherein the second articulating step-up sole assembly includes a second resistance device having a locked state and an unlocked state, wherein the second resistance device in the locked state keeps the second articulating step-up sole assembly in a V-shaped configuration while the user raises most of the user's body mass onto the second articulating step-up sole assembly, and wherein the second resistance device in the unlocked state allows the second articulating step-up sole assembly to begin collapsing from the V-shaped configuration to a lowered configuration after most of the user's body mass is held up by the second articulating step-up sole assembly; and a controller communicatively coupled to the at least one first sensor and the at least one second sensor, the controller being programmed to control operation of the second footwear apparatus based on one or more signals from the at least one first sensor.

18. The exercise system of claim 17 wherein the controller is programmed to determine at least one of a desired rate of collapse of the second footwear apparatus, a time delay for collapse, and target configurations of the second footwear apparatus.

19. The exercise system of claim 17 wherein the controller comprises at least one of a smartphone, a tablet, or a computer.

20. The exercise system of claim 17 wherein the controller is physically coupled to one of the first footwear apparatus and the second footwear apparatus.

21. The exercise system of claim 17, wherein the controller is programmed to cause the first resistance device to switch from the locked state to the unlocked state based on one or more signals from the at least one second sensor, and wherein the controller is programmed to cause the second resistance device to switch from the locked state to the unlocked state based on one or more signals from the at least one first sensor.

22. The exercise system of claim 17, wherein the controller is programmed to cause the first resistance device to switch from the locked state to the unlocked state based on one or more signals from the at least one first sensor.

23. The footwear apparatus of claim 1, wherein the pivotable sole plate is shorter than the support platform such that a rearward end of the pivotable sole plate is positioned general under a central region of the heel support region when the swing arm mechanism is in the expanded configuration and the pivotable sole plate is at a horizontal orientation.

24. The footwear apparatus of claim 23, wherein a ratio of a length of forward offset of the pivotable sole plate to a horizontal distance is in a range of about 0.1 to about 0.4 when the swing arm mechanism is in an expanded configuration and the pivotable sole plate is oriented horizontally, and wherein the horizontal distance is from a front end of footwear of the wearable footwear apparatus to a point below a rearward end of the footwear.

25. The footwear apparatus of claim 23, wherein the rearward end of the pivotable sole plate is positioned to initially strike a horizontal support surface when the support platform is at a substantially horizontal orientation during use.

26. A wearable footwear apparatus, comprising:

an articulating step-up sole assembly including a support platform having a toe support region and a heel support region; and a swing arm mechanism movable relative to the support platform and including a sole that is shorter than the support platform such that a central region of the heel support region is positioned substantially directly above a rearward end of the sole when the sole is at a generally horizontal orientation and the articulating step-up sole assembly is in an expanded V-shaped configuration, a resistance device pivotally coupled to a forward portion of the articulating step-up sole assembly and having a locked state and an unlocked state, an upper link and a lower link pivotally coupling a rearward portion of the resistance device to the support platform and the sole, respectively, such that the resistance device in the locked state substantially prevents rotation of the upper and lower links to hold the articulating step-up sole assembly in the expanded V-shaped configuration while a user raises most of the user's body mass onto the swing arm mechanism, and the resistance device in the unlocked state allows rotation of the upper and lower links to allow the heel support region to move towards a heel portion of the sole to lower the user's body toward the ground during use.

* * * * *